United States Patent [19]

Miyoshi et al.

[11] Patent Number: 4,914,016

[45] Date of Patent: Apr. 3, 1990

[54] SILVER HALIDE PHOTOGRAPHIC LIGHT-SENSITIVE MATERIAL AND PROCESSING METHOD THEREFOR

[75] Inventors: Masanobu Miyoshi; Makoto Kajiwara, both of Odawara; Shigeo Tanaka, Tachikawa; Mitsuhiro Okumura, Sagamihara, all of Japan

[73] Assignee: Konica Corporation, Tokyo, Japan

[21] Appl. No.: 199,803

[22] Filed: May 27, 1988

[30] Foreign Application Priority Data

| | | | |
|---|---|---|---|
| May 31, 1987 | [JP] | Japan | 62-135878 |
| May 31, 1987 | [JP] | Japan | 62-135879 |
| Jun. 10, 1987 | [JP] | Japan | 62-144792 |
| Jun. 13, 1987 | [JP] | Japan | 62-147711 |
| Jun. 16, 1987 | [JP] | Japan | 62-149400 |
| Jun. 18, 1987 | [JP] | Japan | 62-150216 |
| Jul. 25, 1987 | [JP] | Japan | 62-186355 |

[51] Int. Cl.[4] ..... G03C 1/06

[52] U.S. Cl. ..... 430/603; 430/605; 430/614; 430/448

[58] Field of Search ..... 430/603, 608, 448, 551, 430/605, 614

[56] References Cited

U.S. PATENT DOCUMENTS 3,189,458 6/1965 Herz ..... 430/603

*Primary Examiner*—Paul R. Michl
*Assistant Examiner*—Janet C. Baxter
*Attorney, Agent, or Firm*—Finnegan, Henderson, Farabow, Garrett and Dunner

[57] ABSTRACT

A silver halide photographic light-sensitive material containing inorganic sulfur or elemental sulfur, and a processing method comprising a step for developing such photographic material with a color developer which contains an aromatic primary amine compound for not more than 60 seconds. Photographic image improved in contrast of the without degradation in sensitivity and fogging can be obtained by the photographic material and the processing method.

66 Claims, No Drawings

SILVER HALIDE PHOTOGRAPHIC LIGHT-SENSITIVE MATERIAL AND PROCESSING METHOD THEREFOR

FIELD OF THE INVENTION

The present invention relates to a silver halide photographic light-sensitive material having high sensitivity and low fog as well as preferable characteristic of gradation.

BACKGROUND OF THE INVENTION

The photographic quality of silver halide photographic light-sensitive materials is evaluated based on gradation, sensitivity and fog. Stimulated by the recent trend in the photographic art for increased sensitivity, excellent gradation and sensitivity with low fog have been demanded. Therefore, the development of technique that meets the strong demand for all of the high sensitivity, low fog, and harder gradation or high contrast is strongly needed.

To meet the need above, several methods have been developed in order to obtain photographic light-sensitive materials having high sensitivity and higher contrast as well as low fog. The methods usually used in the art to attain high sensitivity include those, for example, disclosed in British Pat. No. 1,315,755, Japanese Patent Examined Publication No. 15748/1969, U.S. Pat. Nos. 2,410,689, 2,983,610, 3,297,446, 3,441,914, 3,591,384, 3,761,267, 3,901,714, 4,054,457, 4,067,740, Research Disclosure Nos. 12008, 13452, and 13654; and "The Theory of the Photographic Process" (4th Ed., Nacoillan, 1977), pp.67–76. However, these methods often provides dilemma; improving sensitivity often incurs greater fog, or lower contrast.

With respect to production of contrasty gradation in picture images research work by the photographic material industry is being devoted to designing silver halide photographic sensitive materials which have desirable gradation characteristics adapted to the specific uses. The gradation property can be broadly divided into the gradation in the range from high density to medium density hereinafter referred to as "shoulder gradation", and that in the range from medium density to low density, hereinafter referred to as "toe gradation", which both are an important property bearing significantly upon the picture images in vividness and sharpness produced in silver halide photographic sensitive materials.

One widely known technique for controlling the gradation and keeping it from decreasing of contrast is to change the quantity of the coated silver. This is the most easiest method for the purpose, but usually, this technique applies only to slight adjustments or the like because of the defect that the maximum density is affected, and, moreover, the technique has little effect for controlling the toe gradation.

Another technique familiarized to the photographic material industry is a method in which silver halide emulsions in a plurality of kinds which have the same color-sensitivity but varient sensitivities and have a more contrasty gradation characteristic than is required are contained in one and the same emulsion layer or separately in a plurality of emulsion layers with the same color-sensitivity.

Although this method prevents the contrast from decreasing, yet it is impossible for the method to make the resultant gradation more contrasty than that of said silver halide emulsions of a plurality of kinds used in a mixture and still more so to make the toe gradation of a silver halide emulsion contrasty.

The conventional methods for attaining higher contrast in order to obtain preferred photographic light-sensitive materials include a method of introducing rhodium into silver halide grains, as a doping agent; a method utilizing lith development, wherein hydroquinone is used as a developing agent and a developer having low concentration of sulfite ion is used in treatment; a method using tetrazolium salt, for example, Japanese Patent Publication Open to Public Inspection, hereinafter referred to as Japanese Patent O.P.I. Publication, No. 140340/1987; and a method using hydrazine derivatives for example, Japanese Patent O.P.I. Publication No. 223774/1986.

However, these methods entail drawbacks such as significant desensitization, greater fog, and deteriorated storage stability, and, at the same time, require a special processing solution in the treatment processes.

Particularly, when color photographic light-sensitive materials are treated with these methods, higher contrast is not satisfactorily attained.

A method less susceptible to photographic property deterioration and being readily practicable is a method that increase the coating weights of silver halide and couplers. However, requiring an increased amount of silver, this method disadvantageously incurs increase in cost and the application thereof has been limited to a specific field. A method using a monodispersed emulsion disclosed in Japanese Patent O.P.I. Publication No. 243454/1986 is a method effective in attaining higher contrast. However, this method attains higher contrast often at the cost of tone reproduction because of the balance needed to be coordinated with other photographic properties. Therefore, the method is still unsatisfactory, neccesitating additional means for higher contrast.

To satisfy three photographic criteria i.e. higher sensitivity, smaller fog, and higher contrast, methods for performing chemical sensitization in the presence of tetrazaindene compound were disclosed in Japanese Patent O.P.I. Publication Nos. 126526/1983, and 237545/1985. However, the effects of these methods are still unsatisfactory, and, furthermore, virtually ineffective for high chloride emulsions having high content of silver chloride.

On the other hand, properties of the silver halide photographic material are varied with exposure condition made on which namely sensitivity or contrast of the photographic material is decreased when the material is exposed for long duration with low intensity light or for short duration with high intensity light. Such phenomenon is called as reciprocity failure.

Generally, as explained in "Dictionary of Photographic terms" edited by Photographic Term Committee of Photographic Society of Japan, published by Photo Industry Publishing Company, the term, reciprocity failure means that reciprocity law is not accorded. Phot chemical reaction is ususally progressed in proportion to an irradiated light amount, i.e. the product of a light intensity and an irradiating time, but there may be some instances where the law may not be accorded. The lather is named reciprocity failure. In photosensitive process of silver halide, the reciprocity law is not applicable when the intensity of light is too high or low, and phenomena called high intensity reciprocity failure and low intensity reciprocity failure respectively will often occur.

On the other hand, silver halide light-sensitive materials are required to improve photographic characteristics for adapting various photographing or printing conditions, in particular, the reciprocity failure of photosensitive materials which greatly relate to slope characteristics during printing is one of important characteristics.

As described as slope control in "Dictionary of Photographic Terms" (mentioned above), Page 139, the image density and color balance of a print will be varied when the exposure of the same subject is changed to photograph with a color negative film and the negative is printed by an printer of integral neutral type will be varied. When taking exposure values changed from a proper exposure of the color negative as the abscissa of a graph and taking the reflection density of each color image of the print as the ordinate, the density curves are deviated from a holizontal line. Such deviated curves are called slopes. Generally, the lopes for three colors are different from each other. Changes in printing density and in color balance with respect to the density of the negative film are called slope characteristics. The slope characteristics depend greatly on by the shape of characteristic curve of the negative, the deviation of the average transmitted light of the negative, the performance of the printer, and the reciprocity failure characteristics of photosensitive materials for making prints.

The printer is automatically adjusted to control the slope characteristics. However the adjustment will be insufficient by the cause of some negative film types and the possible degree of overexposure or underexposure. Therefore, techniques for producing photosensitive materials to be easily controlled in its slope for providing prints are called for, that is to say, improved reciprocity failure characteristics are needed. As the method to decrease changes in sensitivity caused from the reciprocity failure by adding an iridium compound to silver halide emulsion, the following are known: a method as described in Japanese Patent Examined Publication No. 4935/1968, a method described in Japanese Patent Examined Publication No. 32738/1970, a method as described in Japanese Patent Publication Open to Public Inspection No. 88340/1977 hereinafter referred to as Japanese Patent O.P.I. Publication, and a method described in Japanese Patent O.P.I. Publication No. 9604/1979.

Though increasing the amount of an iridium compound added for decreasing changes in sensitivity caused from reciprocity failure surely reduces changes in sensitivity, changes in gradation are apt to increase. Actually, the adding amount cannot be increased due to the compromise between sensitivity changes and gradation changes. For multi-layer color photosensitive materials, a blue-sensitive emulsion layer, green-sensitive emulsion layer, and a red-sensitive emulsion layer are generally applied to. Improving the reciprocity failure characteristics with the most required color balance of three layers kept was quite difficult because of the difference of the silver halide emulsion, the sensitizer, optical sensitizing dye, the inhibitor, coupler, and the coating aid of each layer. In particular, it is difficult to reduce changes in the gradation of three the layers and to let the direction of the changes to agree with each other.

For aforementioned reason, if the exposure is constant, a change in the light intensity will give little changes in sensitivity and gradation. In particular, almost no changes in gradation are given.

Therefore, a silver halide photosensitive material with improved reciprocity failure characteristics in called for.

Further, stability of the emulsion is an important factor for manufacturing a high contrast and high sensitive photographic material.

The instability of an emulsion coating poses itself as a problem when, in the fabrication of a silver halide photographic sensitive material, the emulsion coating is applied to the support immediately after the preparation of the coating solution and also after a period of storage, because the deterioration during the storage causes the sensitivity of the silver halide to change and makes it difficult to obtain a photographic sensitive material of uniform quality.

As a means for improving an emulsion coating solution in stability it came into consideration to add to the coating solution of emulsion a compound known as a stabilizer, such as an azole or azaindene, a reducing agent such as hydroquinone or sulfinic acid, or to use a specific copolymer and fluorescent whitening agent in combination as described in Japanese Patent O.P.I. Publication No. 111629/1974. These methods, however, can hardly be considered to satisfactorily improve a coating solution of emulsion in stability during the storage, or some of such compounds may even impair photographic characteristics of vital importance such as gradation or sensitivity.

It is also known to add a sensitizing dye to the coating solution of emulsion for the same purpose, but this method also has a defect in that the sensitizing dye, according as its addition is increased, causes its residual color stains to be increasingly produced.

Now, after exposure a silver halide photographic light-sensitive material is subjected to a processing stage, in which what is commonly termed processing stability is highly required. Therefore, for the purpose of processing such photographic light-sensitive material, an automatic developing machine is generally employed which can produce high quality photographs at low cost and efficently.

In the process of the photographic light-sensitive material being processed by employing such automatic developing machine, a processing solution is subject to decrease in activity with time, and therefore it is customary to replenish the solution by a corresponding amount of such solution, which solution is hereinafter referred to as replenishing solution, to thereby maintain the activity of the processing solution always at constant level, which is hereinafter referred to as continuous replenishment.

Actually, however, even in the case of continuous replenishment, for various reasons there may arise problems, such as changes in the composition and pH of the processing solution, and inclusion of foreign matter, which result in changes in the activity of the processing solution which, in turn, have considerable adverse effect on the photographic performance of the photographic light-sensitive material.

By way of example, continuous replenishment in the case of processing color paper (color photographic paper) in an automatic developing machine is described in further details. After exposure, processing of the color paper in the developing machine is carried out in the following sequence: color development—bleach fix—washing—stabilization. In the automatic developing machine, transport means for color paper, e.g., an endless belt, runs through a color developing bath, a bleach-fixing bath, and a washing or stabilizing bath. Thus, it is likely that a bleach-fix solution deposit on the endless belt will more or less become included in the color developing bath without being fully removed in the stage of washing or stabilizing, which naturally results in varied activity of the color developing solution. Processing with such color developing solution will usually be a cause of a gradation change and/or increased fogging, with the result that the photographic performance of the photographic light-sensitive material is adversely affected.

Therefore, the development of a photographic light-sensitive material which is less liable to changes in its photographic performance characteristics, such as sensitivity, gradation, and fogging, even if there should occur some change in the activity of a processing solution, and which has good processing stability, has been greatly demanded.

Resently, improved hardward such as a printer and automatic developing machine, improved developer solution, improved silver halide color photographic light-sensitive material packaging thereof. As a result, the so-called "mini-laboratory" system, that performs developing of color negative film through preparation of color print even in a limited room for example in one corner of a department store, is increasingly used more commonly.

Under such circumstances, it is a current requirement that a color print of further improved quality be more readily prepared in a shorter period.

Rapid processing of silver halide color photographic light-sensitive materials requires acceleration in each of principal color photographic processes, that is, color developing, bleaching, fixing, washing, and drying. Improvement in color developing, which takes a particularly long period, contributes to overall reduction in processing time.

One of the methods to shorten a color developing time is to use smaller silver halide grains in a light-sensitive material.

This technique, however, inevitably incurs loss in sensitivity. Additionally, the blue-sensitive emulsion layer uses both light absorption by silver halide and light absorption by a sensitizing dye, and, therefore, once a silver halide emulsion of a different grain size is employed, the color balance previously attained by the two types of light absorption will disrupted, and results in another problem in terms of color reproduction. More specifically, the degree of light absorption by silver halide grains is proportional to the third power of grain size, while the degree of light absorption of a sensitizing dye is proportional to the second power of silver halide grain size. Correspondingly, a smaller grain size trends to decrease in sensitivity. At the same time, since the green-sensitive silver halide emulsion is somewhat sensitive to light absorbed with silver halide grains, the green-sensitive emulsion may be developable with blue light. This possibility of accidental development is greater, if the sensitivity of a blue-sensitive emulsion layer becomes lower; an area supposed to be colored in high-density yellow may be stained with magenta color.

Another method for shortening a color developing time is a method that uses development accelerator when an exposed silver halide color photographic light-sensitive material is subjected to developing using an aromatic primary amine color developing agent. The examples of disclosed accelerators include a development accelerator containing quaternary nitrogen atoms; a polyethylene oxide type development accelerator; an imidazole type development accelerator; a polyacrylamido-polyacrylic acid development accelerator; and a development accelerator having a thion group. However, among these development accelerators, those having a relatively higher activity sometimes incur fogging.

Furthermore, a method that incorporates 1-aryl-pyrazolidone such as 1-aryl-3-pyrazolidone into a silver halide color photographic light-sensitive material that is processed in an extremely short developing time was disclosed.

However, these techniques already disclosed are not necessarily satisfactory in forming a dye image of high density at sufficient high development speed, calling for further improvements.

Japanese Patent O.P.I. Publication No. 50533/1983 discloses a developing promoting method combinedly using 1-aryl-3-pyrazolidone and non-sensitive silver halide grains. This method is also unsatisfactory in promoting development.

Another method is to provide a larger content of silver chloride included in silver halide particles. This method is not satisfactory since the minimum density increases when bleach-fixer is accidentally mixed into a color developer. There has been a defect that only a lowered contrast image may be obtained when development is performed for 60 seconds or less.

Further in such a short time processing as mentioned above, an uneven development occurs around the leading, trailing and side edges of a paper roll or around a hole between picture frames, because the stirring efficiency therearound is different from those in the other areas, thus causing the difference in color balance, and degraded print quality.

SUMMARY OF THE INVENTION

The first object of the invention is to provide a silver halide photographic light-sensitive material having excellent gradiation characteristics.

The second object of the invention is to provide a silver halide photographic light-sensitive material which satisfied the requirement in high sensitivity, low fogging and high contrast at the same time.

The third object of the invention is to provide a silver halide photographic light-sensitive material improved in stability in the production process and the storage period thereof.

The fourth object of the invention is to provide a silver halide photographic light-sensitive material improved in reciprocity failure properties.

The fifth object of the invention is to provide a silver halide photographic light-sensitive material which have good processing stability in processing stages.

The sixth object of the invention is to provide a color image forming method that provides a color image of high quality free from the difference in stirring efficiency, even developing is rapidly performed.

The foregoing objects of the invention have been accomplished by a silver halide photographic light-sensitive material comprising a support having thereon a photographic component layers including at least one silver halide emulsion hayer wherein at least one of the photographic component layers is added with inorgatic sulfur and an image forming method comprising a step for developing such silver halide photograhic material with a color developer containing an aromatic primary amine compound for not mroe than 60 seconds.

DETAILED DESCRIPTION OF THE INVENTION

The term "inorganic sulfur" used herein means sulfur as a so-called single substance which does not combine with any other element to form a compound. Therefore, the "inorganic sulfur" referred to as such herein includes none of those sulfur-containing compounds which are known as photographic additives in the art, such as sulfides, sulfuric acid or salt thereof, sulfurous acid or salt thereof, thiosulfuric acid or salt thereof, sulfonic acid or salt thereof, thioether compound, thiourea compound, mercapto compound, and sulfur-containing heterocyclic compound.

The single-element sulfurs which can be used as "inorganic sulfur" in this invention are known as having a number of allotropes, and any of the allotropes may be used.

Of the allotropes, one which is stable at room temperaturte is α-sulfur belonging to the rhombic system. In this invention, it is preferably to use this -sulfur.

For the purpose of adding the "inorganic sulfur" according to the invention, it may be added per se in the form of solid, but preferably it is added in the form of solution. It is known that while inorganic sulfur is insoluble in water, it is soluble in carbon disulfide, sulfur chloride, benzene, diethyl ether, ethanol, and the like. Therefore, when adding inorganic sulfur, it is desirable to dissolve same in one of these solvents. Of these solvents for inorganic sulfur, ethanol in particular is preferably used from the standpoints of ease of handling and possible photographic effects.

The inorganic sulfur is added in a suitable amount which varies within the range of from $1\times10^{-5}$ mg to 10 mg per mol of silver halide depending upon the type of the silver halide emulsion applied and the desired degree of effect of the addition. Preferably, it is added within the range of from $1\times10^{-3}$ mg to 5 mg per mol of silver halide.

The inorganic sulfur in accordance with the invention may be added to either a light-sensitive silver halide emulsion layer or a non-light-sensitive layer, preferably to a light-sensitive silver halide emulsion layer.

For the timing of addition of the inorganic sulfur into the silver halide emulsion, the inorganic sulfur may be added at any stage during the process of from silver halide grain formation and up to formation of photographic layers on a support. From the view point of high contrast effect, however, it is preferably added at the end of the stage of chemical sensitization.

In another preferable embodiment of the invention, a chemical sensizing process of the emulsion is performed in the presence of inorganic sulfur. And in more preferable embodiment of the invention, the chemical sensitization of the emulsion is stopped in the presence of additionally added inorganic sulfur.

To perform chemical sensitization in the presence of inorganic sulfur, an appropriate amount of inorganic sulfur added varies depending on the type of silver halide emulsion being used, as well as on the magnitude of effect being intended. The amount of similar sulfur added is $1\times10^{-5}$ mg to 10 mg, or, preferably, $1\times10^{-3}$ to 5 mg per mol silver halide.

When inorganic sulfur is further added at a period of the stop process in chemical sensitization, an appropriate amount of it is also varied depending on the type of silver halide emulsion being used, as well as on the magnitude of effect being intended. The amount of similar sulfur added is $1\times10^{-5}$ mg to 10 mg, or, preferably, $1\times10^{-3}$ to 5 mg per mol silver halide. The total of amount of inorganic sulfur added during both processes is $2\times10^{-5}$ mg to 15 mg, or, preferably, $2\times10^{-3}$ mg to 10 mg per mol silver halide.

When performing chemical sensitization in the presence of inorganic sulfur, and as far as there is a condition allowing the silver halide grains to be chemically sensitized in the presence of inorganic sulfur, the timing of incorporating inorganic sulfur into a silver halide emulsion is arbitrarily selected from the processes preceding the completion of the stop process in chemical sensitization. More specifically, the period of incorporation is arbitrarily selected from a period at which silver halide grains are capable of being chemically sensitized. More specifically, the period of incorporation is arbitrarily selected from a period before the formation of silver halide grains, a period for the formation of silver halide grains, a period after the completion of forming silver halide grains and before the initiation of desalination, a period after the desalination and before the initiation of chemical sensitization, at the period of initiation of chemical sensitization and during chemical sensitization. Preferably, the inorganic sulfur is incorporated at the period after the completion of forming silver halide grains and before the initiation of desalination; a period after the desalination and before the initiation of chemical sensitization; at the initiation of chemical sensitization; or during chemical sensitization.

The incorporation of inorganic sulfur at the initiation of the chemical sensitization is particularly advantageous in obtaining greater effects of high sensitivity and low fog, without deteriorating high contrast. The initiation process of chemical sensitization is a process at which chemical sensitizers are added, wherein a moment a chemical sensitizer is added is the time of the initiation of chemical sensitization.

The sensitizers able to be used according to the invention include a chemical sensitizer such as chalcogen sensitizer. The term "chalcogen sensitizer" is a general term covering a sulfur sensitizer, selenium sensitizer, and tellurium sensitizer. For photographic application, a sulfur sensitizer and selenium sensitizer are advantageous. As a sulfur sensitizer, those known in the art are useful, and the examples of which include thiosulfate, allyl thiocarbazide, thiourea, allyl isothiocyanate, cystine, p-toluene thiosulfonate, and rhodanine. Other useful examples include the sulfur sensitizers described in U.S. Pat. Nos. 1,574,944, 2,410,689, 2,278,947, 2,728,668, 3,501,313, and 3,656,955; West German OLS Patent No. 1,422,869; Japanese Patent O.P.I. Publication Nos. 24937/1981 and 45016/1980. An amount of sulfur sensitizer added greatly varies depending on pH level, temperature, size of silver halide grains and the like. However, as a guideline, the preferred rate of addition is $10^{-7}$ to $10^{-1}$ mol per mol silver halide.

A selenium sensitizer may used in place of the sulfur sensitizer, and the examples of useful selenium sensitizer include aliphatic isoselenocyanates such as allyl isoselenocyanate; selenoureas; selenoketones; selenamides; selenocarboxylic salts and esters; selenophosphates; selenides such as diethyl selenide and diethyl diselenide. The specific examples of selenium sensitizer are described in, for example, U.S. Pat. Nos. 1,547,944, 1,602,592, and 1,623,499. Furthermore, reducing sensitization may be used together with sulfur sensitization. The scope of useful reducing sensitizers is not limited, and the typical examples of which include those known in the art such as stannous chloride, thiourea dioxide, hydrazine, and polyamine. Additionally, noble metal compounds, such as platinum compound and palladium compound, may be used for this purpose.

The conditions of chemical sensitization exercised according to the invention varies depending on the type of silver halide grains used, and intended photographic performance. As a guideline, the temperature is 35° to 70° C.; pH, 5.0 to 7.5; and pAg, 6.0 to 8.5. The duration of chemical sensitization is determined usually by examining photographic characteristics resultant at specific time steps, and under prescribed chemical sensitization conditions, and then, from these time steps the duration achieving most favorable photographic characteristics, in terms of, for example, low fog, high sensitivity, and high contrast, is selected. However, the process stability, and operation efficiency are put into consideration in many cases, when determining the duration. As a guideline, the duration ranges from scores of minutes to several hours.

Aforementioned chemical sensitization can be stopped by methods well known in the art, such as reduction of temperature, reduction of pH level, and the use of a chemical sensitization stopping agent. A method using a chemical sensitization stopping agent is advantageous in view of the stability of emulsions. Chemical sensitization stopping agents already known are halide salts, for example, potassium bromide, and sodium chloride, and organic compounds known as antifoggants or stabilizers, for example, 7-hydroxy-5-methyl-1,3,4,7a-tetrazaindene. These agents are either independently or combinedly used.

Inorganic sulfur according to the invention may be incorporated at the stop process in chemical sensitization. The "stop process in chemical sensitization" is the process of adding a previously mentioned stopping agent. The timing of incorporating inorganic sulfur may be arbitrarily determined within the period of the stop process of chemical sensitization. More specifically, inorganic sulfur is added simultaneously with a chemical sensitization stopping agent or within ten minutes before and after the addition; or, preferably simultaneously with a chemical sensitization stopping agent or within five minutes before and after the addition.

The composition of silver halide of light-sensitive silver halide grains according to the invention is not particularly limited, and any of silver chloride, silver bromide, silver iodide, silver chloro-bromide, silver iodo-bromide and silver chloro-iodo-bromide may be used independently or in combination of several of them.

However, in order to make the effects of inorganic sulfur according to the invention more significant, silver halide grains used in the invention comprise more than 80 mol %, preferably, more than 90 mol % of silver chloride content; less than 20 mol %, preferably, less than 10 mol % silver bromide content; and less than 0.5 mol % silver iodide content. In particular, silver chloride or silver chloro-bromide comprising 0 to 5 mol % silver bromide content is more advantageous.

The composition of silver halide grains used in the present invention may be homogeneous from the inside to outside portions, or different between the inside and outside portion. When the composition of the inside portion is different from that of the outside portion, the composition may either continuously or discontinuously change from the inner to outter portions.

There is no specific limitation of the grain size of silver halide grains of the invention. However, in view of rapid-processability, sensitivity, and other photographic performance criteria, the preferred grain size is 0.2 to 1.6 μm, in particular, 0.25 to 1.2 μm. The grain size can be measured by a variety of methods usually used in the photographic art. The typical methods are described in "Analysis Method of Grain Size" (by Labrand), A.S.T.M. Symposium on Light Microscopy (1955), pp. 94–122; "The Theory of the Photographic Process" by Mees and James, 3rd edition, Chapter 2, published from Macmillan Company (1966). The grain sizes can be measured based on projected areas or approximate diameter values of grains. When silver halide grains have virtually identical configurations, the grain size distribution can be expressed with considerable precision by diameter or projected area.

The grain size distribution of the silver halide grains may be either multi-dispersed or monodispersed type. However, the monodispersed silver halide grains of variation coefficient of not more than 0.22, or, preferably, not more than 0.15, in terms of size distribution of the silver halide grains contained in an emulsion. The variation coefficient is a coefficient indicating the range of the grain size distribution and is defined by the following expressions.

$$\text{Variation coefficient } (S/\bar{r}) = \frac{\text{Standard deviation of size distribution}}{\text{Average grain size}}$$

S=standard deviation of grain size distribution $$S = \sqrt{\frac{\Sigma (\bar{r} - ri)^2 ni}{\Sigma ni}}$$

$$\text{Average grain size } (\bar{r}) = \frac{\Sigma niri}{\Sigma ni}$$

In the above expressions, ri represents sizes of independent grains; ni, a number of independent grains counted. The term "grain size" here means a diameter of independent spherical silver halide grain; a diameter, when the grain is cubic or has any shape other than spherical shape, of a projected image converted into a disc image.

The silver halide grains according to the invention are prepared by any of the acid process, neutral process, and ammonium process. The grains may be grown at once, or may be grown after forming seed grains. A method for forming seed grains may be identical with or different from a method for growing the grains.

As a method for reacting soluble silver salt with soluble halide salt, the normal precipitation method, reverse precipitation method or double-jet precipitation method, or the combination of these methods is arbitrarily used. Among these methods, the double-jet precipitation method is advantages. Furthermore, pAg-controlled double-jet method disclosed, for example, in Japanese Patent O.P.I. Publication No. 48521/1979, that is, one modification of the double-jet precipitation method, may be used.

If necessary, a solvent for silver halide such as thioether may also be used.

Additionally, compounds such as mercapto-group containing compound, nitrogen-containing heterocyclic compound, sensitizing dye may be added during or after the formation of silver halide grains.

The configurations of silver halide grains according to the invention are arbitrarily selected. The preferred one example is a cubic grain having {100} face as a crystal face. Additionally, octahedral, tetradecahedral or dodecahedral grains may be prepared using the methods described in U.S. Pat. Nos. 4,183,756, and 4,225,666, Japanese Patent O.P.I. Publication No. 26589/1980, Japanese Patent Examined Publication No. 42737/1980, and in the Journal of Photographic Science 21, 39/1973, and the like, thereby the resultant silver halide grains may be used in embodying the invention.

Also, grains having twin plane may be used.

The silver halide grains may comprise grains of a common configuration, or may be a mixture of various configurations.

With the silver halide grains used in the silver halide emulsion of the invention, metal atoms in the forms of metallic ions may be integrated into the interior and/or onto the surface of each grain by using at least one type of salt selected from cadmium salt, zinc salt, lead salt, thallium salt, irridium salt or complex salt containing it, rhodium salt or complex salt containing it, and iron salt or complex salt containing it in the course of forming and/or growing the grains, and additionally, by subjecting the grains to an adequate reducing atmosphere, the reduction-sensitization necleus is incorporated into the interior and/or onto the surface of every grain.

With the silver halide emulsion of the invention, excess soluble salts may be either removed or left unremoved from in the emulsion, once the silver halide grains have satisfactorily grown.

Such salts can be removed in compliance with the methods described in Research Disclosure No. 17643.

The silver halide grains of the invention may be those where latent images are primarily formed either on the surface thereof or in the interior thereof. The preferred grains are those where latent images are primarily formed on the surface thereof.

The emulsion layer of the invention may contain an iridium compound for improving its reciprocity failure properties.

Though the types of iridium compounds used in the invention are not limited, in particular, water soluble iridium is preferable. From the viewpoint of stability, safety, and profitability as a compound, the following are more preferable: Iridium halide (III) compounds such as iridium chloride (III), iridium bromine (III), iridium halide (IV) compounds such as iridium chloride (IV), iridium bromide (IV), and iridium complex salts having halogen atoms, amines, or oxalate as a ligand, for example, a hexachloroiridium (III) complex salt, a hexachloridium (IV) complex salt, a hexaamineiridium (III) complex salt, and a hexaamineiridium (IV) complex salt. According to the invention, any of tervalent or tetravalent compounds can be combined and used together. These iridium compounds are used by solving water or proper solvents. A general method to stabilize the solution of iridium compounds is often used. That is to say, adding water solution hydrogen halide water such as hydrochloric acid, oxalic acid, or fluorine acid or alkali halide such as KCl, NaCl, KBr, or NaBr can be utilized.

Iridium compounds used in the invention can be added at any processes of producing silver halide emulsion. Specifically, they can be timely added at any periods in the process as follows; a period before forming silver halide particles, a period when forming silver halide particles starts, a period during forming silver halide particles, a period between after forming silver halide particles is finished and before the chemical sensitization starts, a period when the chemical sensitization starts, a period during the chemical sensitization and a period when chemical sensitization ends. A period when forming silver halide particles starts or a period during chemical sensitization is preferable.

Iridium compounds used in the invention may be added at one period or pural periods.

In this case, a mixed solution of Ir (III) and Ir (IV) may be divided and added two or more times to different processes, or each solution of Ir (III) and Ir (IV) may be separately added at different processes. The amount of adding is preferable to the extent that the total mol number of Ir (III) compounds and Ir (IV) compounds per 1 mol of silver halide is $10^{-8}$–$10^{-5}$ mol. If the adding amount is below this amount, the effect will be decreased. On the other hand, if the adding amount is larger than this amount, desensitization or fogging will occur. Therefore, these cases are not preferable generally.

By using inorganic sulfur in chemical sensitization process together with the iridium compounds, the silver halide emulsion relating to the invention can reduce changes in gradation while decreasing sensitivity changes causing from reciprocity failure by adding iridium compounds is maintained.

It is important in embodying the invention to sensitize a silver halide emulsion to high sensitivity. Therefore, a silver halide emulsion is preferably sensitized using a gold sensitizer. Gold compounds useful as sensitizers include chloroauric acid, sodium gold chloride, and potassium gold thiosulfate, and are not limited only to these examples.

An amount of gold compound added to a silver halide emulsion according to the invention is $5\times10^{-7}$ to $5\times10^{-3}$, or, preferably, $2\times10^{-6}$ to $1\times10^{-4}$, in particular, $2.6\times10^{-5}$, or, most specifically, $2.6\times10^{-6}$ to $9\times10^{-6}$ mol per one silver halide.

Adding a gold compound to a silver halide emulsion is performed by dissolving a compound into an arbitrary appropriate solvent such as water or ethanol.

A gold compound according to the invention is incorporated into a silver halide emulsion during the preparation thereof; the excellent effect of the invention is achieve by setting the timing of the incorporation in an arbitrary period before the completion of the stop process in chemical sensitization also known as chemical ripening.

The stop process in chemical sensitization also called a completion process in chemical sensitization means a process where, among sensitization processes, a chemical sensitization-stop agent is added. This process covers a period including addition of the chemical sensitization-stop agent and approximately 10 minutes both before and after the addition, and, preferably, including addition and 5 minutes both before and after the addition.

The previously mentioned arbitrary period before the stop process in chemical sensitization is an arbitrary period selected from a period before the formation of silver halaide grains, a period for the formation of silver halide grains, a period after the completion of forming silver halide grains and before the initiation of chemical sensitization, a period during chemical sensitization and before the completion of chemical sensitization. The preferred arbitrary period is selected from a period after the completion of forming silver halide grains and before the initiation of chemical sensitization, a period during chemical sensitization and before the completion of chemical sensitization. A total amount may be added at once, or divided into several parts that are added at several times.

The silver halide emulsion according to the invention, by combined addition of a gold sensitizer and inorganic sulfur, is capable of maintaining high degree of sensitization effect due to gold sensitization while the lower contrast as well as large fog being prevented.

To stabilize the photographic properties of the silver halide photographic light-sensitive material from the completion of chemical sensitization, during the preparation, and actual use of the similar material, known inhibitors may be used. The examples of such inhibitors, that are known antifoggants or inhibitors, include azoles such as benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, polyhydroxybenzenes, and mercaptotetrazoles, in particular, 1-phenyl-5-mercaptotetrazole and the like; mercaptopyrimidines; mercaptotriazines e.g. thioketo compounds such as oxazolinethion; azaindenes such as tetraazaindenes in particular, 4-hydroxy-substituted (1,3,3a,7) tetraazaindenes, and pentaazaindenes; benzenethiosulfonic acid, benzenesulfinic acid, and benzenesulfonic amide.

The examples of useful compounds include thiazolium salt, azaindenes, urazols, sulfocatechols, oximes, mercaptotetrazoles, nitron: nitroindazoles, thyronium salts, palladium salts, platinum salts, and gold salts.

The inhibitor is added to a layer of silver halide emulsion or to a layer of non-light-sensitive hydrophilic colloid.

The inhibitor preferably used in the invention is a nitrogen-containing heterocyclic compound having a solubility product (ksp) of the inhibitor with a silver ion not more than $1\times10^{-10}$, preferably not more than $1\times10^{-11}$. A compound whose solubility product exceeds this limit, that is, whose ability to form a salt with silver ion is lower, is less as effective as desired. For the measurement and calculation of the solubility product "New Experimental Chemistry (Shin-Jikken Kagaku Kohza)", Vol. 1, Pages 233–250, Maruzen can be quoted as a reference.

The inhibitors applicable according to the present invention include the compounds specified in the literature referred to next and can be synthesized in the same manners as their synthesis described in the literature referred to; Chemical and Pharmaceutical Bulletin, Vol. 26, 314/1978, Tokyo; Japanese Patent Publication Open to Public Inspection No. 79436/1980; Berichte der Deutschen Chemischen Gesellsdraft 82, 121/1948; U.S. Pat. No. 2,843,491; U.S. Pat. No. 3,017,270; British Pat. No. 940,169; Japanese Patent O.P.I. Publication No. 102639/1976; Journal of American Chemical Society, 44, 1502–1510; Beilsteins Handbuch der Organischen Chemie 26, 41, 43 and 58.

Where a purine-derived compound or a mercapto group-containing compound expressed by the formula S hereunder is used as an inhibitor relevant to this invention, the inhibitor combined with an inorganic sulfur, being capable of rendering the gradation contrasty with an excellent effect, is useful as a means for controlling the gradation as well.

$$Z_o\text{—SM} \qquad \text{Formula S}$$

where $Z_o$ represents a nitrogen-containing heterocyclic group, and M a hydrogen atom, an alkali metal atom or ammonium.

An inhibitor applicable according to the present invention can be used in combination with another or more as well as singly or even in combination with a stabilizer other than an inhibitor in this invention or with a fogging inhibitor.

In the embodiment of the present invention the inhibitor can be added to the layer(s) of silver halide emulsion at any time selected from among the stages of before the formation of silver halide grains, during the formation of silver halide grains, in the intervening time from the completion of the formation of silver halide grains to the start of chemical sensitization, during the chemical sensitization, at the time of the completion of the chemical sensitization, and in the intervening time from the completion of the chemical sensitization to the time of the coating. Preferably, the inhibitor can be added at the start and/or the completion of the chemical sensitization. The whole quantity of the inhibitor can be added at any one time hof said stages or in portions over a number of times.

The inhibitor may also be added to the coating solution for the non-light-sensitive hydrophilic colloid layer which is to be formed contiguously to the layer of silver halide emulsion. When so added, the inhibitor migrates into said silver halide emulsion layer after application of the coating.

An inhibitor applicable according to the present invention can be added to a layer of silver halide emulsion or a layer of non-light-sensitive hydrophilic colloid by dissolving, prior to the addition, said inhibitor in water or in an organic solvent e.g. methanol and ethanol, which is miscible in any proportion with water.

The inhibitor is added to a layer of silver halide emulsion ordinarily in a quantity of $1\times10^{-6}$ mole to $1\times10^{-1}$ mole per 1 mol silver halide, preferably in a quantity of $1\times10^{-5}$ mol to $1\times10^{-2}$ mole, although the addition is not specifically restricted to these quantities. When said inhibitor is added to a layer of non-light-sensitive hydrophilic colloid, it is preferable to increase the addition to 1.5 to 3 times the quantity suitable for a silver halide emulsion layer.

Some examples typifying the inhibitors applicable according to the present invention will be listed hereunder on the understanding that the applicability is not restricted to these examples.

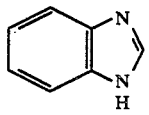

S-1

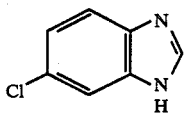

S-2

-continued
S-3
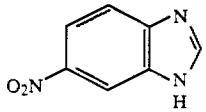
S-4
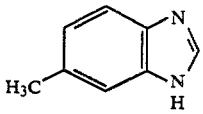
S-5
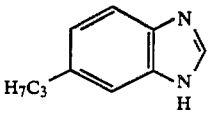
S-6
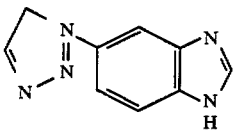
S-7
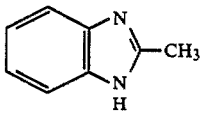
S-8
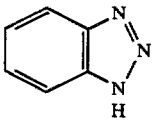
S-9
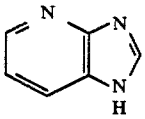
S-10
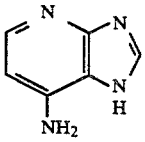
S-11
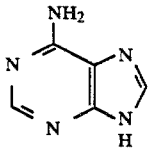
S-12
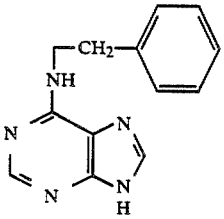
S-13
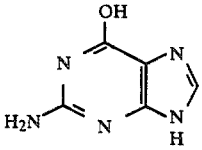
-continued
S-14
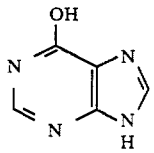
S-15
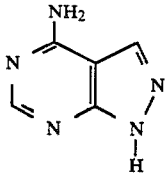
S-16
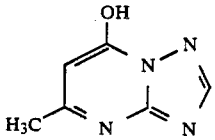
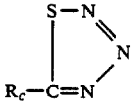
| Example Compounds No. | $R_c$ |
|---|---|
| S-17 | $-NH_2$ |
| S-18 | 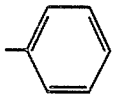 |
| S-19 | 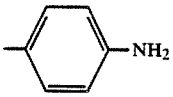 |
| S-20 | $-NO_2$ |
| S-21 | 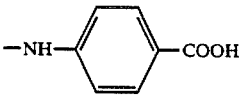 |
| S-22 | 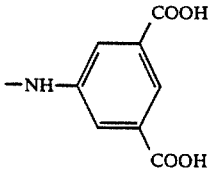 |
| S-23 | 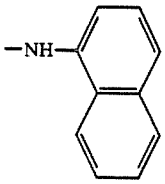 |
| S-24 | 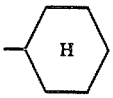 |

-continued
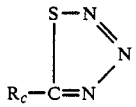
| Example Compounds No. | $R_c$ |
|---|---|
| S-25 | 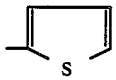 |
| S-26 | 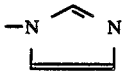 |
| S-27 | 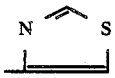 |
S-28 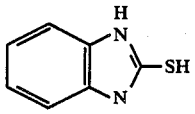
S-29 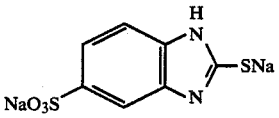
S-30 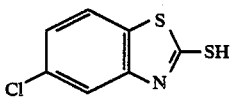
S-31 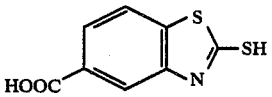
S-32 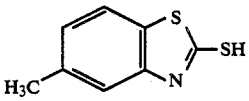
S-33 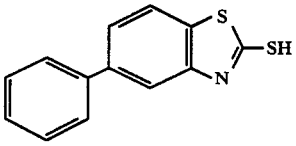
S-34 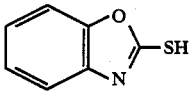
S-35 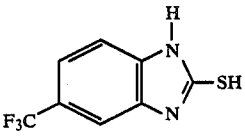
-continued
S-36 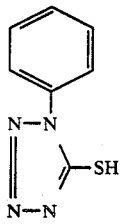
S-37 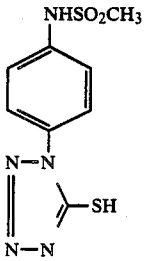
S-38 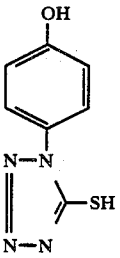
S-39 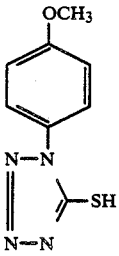
S-40 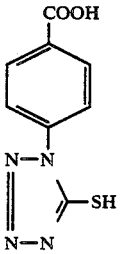
S-41 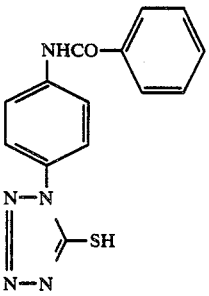

-continued
S-42
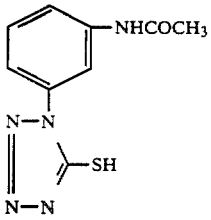
S-43
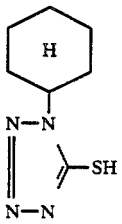
S-44
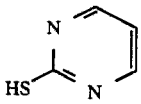
S-45
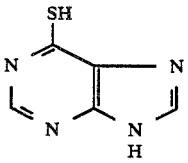
S-46
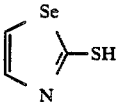
S-47
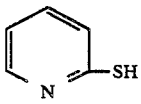
S-48
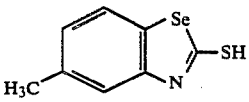
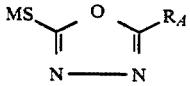
| Example Compounds No. | $R_A$ | M |
|---|---|---|
| S-49 | $-C_2H_5$ | —H |
| S-50 | $-CH_2-CH=CH_2$ | —H |
| S-51 | $-CH=CH-CH_2-CH_3$ | —H |
| S-52 | $-C_7H_{15}$ | —H |
| S-53 | $-C_9H_{10}$ | —Na |
| S-54 | 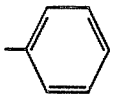 | —H |
| S-55 | $-C_4H_9(t)$ | —H |
-continued
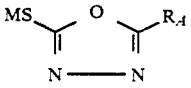
| Example Compounds No. | $R_A$ | M |
|---|---|---|
| S-57 | 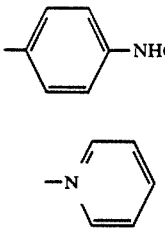 | —H |
| S-58 | 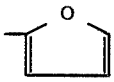 | —H |
| S-59 | 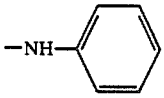 | —H |
| S-60 | 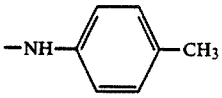 | $-NH_4$ |
| S-61 | $-NHCOCH_3$ | —H |
| S-62 | 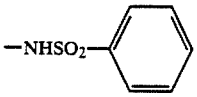 | —H |
| S-63 | $-N(CH_3)_2$ | —H |
| S-64 | 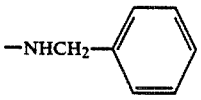 | —H |
| S-65 | 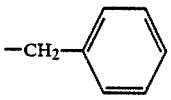 | —H |
| S-66 | $-S-CH_3$ | —H |
| S-67 | 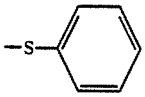 | —H |
| S-68 | —SH | —H |
| S-69 | —H | —H |
| S-70 | $-C_2H_5$ | —H |
| S-71 | $-C_4H_9(t)$ | —H |
| S-72 | $-C_6H_{13}$ | —H |
| S-73 | 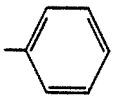 | —H |

-continued
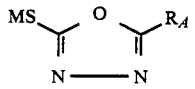
| Example Compounds No. | $R_A$ | M |
|---|---|---|
| S-74 | 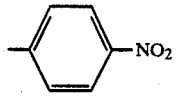 | —H |
| S-75 | 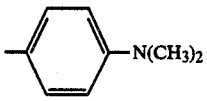 | —H |
-continued
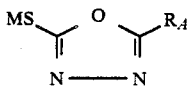
| Example Compounds No. | $R_A$ | M |
|---|---|---|
| S-76 | 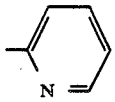 | —H |
| S-77 | 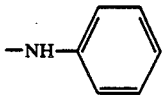 | —H |
| S-78 | $-N(CH_3)_2$ | —H |
| S-79 | $-CH_2CH{=}CH_2$ | —H |
| S-80 | —SH | —H |
| S-81 | $-NHCOC_2H_5$ | —H |
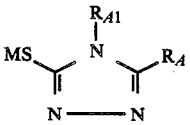
| Example Compounds No. | $R_A$ | $R_{A1}$ | M |
|---|---|---|---|
| S-82 | $-C_2H_5$ | —H | H |
| S-83 | $-CH_3$ | $-CH_3$ | H |
| S-84 | $-CH_3$ | 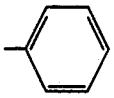 | H |
| S-85 | $-NHCOCH_3$ | $-CH_3$ | H |
| S-86 | 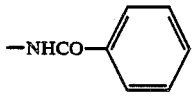 | 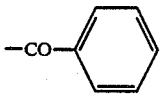 | H |
| S-87 | $-NHCOCH_3$ | $-CO-CH_3$ | H |
| S-88 | $-NHCOCH_3$ | 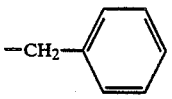 | H |
| S-89 | $-NHCOC_2H_5$ | 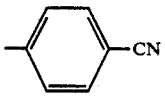 | Na |
| S-90 | 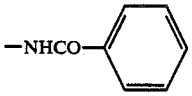 | 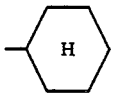 | H |
| S-91 | $-NHSO_2CH_3$ | —H | H |
| S-92 | 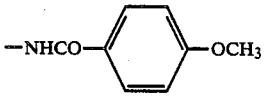 | $-CH_3$ | Na |

-continued
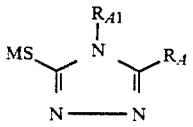
| Example Compounds No. | $R_A$ | $R_{A1}$ | M |
|---|---|---|---|
| S-93 | 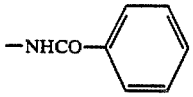 | $-CH_2CH-CH_2$ | H |
| S-94 | 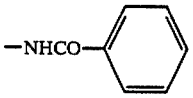 | 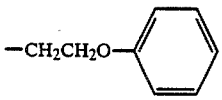 | H |
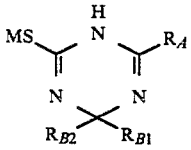
| Example Compounds No. | $R_A$ | $R_{A1}$ | | M |
|---|---|---|---|---|
| S-95 | $-C_2H_5$ | $-CH_3$ | $-CH_3$ | $-H$ |
| S-96 | 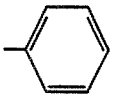 | $-CH_3$ | $-CH_3$ | $-H$ |
| S-97 | $-NH_2$ | $-H$ | 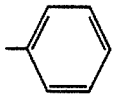 | $-H$ |
| S-98 | 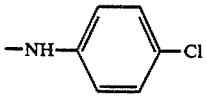 | $-H$ | $-C_4H_9$ | $-H$ |
| S-99 | $-NHCOCH_3$ | $-CH_3$ | $-CH_3$ | $-H$ |
| S-100 | 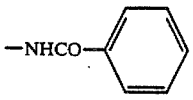 | $-CH_3$ | $-CH_3$ | $-H$ |
| S-101 | 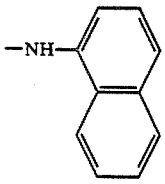 | $-CH_3$ | $-C_3H_7(i)$ | $-H$ |
| S-102 | 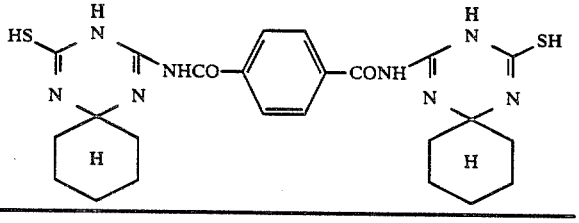 | | | |

In the present invention, the silver halide emulsion may be optically sensitized by a sensitizing dye in desired spectral region. The sensitizing dye may be used alone, or as mixture of two or more dyes. A super-sensitizer may be use for increasing the sensitizing effect of the sensitizing dye, which is a dye having no optical sensitizing effect or a compound which do not substantially absorb visible light.

The sensitizing dyes include a cyanine dye, merocyanine dye, complex cyanine dye, complex merocyanine dye, holopolar cyanine dye, hemicyanine dye, steryl dye, and hemioxanol dye.

The particularly useful dyes are a cyanine dye, merocyanine dye, and complex merocyanine dye. These dyes can have any of basic heterocyclic nuclei present in an ordinary cyanine dye. The examples of such nuclei include a pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus; a nucleus comprising an aliphatic hydrocarbon ring condensed with any of these nuclei; a nucleus comprising an aromatic hydrocarbon ring condensed with any of these nuclei, that is, an indolenin nucleus, benzindolenin nucleus, indole nucleus, benzoxazole nucleus, naphthoxazole nucleus, benzothiazole nucleus, naphthothiazole nucleus, benzoselenazole nucleus, benzimidazole nucleus, and the like. These nuclei may have a substituent on the carbon atom therein.

A merocyanine dye or complex merocyanine dye may have, as a nucleus having ketomethylene structure, a 5-membered or 6-membered heterocyclic nucleus such as pyrazoline-5-one nucleus, thiohydantoin nucleus, 2-thiooxazolidine-2,4-dione nucleus, rhodanine nucleus, and thiobarbituric nucleus.

The useful sensitizing dyes applicable to the blue-sensitive silver halide emulsion layer include those described in West German Patent No. 929,080; U.S. Pat. Nos. 2,231,658, 2,493,748, 2,503,776, 2,519,001, 2,912,329, 3,656,959, 3,672,897, 3,694,217, 4,025,349, and 4,046,572; British Pat. No. 1,242,588; and Japanese Patent Examined Publication Nos. 14030/1969 and 24844/1977. The useful sensitizing dyes applicable to green-sensitive silver halide emulsions are cyanine dyes, merocyanine dyes and complex cyanine dyes described in U.S. Pat. Nos. 1,939,201, 2,072,908, 2,739,149, and 2,945,763; and British Pat. No. 505,979. The useful sensitizing dyes applicable to red-sensitive silver halide emulsions are cyanine dyes, merocyanine dyes and complex cyanine dyes described in U.S. Pat. Nos. 2,269,234, 2,270,378, 2,442,710, 2,454,629, and 2,776,280. Also, cyanine dyes, merocyanine dyes or complex cyanine dyes described in U.S. Pat. Nos. 2,213,995, 2,493,748, 2,519,001 and West German Patent No. 929,080 and the like are advantageously incorporated into either the green-sensitive or red-sensitive silver halide emulsion. These sensitizing dyes may be used separately or in combination. The combined use of sensitizing dyes is often used for supersensitization. The typical combination examples are described in Japanese Patent Examined Publication Nos. 4932/1968, 4933/1959, 4936/1969, 32753/1969, 25831/1970, 26474/1970, 11627/1971, 18107/1971, 8741/1972, 11114/1972, 25379/1972, 37443/1972, 28293/1973, 38406/1973, 38407/1973, 38408/1973, 41203/1973, 41204/1973, 6207/1974, 40662/1975, 12375/1978, 34535/1979, and 1569/1980; Japanese Patent O.P.I. Publication Nos. 33220/1975, 33828/1975, 38526/1975, 107127/1976, 115820/1976, 135528/1976, 151527/1976, 23931/1977, 51932/1977, 104916/1977, 104917/1977, 109925/1977, 110618/1977, 80118/1979, 25728/1981, 1483/1982, 10753/1983, 91445/1983, 153926/1983, 114533/1984, 116645/1984, and 116647/1984; and U.S. Pat. Nos. 2,688,545, 2,977,229, 3,397,060, 3,506,443, 3,578,447, 3,672,898, 3,679,428, 3,769,301, 3,814,609, and 3,837,862.

Since a high chloride silver halide emulsion, when compared to a conventional silver halide emulsion principally comprising silver bromide, have weaker light absorption by silver halide, the sensitivity of a blue-sensitive emulsion is inevitably lower. Therefore, selecting a sensitizing dye is of great significance.

The compounds advantageous as a blue-spectral sensitizing dyes are those represented by formula D.

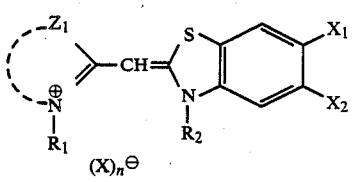

General formula D wherein $Z_1$ represents a group of atoms required to complete a benzothiazole nucleus or naphthothiazole nucleus; $X_1$ and $X_2$ respectively represent a hydrogen atom, halogen atom, alkyl group, alkoxy group, aryl group or hydroxyl group.

$R_1$ and $R_2$ independently represent an alkyl group, while $X^-$ represents an anion.

n is 0 or 1.

The typical examples of such compounds are as follows.

BS-1

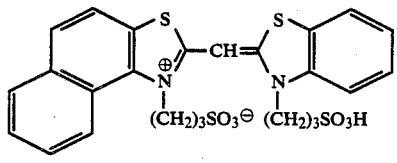

BS-2

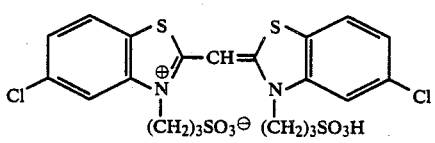

BS-3

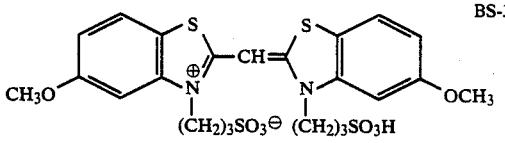

BS-4

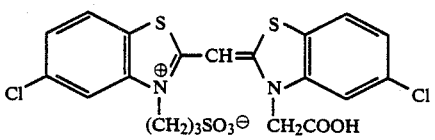

-continued
BS-5
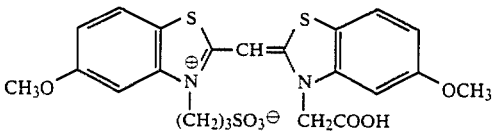
-continued
BS-6
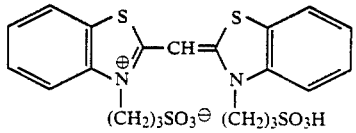
The compounds advantageous as the green-spectral sensitizing dye are as follows.
GS-1
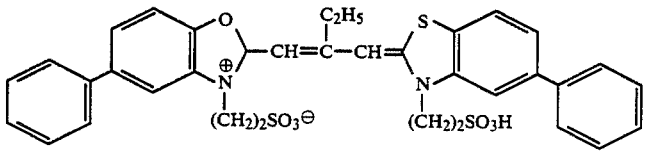
GS-2
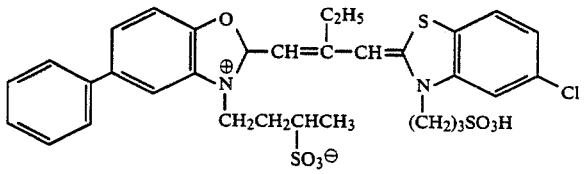
GS-3
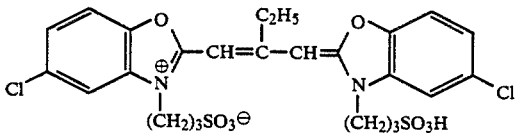
GS-4
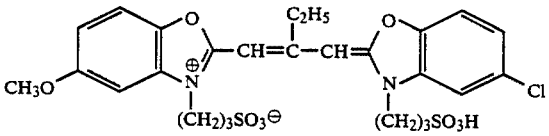
GS-5
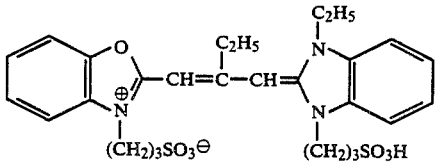
The compounds advantageous as the red-spectral sensitizing dye are as follows.
RS-1
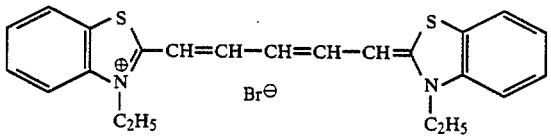
RS-2
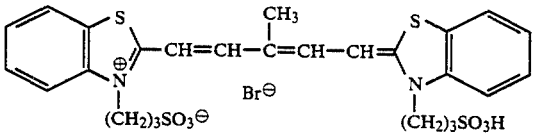
RS-3
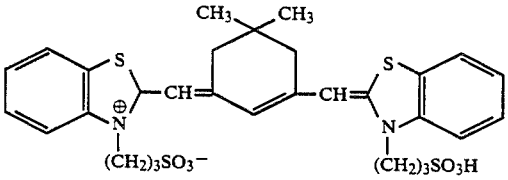

-continued

RS-4

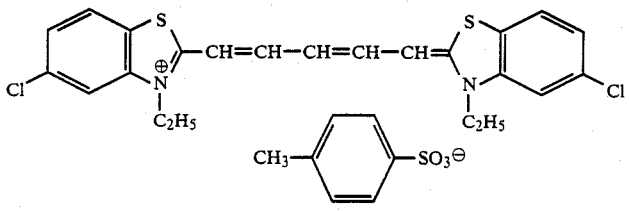

These compounds are generally known, and can be synthesized by the methods described, for example, in British Pat. No. 660,408, U.S. Pat. No. 3,149,105, Japanese Patent O.P.I. Publication No. 4127/1975; or "The Cyanine Dyes and Related Compounds", Paragraphs 32 to 76, by Hamer, published by Interscience Publishers, New York, 1969.

The preferred amounts of these sensitizing dyes added are 0.1 to 2 m mol, more specifically, 0.2 to 1 m mol per mol silver halide.

Methods well known in the art can be used for incorporating a sensitizing dye into a photographic emulsion.

For example, any of these sensitizing dyes is first dissolved in a water-soluble solvent such as pyridine, methyl alcohol, ethyl alcohol, methol cellosolve, and acetone (or the mixture of these solvents), thereby the solution is possibly diluted with water; otherwise, a sensitizing dye is directly dissolved in water. The resultant solution is the added to the photographic emulsion. Additionally, it is advantageous to use ultrasonic vibration in dissolving the similar dye.

Furthermore, the sensitizing dye useful in embodying the invention is first dissolved in a volatile organic solvent, as described in U.S. Pat. No. 3,469,987 and the like, thereby the resultant solution is dispersed in hydrophilic colloid, and the dispersion is incorporated into the photographic emulsion; otherwise, as described in Japanese Patent Examined Publication No. 24185/1971, the similar dye is not dissolved but dispersed in a water-soluble solvent, thereby the dispersion is incorporated into the photographic emulsion.

The sensitizing dye used in embodying the invention may be incorporated into the photographic emulsion, in the form of a dispersion prepared by an acid-dissolution dispersion process. Other useful methods for incorporation include those described in U.S. Pat. Nos. 2,912,345, 3,342,605, 2,996,287, and 3,425,835.

The sensitizing dyes may be added to the silver halide emulsion of the invention by dissolving the dyes in separately measured solvents of a common type or different types, and then, by mixing solvents prior to the addition of dyes into the emulsion, or, otherwise, prepared dye solutions may be separately added to the emulsion. When adding the solutions separately, the order, timing, and intervals of addition are deliberately selected based on the intended purpose.

The timing of adding the sensitizing dye according to the invention to the emulsion is arbitrary timing ranging from the formation of the silver halide grains, and until the emulsion is actually used for coating. The particularly preferred timing is within a range from the formation of the similar grains and until the desalination, and before a color coupler is added.

The present invention is applicable to silver halide photographic light-sensitive materials for both black-and-white and color photography, but it is preferably applicable to materials for final image representation for direct viewing, such as black-and-white photographic paper, color photographic paper, color reversal film, and color reversal paper. The advantage is conspicuous where a highly silver chloride containing emulsion which contains silver chloride in a proportion of 80 mole % or more is used for color photographic materials, especially markedly when used for color paper, according to the invention, the application resulting in satisfactory images with fogging inhibited and without the slightest impairment of the rapid processing efficiency.

While various color-forming substances are applicable to the color photography based on the present invention, color couplers can be named as important examples of them.

For couplers for yellow, previously known couplers derived from acyl acetanilide are useful. Of these, the use of compounds derived from benzoyl acetanilide and pivaloyl acetanilide is advantageous. Examples of the yellow couplers applicable in the practice of this invention are described in British Pat. No. 1,077,874, Japanese Patent Examined Publication No. 40757/1970, Japanese Patents O.P.I. Publication Nos. 1031/1972, 26133/1972, 94432/1973, 87650/1975, 3631/1976, 115219/1977, 99433/1979, 133329/1979, and 30127/1981, U.S. Pat. Nos. 2,875,057, 3,253,924, 3,265,506, 3,408,194, 3,551,155, 3,551,156, 3,664,841, 3,725,072, 3,730,722, 3,891,445, 3,900,483, 3,929,484, 3,933,500, 3,973,968, 3,990,896, 4,012,259, 4,022,620, 4,029,508, 4,057,432, 4,106,942, 4,133,958, 4,269,936, 4,286,053, 4,304,845, 4,314,023, 4,336,327, 4,356,258, 4,386,155, and 4,401,752.

A non-diffusible yellow coupler applicable to light-sensitive materials according to this invention is preferably what can be expressed by the following general formula Y:

Formula Y

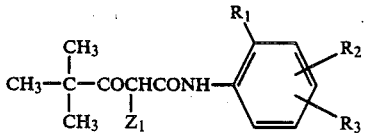

where $R_1$ represents a halogen atom or alkoxy group; $R_2$ represents a hydrogen atom, halogen atom, or alkoxy group, which may have a substituent; $R_3$ represents a group, which may have a substituent, of acylamino, alkoxycarbonyl, alkylsulfamoyl, arylsulfamoyl, arylsulfonamido, alkylureido, arylureido, sccinimido, alkoxy, or aryloxy; $Z_1$ represents a group which may be split off when the coupling takes place with the oxidized product of a color developing agent.

Among the compounds represented by formula Y, compounds represented by the following general formula Y' has excellent coloring, proving good color excellent for light proof by high-speed processing.

Formula Y'

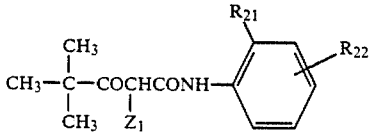

wherein $R_{21}$ represents a halogen atom, or alkoxy group; while $R_{22}$ represents $—NHCOR_{23}SO_2R_{24}$ group, $—COOR_{24}$ group, $—COOR_{23}COOR_{24}$ group, $—\underset{\underset{R_{25}}{|}}{N}—SO_2R_{24}$ group, $SO_2\underset{\underset{R_{25}}{|}}{N}R_{24}$ group, $R_{23}$ in these groups represents an alkylene group; $R_{24}$, non-diffusion group; $R_{25}$, alkyl group, aralkyl group or hydrogen atom. $Z_1$ represents a group being capable of splitting off by coupling reaction.

The particularly preferred compounds among those represented by formulas Y or Y' are as follows.

Y-1

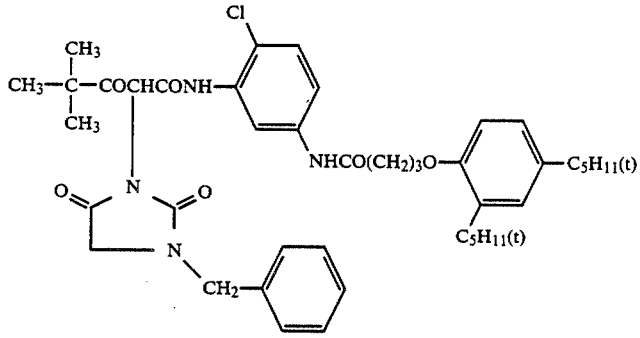

Y-2

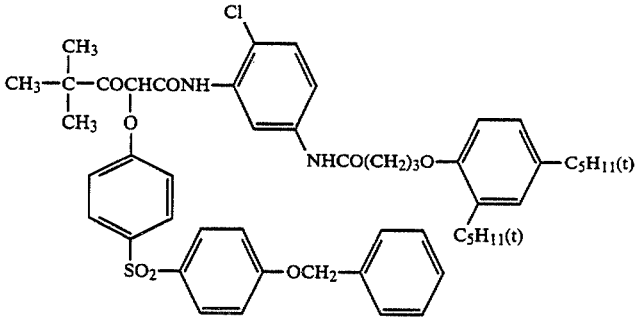

Y-3

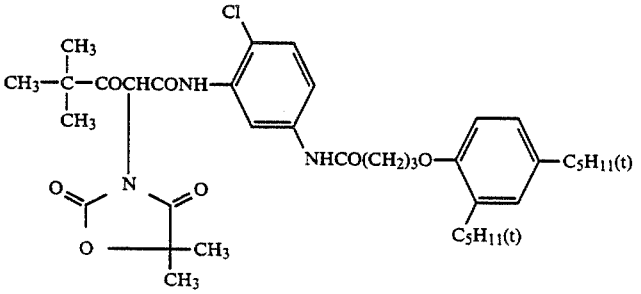

Y-4

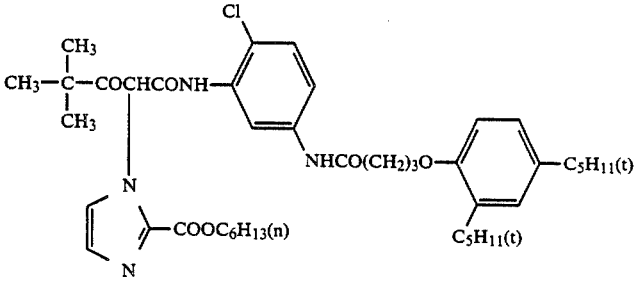

-continued
Y-5
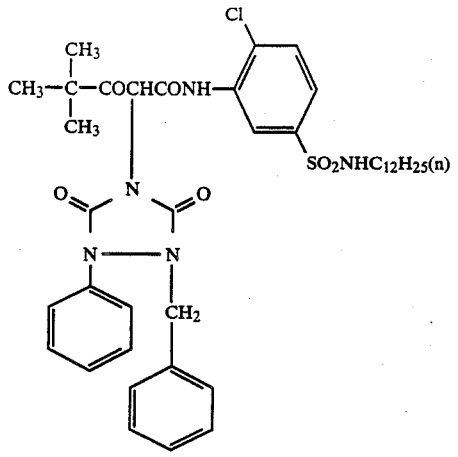
Y-6
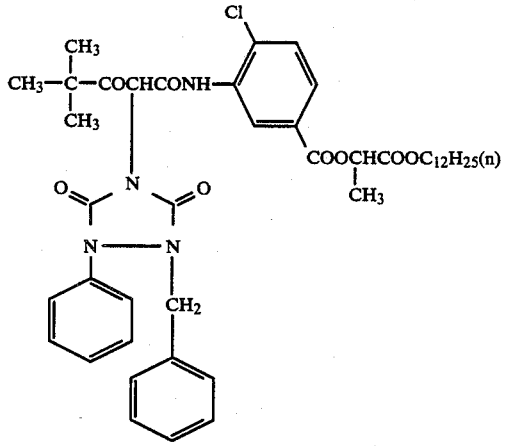
Y-7
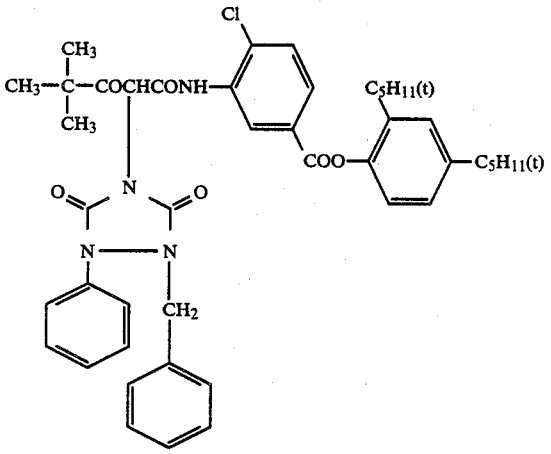

-continued
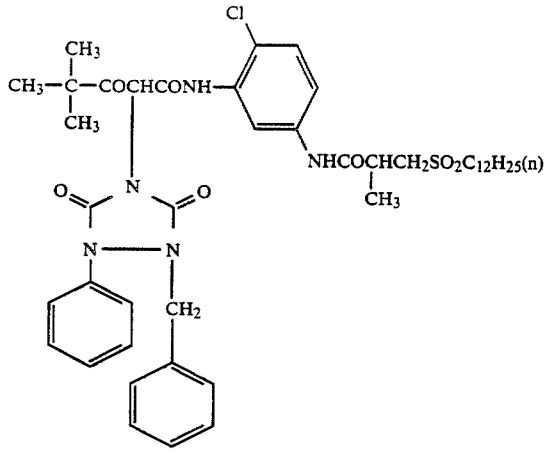
Y-8
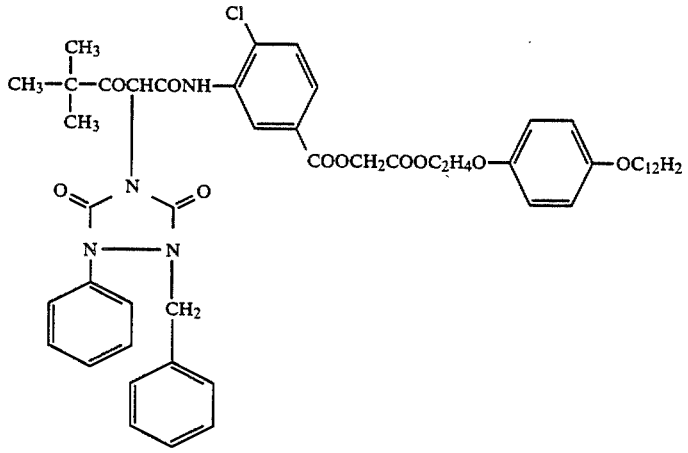
Y-9
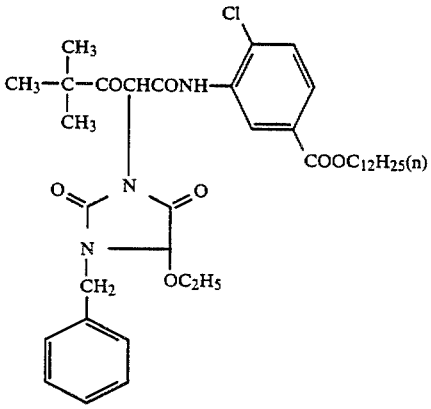
Y-10

-continued
Y-11
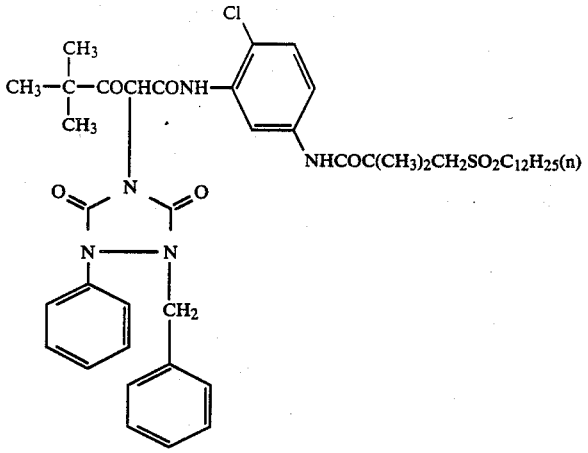
Y-12
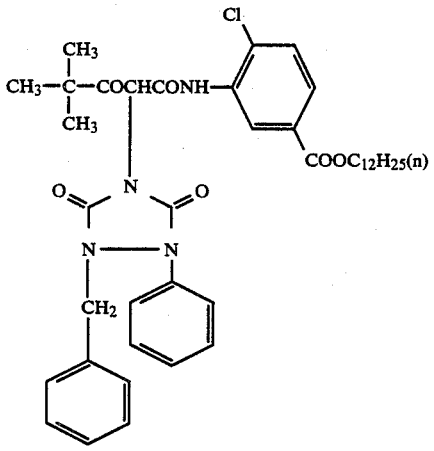
Y-13
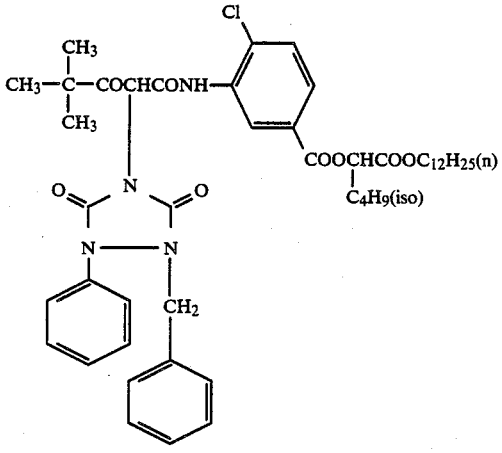

-continued
Y-14
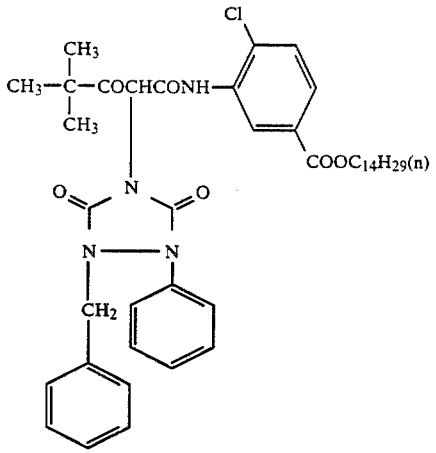
Y-15
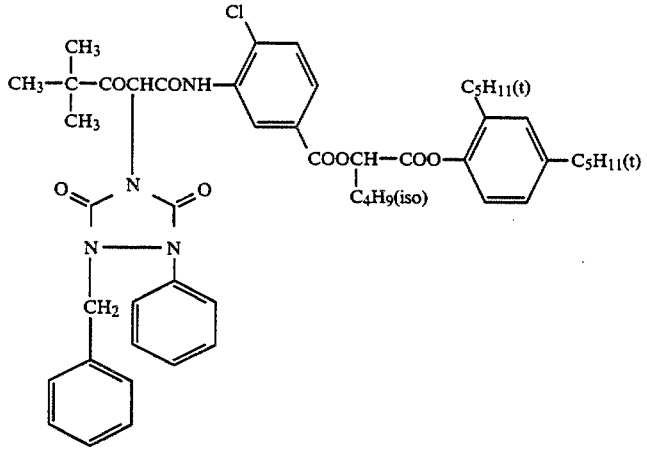
Y-16
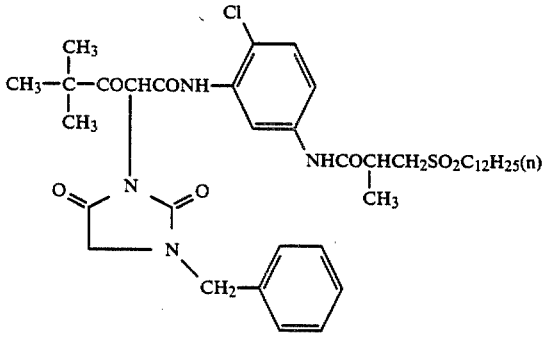
Y-17
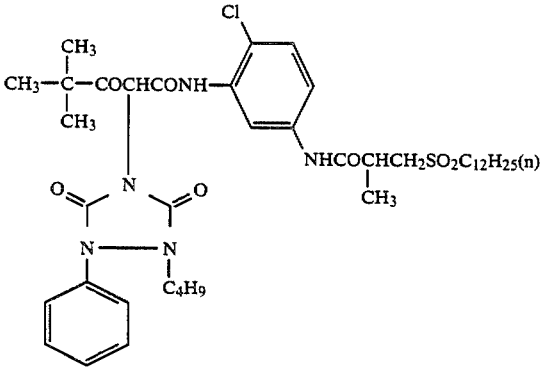

-continued

Y-18

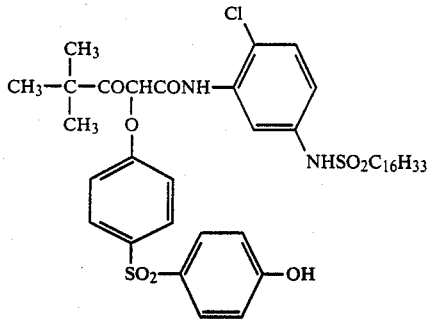

Y-19

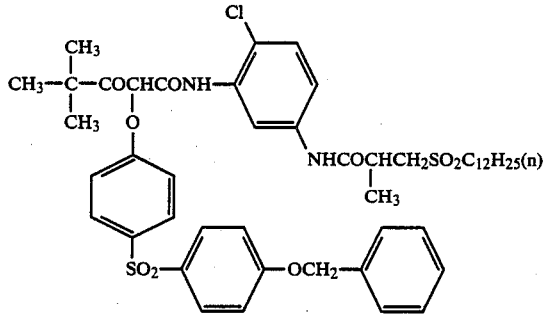

The image stabilizers advantageously used in combination with a yellow coupler according to the invention include the following compounds.

IST-1

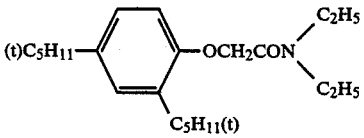

IST-2

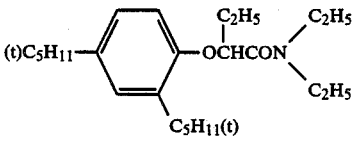

IST-3

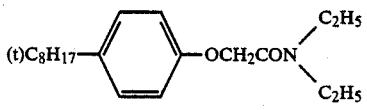

IST-4

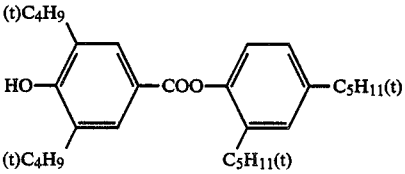

Compounds expressed by the formula a and those by the formula aI, both formulas shown hereunder, can be applied each as a coupler for magenta images with good results in the practice of this invention:

Formula a

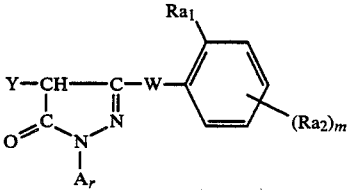

where $A_r$ represents an aryl group; $Ra_1$ represents a hydrogen atom or a substituent; $Ra_2$ represents a substituent; Y represents a hydrogen atom or a substituent which may be split off upon the reaction with the oxidized product of a color developing agent; W represents —NH—, —NHCO— (the N atom is bonded to a carbon atom of a pyrazolone nucleus) or —NHCONH—; m is an integer of 1 or 2.

Formula aI

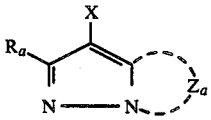

where $Z_a$ represents a group of non-metal atoms necessary for forming a nitrogen-containing heterocyclic ring, which may have (a) substituent(s); X represents a hydrogen atom or a substituent which may be split off upon the reaction with the oxidized product of a color developing agent; $R_a$ represents a hydrogen atom or a substituent, which is, for example, a halogen atom, spiro-compound residue, bridged hydrocarbon compound residue, or a group of alkyl, cycloalkyl, alkenyl, cycloalkenyl, alkinyl, aryl, heterocycle, acyl, sulfonyl, sulfinyl, phosphonyl, carbamoyl, sulfamoyl, cyano, alkoxy, aryloxy, heterocycloxy, siloxy, acyloxy, carbamoyloxy, amino, acylamino, sulfonamido, imido, ureido, sulfamoylamino, alkoxycarbonylamino, alkylthio, arylthio, or heterocyclethio.

The above-mentioned substituents are dealt with, for example, in the specifications of U.S. Pat. Nos. 2,600,788, 3,061,432, 3,062,653, 3,127,269, 3,311,476, 3,152,896, 3,419,391, 3,519,429, 3,555,318, 3,684,514, 3,888,680, 3,907,571, 3,928,044, 3,930,861, 3,930,866, and 3,933,500, Japanese Patent O.P.I. Publication Nos. 29639/1974, 111631/1974, 129538/1974, 13041/1975, 58922/1977, 62454/1980, 118034/1980, 38043/1981, 35858/1982, and 23855/1985, British Pat. No. 1,247,493, Belgian Patent Nos. 769,116 and 792,525, West German Patent No. 2,156,111, Japanese Patent Examined Publication No. 60479/1971, Japanese Patent O.P.I. Publication Nos. 125,732/1984, 228,252/1984, 171,956/1984, 33,552/1985, and 43,659/1985, West German Patent No. 1,070,030, and U.S. Pat. No. 3,725,067.

The cyan images forming couples can be exemplified primarily by those of tetravalent and bivalent phenol type and naphthol type, which are dealt with in the specifications of U.S. Pat. Nos. 2,306,410, 2,356,475, 2,362,598, 2,367,531, 2,369,929, 2,423,730, 2,474,293, 2,476,008, 2,498,466, 2,545,687, 2,728,660, 2,772,162, 2,895,826, 2,976,146, 3,002,836, 3,419,390, 3,446,622, 3,476,563, 3,737,316, 3,758,308, and 3,839,044, British Pat. Nos. 478,991, 945,542, 1,084,480, 1,377,233, 1,388,024, and 1,543,040, and Japanese Patent O.P.I. Publication Nos. 37425/1972, 10135/1975, 25228/1975, 112038/1975, 117422/1975, 130441/1975, 6551/1976, 37647/1976, 52828/1976, 108841/1976, 109630/1978, 48237/1979, 66129/1979, 131931/1979, 32071/1980, 146050/1984, 31953/1984, and 117249/1985.

Compounds expressed by the formula E and those by the formula F, both formulas shown hereunder, can be applied each as a coupler for cyan images with good results;

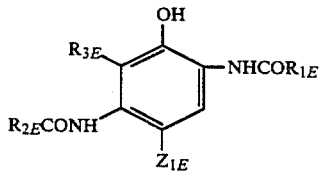

Formula E where $R_{1E}$ represents an aryl group, cycloalkyl group, or heterocyclic group; $R_{2E}$ represents an aryl group, cycloalkyl group, or heterocyclic group; $R_{2E}$ represents an alkyl group or phenyl group; $R_{3E}$ represents a hydrogen atom, halogen atom, alkyl group, or alkoxy group; $Z_{1E}$ represents a hydrogen atom, halogen atom, or a group which may be split off upon the reaction with the oxidized product of a color developing agent.

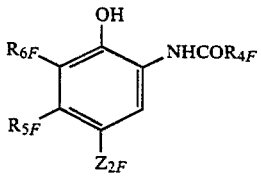

Formula F where $R_{4F}$ represents an alkyl group, e.g. a group of methyl, ethyl, propyl, butyl, or nonyl; $R_{5F}$ represents an alkyl group, e.g. methyl group or ethyl group; $R_{6F}$ represents a hydrogen atom, halogen atom, e.g. fluorine, chlorine, or bromine, or alkyl group, e.g. methyl group or ethyl group; $Z_{2F}$ represents a hydrogen atom, halogen atom, or a group which may be split off by the reaction with the oxidized product of an aromatic primary amine as a color developing agent.

It is advantageous, in the practice of this invention, to use gelatin as a hydrophilic colloid in which the silver halide is dispersed, but alternative use can be made of other hydrophilic colloids.

Whereas it is most generalized to use, as a hydrophilic colloid, gelatin in the form of an alkali-treated gelatin, acid-treated gelatin, or the like, more can be named as alternative hydrophilic colloids applicable satisfactorily to the practice of this invention, which are, for example, gelatin derivatives, such as phthalated of gelatin and phenylcarbamoyl gelatin, albumin, agar-agar, gum arabic, alginic acid, partially hydrolyzed cellulose derivative, partially hydrolyzed polyvinyl acetate, polyacrylamide, polyvinyl alcohol, polyvinyl pyrrolidone, and copolymers of these vinyl compounds.

It is acceptable to incorporate various previously known photographic additives into the silver halide photographic sensitive materials in the practice of this invention. Examples are ultraviolet ray absorbents e.g. benzophenone compound and benzotriazole compound; dye-image stabilizers, e.g. phenol compound, bisphenol compound, hydroxychroman compound, bisspirochroman compound, hydantoin compound, and dialkoxybenzene compound; anti-staining agents, e.g. hydroquinone derivative; surface-active agents, e.g. sodium alkylnaphthalene sulfonate, sodium alkylbenzene sulfonate, sodium alkyl succinic ester sulfonate, and polyalkylene glycol; water soluble anti-irradiation dyes, e.g. azo compound, styryl compound, triphenylmethane compound, oxonol compound, and anthraquinone compound; hardeners, e.g. halogen S-triazine compound, vinylsulfone compound, acryloyl compound, ethylenimino compound, N-methylol compound, epoxy compound, and water-soluble aluminum salt; agents for improving physical properties, e.g. glycerine, fatty polyhydric alcohol, polymer dispersion (latex) solid and liquid parrafins, and colloidal silica; fluoresent whitening agents. e.g. diaminostilbene compound; and various oil-soluble colorants.

A silver halide photographic sensitive material embodying the present invention can be provided, in its overall photographic layer, with, besides the various emulsion layers, a subbing layer, intermediate layer, yellow filter layer, ultraviolet ray-absorbent layer, protective layer, antihalation layer, and the like according as required.

The support of a silver halide photographic sensitive material embodying the present invention can be made of, for example, paper, glass, cellulose acetate, cellulose nitrate, polyester, polyamide, or polystyrene, or combination of two kinds or more of materials, e.g. paper and a polyolefin such as polyethylene, polypropylene, or the like, in a laminate or otherwise in a pasted substrate according as the purpose requires.

In order to improve the adhesive property between the support and the emulsion layers the surface of said support may be treated by any of the techniques of surface treatment in general use, such as the treatment by a mechanical means or with an organic solvent to render the surface coarse, or the treatment by electron impact or flame, or said surface may be provided with a subbing layer.

The color developing agents contained in color developers, that are used for subjecting, to color developing, a silver halide emulsion of the invenion having incorporated inorganic sulfur, are aromatic primary amine color developing agents, and examples of which are aminophenol derivatives and p-phenylenediamine derivatives. These color developing agents may be used in the form of organic or inorganic salt, and examples of which include hydrochloride, sulfate, p-toluene sulfonate, sulfite, oxalate, and benzenesulfonate.

The useful aminophenol developing agents include o-aminophenol, p-aminophenol, 5-amino-2-hydroxytoluene, 2-amino-3-hydroxy-toluene, 2-hydroxy-3-amino-1,4-dimethylbenzene.

Particularly useful primary amine color developing agents are N, N-dialky-p-phenylenediamine compounds, wherein an alkyl and phenyl group thereof may or may not have a substituent.

Among such compounds, the especially advantageous compounds are N, N-dimethyl-p-phenylenediamine hydrochloride, N-methyl-p-phenylenediamine sulfate, 2-amino-5-(N-ethyl-N-dodecylamino)-toluene, N-ethyl-N-β-methanesulfonamidoethyl-3-ethyl-4-aminanilinefulfate, N-ethyl-N-β-hydroxyethylaminoaniline, 4-amino-3-methyl-N, N-diethylaniline, and 4-amino-N-(2-methoxyethyl)-N-ethyl-3-methylaniline p-toluenesulfonate.

These color developing agents can be used singly or in combination of more than two.

The concentration according to which these compounds are used is approximately 0.1 to 30 g, or, preferably, approximately 1 to 15 g per liter color developer. The amount smaller than 0.1 g per liter developer does not provide satisfactory dye density.

The processing temperature of a color developing bath is 10° to 65° C., or, preferably, 25° to 45° C.

The color developer for the image forming method of the invention can contain alkali agents conventionally used in a developer, and of which examples include sodium hydroxide, potassium hydroxide, ammonium hydroxide, sodium carbonate, potassium carbonate, sodium sulfate, sodium metaborate, and borax. The similar color developer may further contain various additives for example alkali metal halides such as potassium chloride, and sodium chloride; developing adjusting agents such as citradinic acid; and preservatives for preventing aging deterioration of color developer from deterioration, including sulfites such as sodium sulfite, hydroxylamines such as N, N-diethylhydroxylamine, polysaccharides such as glucose, polyalkanolamines such as triethanolamine, and tetronic acid, tetronimide, 2-anilinoethanol, hydroxyacetone, aromatic secondary alcohol, hyroxamic acid, or pyrogallol-1,3- dimethylether.

The pH level of the developer according to the invention is not less than 9.5, and, preferably, not more than 13. It is conventionally known that developing is accelerated by raising the pH level of developer. However, according to the invention, the silver halide color photographic light-sensitive material according to the invention enables satisfactorily rapid developing even with the PH of not more than 11.

The color developer solution according to the invention may contain various chelating agents as sequestering agents. The examples of chelating agents include amino-polycarboxylic acids such as ethylenediamine tetraacetic acid, and diethylenetriamine pentaacetatic acid; organic phosphonic acids such as 1- hyroxyethylidene-1, 1'-diphosphonic acid; aminopolyphosphoric acids such as aminotri(methylene phosphoric acid), and ethylenediamine tetraphosphoric acid; oxycarboxylic acids such as citric acid, and gluconic acid; phosphonocarboxylic acids such as 2-phosphonobutane-1,2,4-tricarboxylic acid; polyphosphoric acids such as tripolyphosphoric acid, and hexamethaphosphoric acid; and polyhydroxy compounds.

The particularly useful fluorescent whitening agents are water-soluble agents selected from stilbene, triazine, imidazolone, pyrazoline, triazole, coumarin, acetylene, oxazole and oxadiazole agents. These fluorescent whitening agents are described in U.S. Pat. Nos. 2,571,706, 2,581,057, 2,618,636, 2,702,296, 2,713,054, 2,715,630, 2,723,197, 3,269,840, 3,513,102, 3,615,544, 3,615,547, 3,684,729, 3778,854 and 3,789,012; British Pat. Nos. 669,590, 672,803, and 712,764; Netherlands Patent No. 74,109; West German Pat. No. 911,368; West German OLS No. 2,525,680; and Japanese Patent Examined Publication No. 7127/1959.

The light-sensitive materials of the invention can be processed by a variety of methods. For example, color developing comprises a color developing process, bleaching process, and fixing process, and, in compliance with a specific requirement, washing and/or stabilizing. Instead of both a process using bleaching solution and a process using fixing solution, the bleach-fixing process can be performed by using single-bath bleach-fixing solution. In combination with these processess, the pre-hardening process and neutralization, stop-fixing process, and post-hardening process may be incorporated. The typical combination of processes are as follows. (These combinations include as the final process, any of a washing process, stabilizing process, and washing-stabilizing process.)

Color developing—bleaching process—fixing process.

Color developing process—bleach-fixing process

Pre-hardening process—neutralization process—color developing process—stop-fixing process—washing process—bleaching process—fixing process—washing process—post-hardening process Color developing process—washing process—auxiliary color developing process—stopping process—bleaching process—fixing process As bleaching agents for use in the bleach-fix solution or bleaching solution at the bleaching stage there are generally known those having such metal ions as iron, cobalt, and copper with such organic acid as amino-polycarboxylic acid, oxalic acid, or citric acid.

As typical examples of the above mentioned amino-polycarboxylic acid are mentioned the following:

ethylenediamine tetra-acetic acid;
diethylene triamine penta acetic acid;
propylene diamine tetra-acetic acid;
nitrotriacetic acid;
iminodiacetic acid;
ethylether diamine tetra-acetic acid;
ethylene diamine tetra-propionic acid;
disodium ethylene diamine tetra-acetate;
pentasodium diethylene triamine penta-acetate;
sodium nitrilotriacetate;

The bleaching solution may contain, together with the bleaching agent, various kinds of additives. Where a bleach-fixing solution is used in the bleaching stage, a solution having a composition including, in addition to the bleaching agent, a silver halide fixing agent is employed. The bleach-fixing solution may further contain a halogen compound, such as for example potassium bromide. As is the case with the bleaching solution, the bleach-fixing solution may contain various other additives, such as pH buffers, defoamer, surface active agent, preservative chelating agent, stabilizer, and organic solvent.

As silver halide fixing agents there may be mentioned, for example, compounds capable of forming a water-soluble silver salt by reacting with silver halide, such as for example sodium thiosulfate, ammonium thiosulfate, potassium thiocyanate, sodium thiocyanate, thiourea, and thioether, which are used for ordinary fixing purposes.

[EXAMPLES]

The invention is further illustrated in detail by the following examples. It is noted, however, that the examples given represent only one mode of carrying out the invention; and the invention is not limited by these examples.

EXAMPLE 1

An aqueous solution of silver nitrate and an aqueous solution of halide, a mixed aqueous solution of potassium bromide and sodium chloride, were added to aqueous solution of inactive gelatin by the double jet technique, the solutions being mixed together. For this purpose, the temperature, pH, and pAg conditions were controlled in accordance with the procedure described in Japanese Patent O.P.I. Publication No. 45437/1984 so that they were respectively maintained at 50° C., 3.0, and 7.8. Then, desalting, was carried out in a conventional way, and thus EMP-1 was obtained. EMP-1 was a monodisperse emulsion composed of cubic silver chlorobromide grains having a mean grain diameter of 0.7 μm which contained 99.5 mol % of silver chloride.

Subsequently, EMP-1 was subjected to chemical sensitization by using sodium thiosulfate 3 mg per mol of silver halide under optimum conditions, and then the chemical sensitization was terminted in a conventional manner, whereby EM-1, a comparison emulsion was prepared.

Nextly, EM-2, EM-3, and EM-4 were prepared in same way as in EM-1, except that 0.005 mg, 0.10 mg, and 0.5 mg of the inorganic sulfur of the invention per mol of silver halide were respectively added at the end of chemical sensitization. In this conjunction it is noted that the inorganic sulfur was added in the form of 0.005 wt. % ethanol solution.

Nextly, EM-5 and EM-6 were prepared in same way as in EM-2 through EM-4, except that the following compounds SC-1 and SC-2, as sulfur-containing compounds for comparison purposes, were added in the amount of 1.0 mg per mol of silver halide.

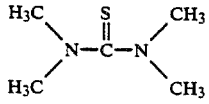

SC-1

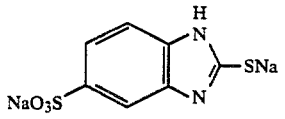

SC-2

Nextly, the foregoing emulsions EM-1 to EM-6 were coated on a paper support laminated with polyethylene on both sides, and thus photosensitive materials I-1 to I-6 were obtained.

These samples I-1 to I-6 were subjected to exposure by employing a KS-7 type sensitometer (made by Konishiroku Photo Industry Co. Ltd.) and through an optical wedge, and then same was processed by using a developing solution and a fixing solution respectively of the following compositions.

| [Processing procedure] | |
|---|---|
| Development | 5 min (ordinary temperature) |
| Fixing | 3 min (ordinary temperature) |
| Washing | 5 min (ordinary temperature) |

| [Developing solution] | |
|---|---|
| Water | 500 ml |
| Metol | 2.5 g |
| L-ascorbic acid | 10 g |
| Potassium carbonata | 72.5 g |
| Potassium bromide | 1.0 g |

Water was added to the solution to a total quantity of 1000 ml, of pH of the solution was adjusted to 10.3 by using potassium hydraxide or sulfuric acid.

| [Fixing solution] | |
|---|---|
| Sodium thiosulfate | 250 g |
| Sodium anhydrosulfite | 15 ml |
| Gracical acetic acid | 15 ml |
| Potassium alum | 15 g |

Water was added to the solution to a total quantity of 1000 ml.

Measurements were made by a densitometer PDA-65;(made by Konica Corporation) for reflection density of the samples obtained, to determine values for the following characteristics as defind below:

Gradation (γ): Gradient of a straight line connecting between density 0.5 and density 1.5 in the chracteristic curve.

Fog: Density of unexposed portion

The results are shown in Table 1.

TABLE 1

| Sample | | Inorganic sulfur (mg/mol AgX) | γ | Fog |
|---|---|---|---|---|
| I-1 | Comparative | — | 3.25 | 0.06 |
| I-2 | Inventive | 0.005 | 3.47 | 0.05 |
| I-3 | Inventive | 0.10 | 3.70 | 0.04 |
| I-4 | Inventive | 0.50 | 3.82 | 0.05 |
| I-5 | Comparative | Comparative compound SC-1 1.00 | 2.50 | 0.12 |
| I-6 | Comparative | Comparative compound SC-2 1.00 | 2.70 | 0.05 |

It can be seen from Table 1 that by adding inorganic sulfur at the end of chemical sensitization, a light-sensitive material having high contrast and low fog characteristics can be obtained. In contrast to this, with light-sensitive material 1-5 and 1-6 in which SC-1 or SC-2, a sulfur compound known in the art was added, no light-sensitive material which exhibits both high contrast and decreased fog as did the light-sensitive materials of the invention can be obtained.

Therefore, it is clear that adding a single-element sulfur is a technique which is completely different from the practice of adding such sulfur compound as has been known in the art.

EXAMPLE 2

In this example, the invention was applied to a color photographic light-sensitive material, in which inorganic sulfur was added to a red-sensitive emulsion layer in particular.

Samples EMP-2 to EMP-6, details of which are shown in Table 2, were prepared in same way as EMP-1 in Example 1, except that the rate of adding aqueous solutions of silver nitrate and of halide and the composition of the aqueous halide solution were changed.

Electromicroscopic examinations showed that EMP-2 to EMP-6 all had a twinned crystal incllusion of not more than 5% and they were emulsions composed principally of cubic silver halide grains.

TABLE 2

| Emulsion No. | Silver halide composition (mol %) | Mean grain dia μm | Coefficient of variation |
|---|---|---|---|
| EMP-2 | $AgBr_{0.20}Cl_{0.80}$ | 0.40 | 0.10 |
| EMP-3 | $AgBr_{0.05}Cl_{0.95}$ | 0.40 | 0.09 |
| EMP-4 | $AgBr_{0.005}Cl_{0.995}$ | 0.40 | 0.08 |
| EMP-5 | $AgBr_{0.005}Cl_{0.995}$ | 0.40 | 0.17 |
| EMP-6 | AgCl | 0.40 | 0.08 |

Nextly, samples EMP-2 to EMP-6 were subjected to chemical sensitization under the conditions shown in Table 3, and thus red sensitive emulsions EM-7 to EM-19 were prepared.

Sodium thiosulfate (3.5 mg per mol of silver halide) was used as a chemical sensitizer, and the below-mentioned sensitizing dye RS-5, $5\times10^5$ mol per mol of silver halide, was used. Other conditions were same as in the case with EM-1 to EM-6 in Example 1.

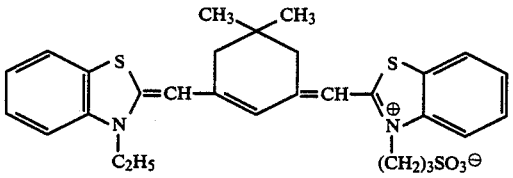

RS-5

TABLE 3

| Emulsion No. | Chemically unsensitized emulsion | Inorganic sulfur added at end of chemical sensitization (mg/mol AgX) |
|---|---|---|
| EM-7 | EMP-2 | — |

TABLE 3-continued

| Emulsion No. | Chemically unsensitized emulsion | Inorganic sulfur added at end of chemical sensitization (mg/mol AgX) |
|---|---|---|
| EM-8 | EMP-2 | 0.2 |
| EM-9 | EMP-3 | — |
| EM-10 | EMP-3 | 0.2 |
| EM-11 | EMP-4 | — |
| EM-12 | EMP-4 | 0.002 |
| EM-13 | EMP-4 | 0.02 |
| EM-14 | EMP-4 | 0.2 |
| EM-15 | EMP-4 | 1.0 |
| EM-16 | EMP-5 | — |
| EM-17 | EMP-5 | 0.2 |
| EM-18 | EMP-6 | — |
| EM-19 | EMP-6 | 0.2 |

Nextly, color photographic light-sensitive materials II-1 to II-13 were prepared by using the foregoing EM-7 to EM-19 as red-sensitive emulsions and with other constructional conditions as set forth in Table 4.

TABLE 4

| Layer | Construction |
|---|---|
| 7th layer | Gelatin (1.0 g/m²) |
| 6th layer | UV light absorber (UV-1 0.3 g/m²)<br>Gelatin (0.7 g/m²) |
| 5th layer | Red-sensitive emulsion (amount of coated silver 0.20 g/m²)<br>Cyan coupler CC-1 (0.15 g/m²)<br>Cyan coupler CC-2 (0.25 g/m²)<br>Dibutylphthalate (0.2 g/m²)<br>Gelatin (1.0 g/m²) |
| 4th layer | UV light absorber (UV-1 0.7 g/m²)<br>Gelatin (1.3 g/m²) |
| 3rd layer | Green-sensitive silver chlorobromide Emulsion (silver bromide 0.5 ml %, coated amount of silver 0.30 g/m²)<br>Magenta coupler (MC-1 0.4 g/m²)<br>Dibutylphthalate (0.2 g/m²)<br>Gelatin (1.5 g/m²) |
| 2nd layer | Gelatin (1.0 g/m²)<br>HQ-1 (0.1 g/m²) |
| 1st layer | Blue-sensitive silver chlorobromide emulsion (silver bromide 0.5 ml %, amount of coated silver 0.35 g/m²)<br>Yellow coupler (Y-3 0.9 g/m²)<br>Dibutylphthalate (0.03 g/m²)<br>Gelatin (2.0 g/m²) |
| Support | Polyethylene coated paper |

Magenta coupler

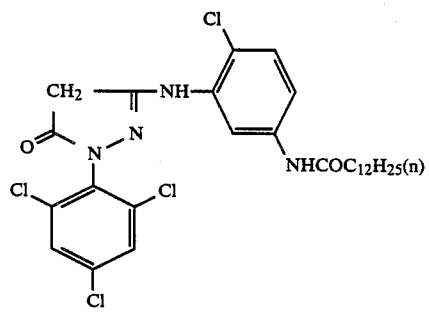

MC-1

Cyan coupler

-continued

CC-1

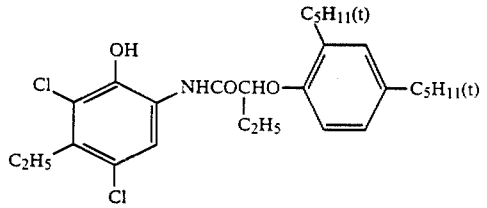

CC-2

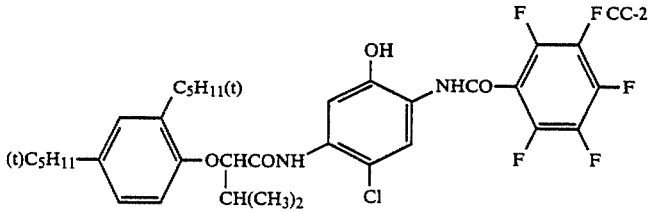

UV absorber

UV-1

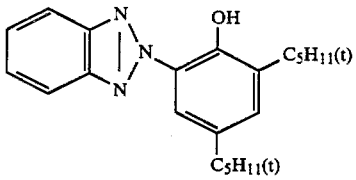

HQ-1

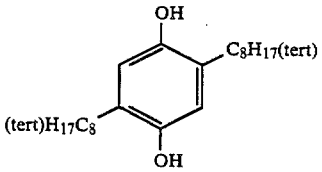

The light-sensitive materials II-1 to II-13 thus obtained were subjected to exposure by using a KS-7 type sensitometer (made by Konishiroku Photo Industry Co., Ltd.) and through an optical wadge, and then they were subjected to the development process set forth below.

| [Processing procedure] | Process time | Process temp |
|---|---|---|
| Color development | 3.5 min | 33° C. |
| Bleach-fixing | 1.5 min | 33° C. |
| Washing | 3 min | 33° C. |
| Drying | — | 80° C. |

| [Color developing solution] | |
|---|---|
| Water | 700 ml |
| Benzyl alcohol | 15 ml |
| Ethylene glycol | 15 ml |
| Hydroxyl amine sulfate | 2 g |
| N-ethyl-N-(β-methane sulfonamide ethyl)-3-methyl-4-amino aniline sulfate | 4.4 g |
| Potassium carbonate | 30 g |
| Potassium bromide | 0.4 g |
| Potassium chloride | 0.5 g |
| Potassium sulfite | 2 g |

Water was added to a total amount of 1 l. (pH=10.2)

| [Bleach-fixing solution] | |
|---|---|
| Ferric ammonium ethylenediamenetetra-acetrate dihydride | 61 g |
| Diammonium ethylendiaminetetraacetrate | 5 g |
| Ammonium thiosulfate | 125 g |
| Sodium metabisulfite | 13 g |

-continued

| [Bleach-fixing solution] | |
|---|---|
| Sodium sulfite | 2.7 g |

Water was added to the solution to a total quantity of 1 l. (pH=7.2)

The samples thus obtained were evaluated for γ and fog in same manner as in Example 1. For reflective density, cyane density, reflection density to red light was evaluated. The results are shown in Table 5.

TABLE 5

| | Light-sensitive material | Red-sensitive emulsion | γ | Fog |
|---|---|---|---|---|
| II-1 | Comparative | EM-7 | 3.2 | 0.07 |
| II-2 | Inventive | EM-8 | 3.43 | 0.06 |
| II-3 | Comparative | EM-9 | 3.22 | 0.07 |
| II-4 | Inventive | EM-10 | 3.62 | 0.06 |
| II-5 | Comparative | EM-11 | 3.20 | 0.07 |
| II-6 | Inventive | EM-12 | 3.35 | 0.06 |
| II-7 | Inventive | EM-13 | 3.58 | 0.06 |
| II-8 | Inventive | EM-14 | 3.93 | 0.05 |
| II-9 | Inventive | EM-15 | 4.15 | 0.06 |
| II-10 | Comparative | EM-16 | 2.80 | 0.08 |
| II-11 | Inventive | EM-17 | 3.32 | 0.06 |
| II-12 | Comparative | EM-18 | 3.25 | 0.07 |
| II-13 | Inventive | EM-19 | 3.88 | 0.06 |

It can be seen from Table 5 that in the case where the invention is applied to a color light-sensitive material, addition of inorganic sulfur is very effective as well for contrast improvement and fog reduction. Table 5 shows further that emulsions having higher monodispersibility or smaller coefficient of variation are more effective in the above respect, and that such advantage is greater as the silver chloride content of the emulsion becomes higher, and especially where the silver chloride content exceeds 90 mol %.

EXAMPLE 3

With the 13 light-sensitive material samples prepared in Example 2, tests were carried out for their withstand characteristics against mingling of bleach-fixing solution, and the light-sensitive materials were evaluated for their stability in processing stages. Test of bleach-fixing solution mingling withstand characteristic withstand A color developing solution-B was prepared by adding 0.6 ml of the foregoing bleach-fix solution per 1 of aforesaid color developing solution-A.

Exposure, developing, and density measurements were carried out using the developing solution so prepared, in order to evaluate sensitivity $S_a$, gamma $\gamma$, and fog characteristics.

Sensitivity: A reciprocal number relative to exposure which is necessary for provision of a reflection density of 0.8.

$\gamma$: Means same as in Examples 1 and 2.

Fog: Means same as in Examples 1 and 2.

Evaluation was given in terms of changes, $\Delta S_8$, $\Delta r$, $\Delta$Fog, in characteristic values from those in the case of color devloping solution, hereinafter referred to as CD, where CD-B was used. $\Delta S_a$, $\Delta\gamma$, $\Delta\gamma$, and $\Delta$Fog are defined as follows.

$$\Delta S_a = \frac{S_a \text{ where } CD\text{-}B \text{ is used}}{S_a \text{ where } CD\text{-}A \text{ is used}} \times 100$$

$$\Delta\gamma = (\gamma \text{ where } CD\text{-}B \text{ is used}) - (\gamma \text{ where } CD\text{-}A \text{ is used})$$

$$\Delta\text{Fog} = (\text{Fog where } CD\text{-}B \text{ is used}) - (\text{Fog where } CD\text{-}A \text{ is used})$$

The results are shown in Table 6.

TABLE 6

| Light-sensitive | | $\Delta S_a$(%) | $\Delta\gamma$ | $\Delta$Fog |
|---|---|---|---|---|
| II-1 | Comparative | +40 | +0.83 | +0.04 |
| II-2 | Inventive | +35 | +0.61 | +0.03 |
| II-3 | Comparative | +42 | +0.72 | +0.04 |
| II-4 | Inventive | +30 | +0.37 | +0.02 |
| II-5 | Comparative | +38 | +0.68 | +0.04 |
| II-6 | Inventive | +35 | +0.57 | +0.03 |
| II-7 | Inventive | +32 | +0.42 | +0.02 |
| II-8 | Inventive | +25 | +0.25 | +0.01 |
| II-9 | Inventive | +23 | +0.21 | +0.02 |
| II-10 | Comparative | +48 | +1.01 | +0.05 |
| II-11 | Inventive | +37 | +0.60 | +0.03 |
| II-12 | Comparative | +45 | +0.72 | +0.04 |
| II-13 | Inventive | +30 | +0.40 | +0.02 |

It can be seen from Table 6 that samples having inorganic sulfur added thereto are all valued smaller in $\Delta S_a$, $\Delta\gamma$, and $\Delta$Fog, indicating that considerable improvement has been effected in process stability. The table shows further that samples having better monodispersibility, that is, lower coefficient of variation, exhibit higher process stability. Where inorganic sulfur is added to an emulsion whose silver chloride content exceeds 90 mol %, it is apparent that much greater improvement in process stability can be obtained.

EXAMPLE 4

Emulsion EMP-1 as the same as in Example 1 was prepared.

Next, to EMP-1 was added sodium thiosulfate (3 mg per mol silver halide), whereby optimum chloride sensitization was performed under the conditions of a temperature 55° C. Then, the chemical sensitization was terminated using a conventional method, thus comparative emulsion EM-21 was obtained.

Further, emulsions EM-22, EM-23 and EM-24 were prepared in a manner identical with Em-21, except that $\alpha$-sulfur according to the invention was added 3 minutes before the addition of sodium thiosulfate, at a rate, respectively of 0.001 mg, 0.15 mg, and 0.60 mg per mol of silver halide. Additionally, $\alpha$-sulfur was incorporated in the form of 0.005 wt % ethanol solution.

Furthermore, EM-25 and EM-26 were prepared in the same manner as EM-22 through EM-24, except that the compounds SC-1 and SC-2 the same as used in Example 1 as comparative sulfur-containing compounds were correspondingly incorporated at a rate of 1.0 mg per mol of silver halide instead of the above $\alpha$-sulfur 3 minutes before the addition of sodium thiosulfate.

Then, the above EM-21 through EM-26 were independently applied on a paper support laminated with polyethylene on both sides to provide light-sensitive material samples VI-1 through VI-6.

The above samples VI-1 through VI-6 were exposed and processed in the same manner as in Example 1.

Processed samples were evaluated in the same manner as in Example 1. Sensitivity is indicated by relative value based on the sensitivity of comparative IV-1. The obtained data are listed in Table 7.

TABLE 7

| Sample | | *$\alpha$-sulfur (mg/molAgX) | Sensitivity | $\gamma$ | Fog |
|---|---|---|---|---|---|
| VI-1 | Comparative | — | 100 | 3.15 | 0.05 |
| VI-2 | Inventive | 0.001 | 125 | 3.37 | 0.05 |
| VI-3 | Inventive | 0.15 | 121 | 3.48 | 0.03 |
| VI-4 | Inventive | 0.60 | 118 | 3.55 | 0.04 |
| VI-5 | Comparative | Comparative compound SC-1 1.00 | 123 | 2.65 | 0.00 |
| VI-6 | Comparative | Comparative compound SC-2 1.0 | 73 | 2.72 | 0.04 |

Table 7 reveals that the chemical sensitization in the presence of inorganic sulfur of the invention ensures a light-sensitive material having high sensitvity, low fog and high contrast. On the other hand, when using SC-1 or SC-2 having sulfur atoms in its molecules but not being a compound of the present invention, the same effects as in the present invention cannot be obtained owing to low contrast and increased fog, in the case of SC-1, or owing to low sensitivity and low contrast, in the case of SC-2.

EXAMPLE 5

The following test was performed to examine the effects of the timing at which inorganic sulfur is added.

First, a part of EMP-1 prepared in Example 4 was separated, and dissolved at 40° C., thereby the temperature was maintained.

Next, this EMP-1 was divided into seven subparts. Each part was heated from 40° C. to 55° C., heating commonly took 30 minutes, and chemically sensitized by adding sodium thiosulfate at a rate of 2 mg per mol silver halide. Then, the chemical sensitization was terminated by a conventional method, thus emulsions EM-27 through EM-33 were obtained. Incidentally, for emulsions EM-28 through EM-33, $\alpha$-sulfur at a rate of 0.2 mg per mol silver halide was incorporated in the form of 0 005 wt % ethanol solution at a timing of incorporation listed in Table 8.

Further, using EM-27 through EM-33, in a manner identical with Example 4, light-sensitive materials V-1 through V-7 were prepared, thereby subjected to a measuring method described in Example 4 in order to determine sensitivity, γ, and fog. Table 8 lists the obtained data.

As is obvious from the results shown in Table 2, it is found that the effects of the invention, namely, effect of higher sensitivity, lower fogging and higher contrast, may be obtained when adding α-sulfur relating in the invention at any point of time with in the range indicated in Table 2.

It is further found from Table 2 that α-sulfur should preferably be added either at substantially the same time with that of adding a chemical sensitizer or before the adding of the chemical sensitizer, so that the effects of the invention may be displayed much better than the other adding time.

TABLE 8

| | Sample | Emulsion | Timing of incorporating α-sulfur | Sa | γ | Fog |
|---|---|---|---|---|---|---|
| V-1 | Comparative | EM-27 | — | 100 | 3.10 | 0.05 |
| V-2 | Inventive | EM-28 | Initiation of heating, at 40° C. | 126 | 3.42 | 0.03 |
| V-3 | Inventive | EM-29 | 5 min. before adding sodium thiosulfate | 127 | 3.44 | 0.03 |
| V-4 | Inventive | EM-30 | At the same time of adding sodium thiosulfate | 125 | 3.40 | 0.03 |
| V-5 | Inventive | EM-31 | 5 min. after adding sodium thiosulfate | 122 | 3.45 | 0.03 |
| V-6 | Inventive | EM-32 | 30 min. after adding sodium thiosulfate | 110 | 3.48 | 0.04 |
| V-7 | Inventive | EM-33 | 60 min. after adding sodium thiosulfate | 108 | 3.51 | 0.04 |

EXAMPLE 6

In this example, the application of the present invention to a color photographic light-sensitive material in which inorganic sulfur being incorporated into the red-sensitive emulsion layer, is described.

Emulsions EMP-2 through EMP-6 as the same as used in Example 2 were propare.

Next, emulsions EMP-2 through EMP-6 were chemically sensitized under the conditions specified in Table 9 in order to prepare red-sensitive emulsions EM-34 through EM-46.

In this case, a sodium thiosulfate of 3.5 mg per mol silver halide was used as a chemical sensitizer and $5\times10^{-5}$ mol per mol silver halide of compound RS-5 was used as a spectral sensitizing dye. The other conditions were left identical with EM-21 through EM-26 Example 4.

Further, using EM-34 through EM-46, respectively as a red-sensitive emulsion, light-sensitive materials VI-1 through VI-13 were prepared, in the same manner in Example 2.

TABLE 9

| Emulsion | Emulsion without chemical sensitization | α-sulfur added 3 min. before chemical sensitization (mg/molAgX) |
|---|---|---|
| EM-34 | EMP-2 | — |
| EM-35 | EMP-2 | 0.2 |
| EM-36 | EMP-3 | — |
| EM-37 | EMP-3 | 0.2 |
| EM-38 | EMP-4 | — |
| EM-39 | EMP-4 | 0.002 |
| EM-40 | EMP-4 | 0.02 |
| EM-41 | EMP-4 | 0.2 |
| EM-42 | EMP-4 | 1.0 |

TABLE 9-continued

| Emulsion | Emulsion without chemical sensitization | α-sulfur added 3 min. before chemical sensitization (mg/molAgX) |
|---|---|---|
| EM-43 | EMP-5 | — |
| EM-44 | EMP-5 | 0.2 |
| EM-45 | EMP-6 | — |
| EM-46 | EMP-6 | 0.2 |

The light-sensitive materials obtained as above were exposed to light through an optical wedge with an actinometer (Model KS-7, Konica Corporation), and then subjected to processing in the same as in Example 2.

The samples obtained above were evaluated for sensitivity, γ, and fog in a manner identical with Example 4. However, as for the reflective density, a cyan density (red light reflective density) was measured with each sample. Table 10 lists the obtained data.

TABLE 10

| | Light-sensitive material | Red-sensitive material | Sa | γ | Fog |
|---|---|---|---|---|---|
| VI-1 | Comparative | EM-34 | 100 | 3.08 | 0.07 |
| VI-2 | Invention | EM-35 | 118 | 3.31 | 0.06 |
| VI-3 | Comparative | EM-36 | 97 | 3.12 | 0.07 |
| VI-4 | Invention | EM-37 | 120 | 3.34 | 0.05 |
| VI-5 | Comparative | EM-38 | 93 | 3.05 | 0.07 |
| VI-6 | Invention | EM-39 | 105 | 3.15 | 0.06 |
| VI-7 | Invention | EM-40 | 131 | 3.30 | 0.05 |
| VI-8 | Invention | EM-41 | 130 | 3.47 | 0.04 |
| VI-9 | Invention | EM-42 | 125 | 3.61 | 0.05 |
| VI-10 | Comparative | EM-43 | 107 | 2.90 | 0.07 |
| VI-11 | Invention | EM-44 | 120 | 3.20 | 0.06 |
| VI-12 | Comparative | EM-45 | 90 | 3.17 | 0.07 |
| VI-13 | Invention | EM-46 | 125 | 3.45 | 0.05 |

Table 10 reveals that in the application of the invention to a color photographic light-sensitive material the incorporation of inorganic sulfur is effective in obtaining high contrast and low fog. Further, Table 10 reveals that the above effect becomes larger with a more highly mono-dispersed emulsion, that is, an emulsion having a smaller variation coefficient and that the above effect is the largest when the percentage of silver chloride becomes high, in particular, above 90 mol %.

EXAMPLE 7

Emulsion EMP-1 the same as used in Example 1 was prepared.

Next, to EMP-1 was added sodium thiosulfate (3 mg per mol silver halide), whereby optimum chemical sensitization was performed under the conditions of a temperature 55° C. Then, the chemical sensitization was terminated using a conventional method, thus comparative emulsion EM-51 was obtained.

Further, emulsions EM-52 through EM-56 were prepared in a manner identical with EM-51, except that α-sulfur at a rate listed in Table 11 was added at the initiation of chemical sensitization when sodium thiosulfate was added, and/or at the completion of chemical sensitization. Additionally, α-sulfur was incorporated in the form of 0.005 wt % ethanol solution.

Then, the above emulsions EM-51 through EM-56 were independently applied on a paper support having polyethylene lamination on both sides, thus light-sensitive material samples VII-1 through VII-6 were prepared.

The above samples VII-1 through VII-6 were exposed, processed and evaluated in the same manner as in Example 1. The obtained data are listed in Table 1. In the Table, sensitivity is indicated by relative value based on the sensitivity of comparative sample VII-1.

TABLE 11

| Light-sensitive material | Emulsion No. | α-sulfur (mg/molAgX) Initiation of chemical sensitization | Completion of chemical sensitization | Sensitivity | γ | Fog |
|---|---|---|---|---|---|---|
| VII-1 | EM-51 | — | — | 100 | 3.14 | 0.08 |
| VII-2 | EM-52 | 0.2 | — | 115 | 3.42 | 0.06 |
| VII-3 | EM-53 | 0.15 | 0.05 | 131 | 3.65 | 0.05 |
| VII-4 | EM-54 | 0.1 | 0.1 | 127 | 3.72 | 0.05 |
| VII-5 | EM-55 | 0.05 | 0.15 | 124 | 3.76 | 0.05 |
| VII-6 | EM-56 | — | 0.2 | 88 | 3.75 | 0.07 |

Table 11 reveals that when compared to adding all the amount of inorganic sulfur of the invention at one, incorporating inorganic sulfur of the invention twice, first at the initiation of chemical sensitization and second at the completion in chemical sensitization, is more advantageous in obtaining a light-sensitive material of further improved total image quality in terms of sensitivity, γ, and fog.

EXAMPLE 8

The following test was performed to examine the effects of the timing at which inorganic sulfur is added.

First, a part of EMP-1 prepared in Example 7 was separated, and dissolved at 40° C., thereby the temperature was maintained.

Next, this EMP-1 was divided into twelve subparts. Each part was heated from 40° C. to 55° C., heating commonly took 30 minutes, and chemically sensitized by adding sodium thiosulfate at a rate of 2 mg per mol silver halide. Then, the chemical sensitization was terminated by a conventional method, thus emulsions EM-61 through EM-72 were obtained. Incidentally, α-sulfur at a rate of 0.2 mg per mol silver halide was incorporated in the form of 0.005 wt % ethanol solution into each emulsion at a timing of incorporation listed in Table 12.

Further, using EM-61 through EM-72, in a manner identical with Example 7, light-sensitive materials VIII-1 through VIII-12 were prepared, thereby subjected to a measuring method described in Example 7 in order to determine sensitivity, γ, and fog. Table 12 lists the obtained data.

TABLE 12

| Light-sensitive material | Emulsion | Timing of 1st addition of α-sulfur (amount added: 0.13 mg/mol Agx) | Timing of 2nd addition of α-sulfur (amount added: 0.10 mg/mol Agx) | Sensitivity | γ | Fog |
|---|---|---|---|---|---|---|
| VIII-1 | EM-51 | — | At the time of end chemical sensitization | 100 | 3.81 | 0.07 |
| VIII-2 | EM-52 | Initiation of heating | At the time of end chemical sensitization | 148 | 3.73 | 0.04 |
| VIII-3 | EM-53 | 5 min. before adding sodium thiosulfate | At the time of end chemical sensitization | 146 | 3.71 | 0.04 |
| VIII-4 | EM-54 | At the same time of adding sodium thiosulfate | At the time of end chemical sensitization | 150 | 3.70 | 0.04 |
| VIII-5 | EM-55 | 5 min. after adding sodium thiosulfate | At the time of end chemical sensitization | 144 | 3.76 | 0.04 |
| VIII-6 | EM-56 | 30 min. after adding sodium thiosulfate | At the time of end chemical sensitization | 133 | 3.83 | 0.05 |
| VIII-7 | EM-57 | 60 min. after adding sodium thiosulfate | At the time of end chemical sensitization | 131 | 3.86 | 0.05 |
| VIII-8 | EM-58 | 5 min. before adding sodium thiosulfate | 5 min. after adding sodium thiosulfate | 125 | 3.36 | 0.06 |
| VIII-9 | EM-59 | 5 min. before adding sodium thiosulfate | 30 min. after adding sodium thiosulfate | 115 | 3.38 | 0.06 |
| VIII-10 | EM-60 | 5 min. before adding sodium thiosulfate | 20 min. before the start of the stop process in chemical sensitization | 127 | 3.42 | 0.05 |
| VIII-11 | EM-61 | 5 min. before adding sodium thiosulfate | 3 min. before the start of the stop process in chemical sensitization | 146 | 3.70 | 0.04 |
| VIII-12 | EM-62 | 5 min. before adding sodium thiosulfate | 3 min. after the start of the stop process in chemical sensitization | 145 | 3.73 | 0.04 |

Table 12 indicates that adding inorganic sulfur according to the invention by simultaneously satisfying the two criteria of addition is more below, significant effects are achieved compared with adding sulfur in several times:

(1) after the completion of chemical sensitization in the presence of inorganic sulfur (for example, incorporating inorganic sulfur simultaneously together with sodium thiosulfate)

(2) further incorporating inorganic sulfur at the stop process of chemical sensitization.

Closer examination of Table 12 reveals that the effects of the invention are further manifest if inorganic sulfur is incorporated viartually simultaneously together with or before the addition of chemical sensitizer.

EXAMPLE 9

In this example, the application of the present invention to a color photographic light-sensitive material, inorganic sulfur being incorporated into the red-sensitive emulsion layer, is described.

Emulsions EMP-2 through EMP-6 set forth in Example 2 were prepared.

Next, emulsions EMP-2 through EMP-6 were chemically sensitized under the conditions specified in Table 13 in order to prepare red-sensitive emulsions EM-71 through EM-86.

RS-6

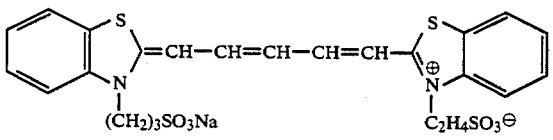

TABLE 13

| Emulsion | Emulsion with out chemical sensitization | α-sulfur (mg/mol Ag ×) Initiation of chemical sensitization | Completion of chemical sensitization |
|---|---|---|---|
| EM-71 | EMP-2 | — | 0.30 |
| EM-72 | EMP-2 | 0.15 | 0.15 |
| EM-73 | EMP-3 | — | 0.30 |
| EM-74 | EMP-3 | 0.15 | 0.15 |
| EM-75 | EMP-4 | — | 0.003 |
| EM-76 | EMP-4 | 0.0015 | 0.0015 |
| EM-77 | EMP-4 | — | 0.03 |
| EM-78 | EMP-4 | 0.015 | 0.015 |
| EM-79 | EMP-4 | — | 0.30 |
| EM-80 | EMP-4 | 0.15 | 0.15 |
| EM-81 | EMP-4 | — | 1.50 |
| EM-82 | EMP-4 | 0.75 | 0.75 |
| EM-83 | EMP-5 | — | 0.30 |
| EM-84 | EMP-5 | 0.15 | 0.15 |
| EM-85 | EMP-6 | — | 0.30 |
| EM-86 | EMP-6 | 0.15 | 0.15 |

Further, using EM-71 through EM-86, respectively as a red-sensitive emulsion, and leaving the other composition be as specified in Example 2, light-sensitive materials IX-1 through IX-16 were prepared.

The light-sensitive materials obtained as above were exposed, processed and evaluated in the same manner as in Example 2.

Table 14 lists the obtained data.

TABLE 14

| Light-sensitive material | Emulsion No. | α-sulfur (mg/mol Agx) Initiation of chemical sensitization | Completion of chemical sensitization | Sensitive | γ | Fog |
|---|---|---|---|---|---|---|
| IX-1 | EM-71 | — | 0.30 | 100 | 3.58 | 0.07 |
| IX-2 | EM-72 | 0.15 | 0.15 | 125 | 3.50 | 0.06 |
| IX-3 | EM-73 | — | 0.30 | 96 | 3.61 | 0.07 |
| IX-4 | EM-74 | 0.15 | 0.15 | 128 | 3.60 | 0.05 |
| IX-5 | EM-75 | — | 0.003 | 115 | 3.49 | 0.07 |
| IX-6 | EM-76 | 0.0015 | 0.0015 | 146 | 3.45 | 0.06 |
| IX-7 | EM-77 | — | 0.03 | 106 | 3.63 | 0.07 |
| IX-8 | EM-78 | 0.15 | 0.015 | 142 | 3.65 | 0.05 |
| IX-9 | EM-79 | — | 0.30 | 93 | 3.78 | 0.06 |
| IX-10 | EM-80 | 0.15 | 0.15 | 137 | 3.77 | 0.04 |
| IX-11 | EM-81 | — | 1.5 | 85 | 3.92 | 0.08 |
| IX-12 | EM-82 | 0.75 | 0.75 | 125 | 3.90 | 0.06 |
| IX-13 | EM-83 | — | 0.30 | 103 | 3.41 | 0.07 |
| IX-14 | EM-84 | 0.15 | 0.15 | 135 | 3.40 | 0.06 |
| IX-15 | EM-85 | — | 0.30 | 90 | 3.75 | 0.07 |
| IX-16 | EM-86 | 0.15 | 0.15 | 129 | 3.74 | 0.05 |

Table 14 reveals that in the application of the invention to a light-sensitive material, incorporating inorganic sulfur dividingly, first at the initiation of chemical sensitization and second at the completion of chemical sensitization achieves the more effects in the general photographic performance, i.e. high sensitivity, high contrast and low fog. Close examination of Table 14 further reveals that the above effects are more manifest with a higher grade monodispersed emulsion, that is, an emulsion having a smaller variation coefficient, and that the above effects are the greatest when the silver chloride content is greater, in particular, in excess of 90 mol %, and the utilization of the effects provides a photographic light-sensitive material of superior quality.

EXAMPLE 10

Preparation of silver halide emulsion EMP-7

An aqueous solution of silver halide nitrate and an aqueous halide solution, an aqueous solution of a mixture of potassium bromide and potassium iodide, were added to aqueous solution of inactive gelatin by a double-jet method over a period of 120 minutes. The temperature was maintained at 60° C. and pAg at 9.0. Then by desalting and washing by conventional methods, EMP-7 was obtained. EMP-7 consisted of silver iodobromide grains (the silver iodide content 2 mol %) with an average grain size of 0.5 μm.

Next, EMP-7 was made to undergo chemical sensitization by adding sodium thiosulfate. The chemical sensitization was carried out at 60° C. and ended by lowering the temperature after a ripening time adequate for optimal sensitometric results, sensitivity and graduation.

After the chemical sensitization, sodium dodecylbenzenesulfonate as a coating aid and additional gelatin were incorporated into the specimen and a coating of the resultant emulsion was applied to a support of polyethylene terephthalate so as to form thereon a coating containing silver in a quantity of 4.0 g/m$^2$ and gelatin in a quantity of 5.0 g/m$^2$. The resulting coating was overlaid with a protective layer consisting of gelatin in a quantity of 3.0 g/m$^2$.

As shown in Table 15, samples X-1 through X-22 were produced by adding an inhibitor as an embodiment of the present invention and an inorganic sulfur at various points of time in the intervening time from the preparation of silver halide emulsion to the coating on the support.

Each sample thus obtained was subjected to wedge exposure by a sensitometer Model KS-7 (product of Konika Corporation), followed by development and fixation in accordance with the following processing procedure below. Upon completion of this procedure the samples were measured by a densitometer Model PDA-65 (product of Konika Corporation) with respect to sensitometric properties. The results are shown in Table 15.

In Table 15, $\gamma$ is the value indicating the graduation expressed by the reciprocal of the difference between the logarithms of the respective exposure values for obtaining the densities of 0.3 and 0.8. The larger the $\gamma$ value was, the more contrasty the gradation was.

The sensitivity is shown in terms of relative sensitivity with the sensitivity of sample X-1 as 100.

| | | |
|---|---|---|
| [Processing procedure] | | |
| Development | 12 min. | (20° C.) |
| Stopping | 30 sec. | (20° C.) |
| Fixing | 10 min. | (20° C.) |
| Washing | 5 min. | |
| [Developing solution] | | |
| Metol | | 2.5 g |
| l-Ascorbic Acid | | 10.0 g |
| Potassium bromide | | 1.0 g |
| Sodium metaborate | | 35.0 g |
| Addition of water | | 1 l |
| [Stop liquid] | | |
| Acetic acid (28%) | | 48 ml |
| Water | | 1 l |
| [Fixing solution] | | |
| Water | | 500 l |
| Sodium thiosulfate | | 240 g |
| Sodium sulfite anhydrous | | 10 g |
| Sodium bisulfite | | 25 g |

Make the quantity 1 liter by adding water or less the same between the different points of time of addition.

Pr-2: at the start of the chemical sensitization

Pr-3: at the completion of the chemical sensitization

Pr-4: in the intervening time after completion of chemical sensitization and immediately before coating Pr-1 through Pr-4 refer to addition to the silver halide emulsion.

PL: protective layer (added at the time of preparing coating solution for the protective layer)

In Table 15, the samples for comparison, for which the inhibitor was used singly, show that the use of the inhibitor in large quantities so as to inhibit the fogging effectively would cause marked retrogradation of the sensitivity and lower contrast. In contrast, the combination use of an inorganic sulfur, which is relavant to the present invention, inhibits fogging virtually without retrogradation of the sensitivity or without lower contrast. The table shows that, whereas the appropriate use of the inorganic sulfur should vary widely with differences in conditions, excessive use results in increases in fogging. It is, furthermore, seen that the invention brings about its effect irrespective of when the inhibitor and inorganic sulfur are added, but that it is preferably to add them before the chemical sensitization is ended.

EXAMPLE 11

TABLE 15

| | | | Inhibitor | | Inorganic sulfur | | Sensitometry | | |
|---|---|---|---|---|---|---|---|---|---|
| | Sample No. | Compound | Added amount mol/Ag × mol | Time for addition*1 | Added amount mol/Ag × mol | Time for addition*1 | Sensitivity | δ | Fog |
| Comparative | X-1 | — | — | — | — | — | 100 | 2.50 | 0.27 |
| | X-2 | S-4 | $2 \times 10^{-4}$ | Pr-3 | — | — | 98 | 2.48 | 0.25 |
| | X-3 | S-4 | $2 \times 10^{-3}$ | Pr-3 | — | — | 61 | 1.64 | 0.07 |
| | X-4 | S-4 | $2 \times 10^{-2}$ | Pr-3 | — | — | 44 | 1.20 | 0.06 |
| Inventive | X-5 | S-4 | $4 \times 10^{-4}$ | Pr-3 | 0.1 | Pr-3 | 98 | 2.46 | 0.09 |
| | X-6 | S-4 | $4 \times 10^{-4}$ | Pr-3 | 0.1 | Pr-3 | 95 | 2.47 | 0.07 |
| | X-7 | S-4 | $4 \times 10^{-4}$ | Pr-3 | 0.01 | Pr-3 | 100 | 2.50 | 0.13 |
| | X-8 | S-4 | $4 \times 10^{-4}$ | Pr-3 | 0.4 | Pr-3 | 94 | 2.41 | 0.06 |
| | X-9 | S-4 | $4 \times 10^{-4}$ | Pr-3 | 2.0 | Pr-3 | 91 | 2.37 | 0.08 |
| | X-10 | S-4 | $4 \times 10^{-4}$ | Pr-3 | 0.1 | Pr-1 | 97 | 2.44 | 0.10 |
| | X-11 | S-4 | $4 \times 10^{-4}$ | Pr-3 | 0.1 | Pr-2 | 94 | 2.47 | 0.06 |
| | X-12 | S-4 | $4 \times 10^{-4}$ | Pr-3 | 0.04 + 0.06 | Pr-2 + Pr-3 | 96 | 2.48 | 0.05 |
| | X-13 | S-4 | $4 \times 10^{-4}$ | Pr-3 | 0.1 | Pr-4 | 99 | 2.41 | 0.12 |
| | X-14 | S-4 | $4 \times 10^{-4}$ | Pr-3 | 0.05 + 0.05 | Pr-3 + PL | 96 | 2.43 | 0.08 |
| | X-15 | S-4 | $4 \times 10^{-4}$ | Pr-1 | 0.01 | Pr-2 | 98 | 2.46 | 0.07 |
| | X-16 | S-4 | $4 \times 10^{-4}$ | Pr-2 | 0.1 | Pr-2 | 96 | 2.47 | 0.06 |
| | X-17 | S-4 | $1 \times 10^{-4}$ $1.5 \times 10^{-4}$ | Pr-2 Pr-3 | 0.1 | Pr-2 | 98 | 2.47 | 0.05 |
| | X-18 | S-4 | $2.5 \times 10^{-4}$ | Pr-4 | 0.1 | Pr-2 | 99 | 2.48 | 0.10 |
| | X-19 | S-4 | $2.5 \times 10^{-4}$ | Pr-1 | 0.1 | Pr-1 | 96 | 2.47 | 0.09 |
| | X-20 | S-4 | $1 \times 10^{-4}$ + $1.5 \times 10^{-4}$ | Pr-2 + Pr-3 | 0.04 + 0.06 | Pr-2 + Pr-3 | 99 | 2.49 | 0.04 |
| | X-21 | S-4 | $2.5 \times 10^{-4}$ | Pr-4 | 0.1 | Pr-4 | 98 | 2.39 | 0.14 |
| | X-22 | S-4 | $1.5 \times 10^{-4}$ + $1 \times 10^{-4}$ | Pr-3 + PL | 0.04 + 0.06 | Pr-3 + PL | 97 | 2.45 | 0.08 |

Time for addition (*1) is express as follows:

Pr-1: During the process of forming silver halide grains. The addition during this process was at three different stages, i.e., (1) added preliminarily into reaction vessel before the silver nitrate solution and halide solution were poured in: (2) added simultaneously when the silver nitrate solution and halide solution were poured in, and (3) added in the intervening time after pouring in the silver nitrate solution and halide solution and before ending the washing. The results were more

Preparation of silver halide emulsion EMP-8

An aqueous solution of silver nitrate and an aqueous halide solution, an aqueous solution of a mixture of potassium bromide and sodium chloride, were added to an aqueous solution of inactive gelatin by a double-jet method over a period of 100 minutes. The temperature was maintained at 60° C. and pAg at 7.0. Then by desalting and washing by conventional methods, EMP-8 was obtained. EMP-8 consisted of tetradecahedral silver chloro-bromide grains, the silver chloride content 30 mole %, with an average grain size of 0.45 μm.

Next, EMP-8 was made to undergo chemical sensitization by adding sodium thiosulfate. The chemical sensitization was carried out at 55° C. and ended by lowering the temperature after a pripening time adequate for optimal sensitometric results sensitivity and gradation. The sample was spectrally sensitized by adding a sensitizing dye RS-7 just before the chemical sensitization was ended.

After the chemical sensitization, a cyan coupler CC-3 in a proportion of 0.4 mol per mol silver halide, which was dissolved in dioctyl phthalate, and sodium dodecylbenzenesulfonate as a coating aid were incorporated into the specimen and a coating of the resultant emulsion was applied to a support of paper, which was coated with a titanium oxide-containing polyethylene, so as to form thereon a coating containing silver in a quantity of 0.3 g/m$^2$ and gelatin in a quantity of 3.0 g/m$^2$. The resulting coating was overlaid with a protective layer consisting of gelatin in a quantity of 3.0 g/m$^2$.

As shown in Table 16, samples XI-1 through XI-15 were produced by adding an inhibitor as an embodiment of the present invention and an inorganic sulfur at various points of time during the preparation of the samples.

Each sample thus obtained was subjected to wedge exposure by a sensitometer Model KS-7, followed by development and fixation in accordance with the color developing processing procedure below. Upon completion of this procedure the specimens were tested by a desitometer Model PDA-65 with respect to sensitometric properties. The results are shown in Table 16.

In Table 16, γ is the value indicating the gradation expressed by the reciprocal of the difference between the logarithms of the respective exposure values for obtaining the densities of 0.5 and 1.5. The larger the γ value was, the more contrasty the gradation was.

The sensitivity is shown in terms of relative sensitivity with the sensitivity of sample XI-1 as 100.

| | | |
|---|---|---|
| [Processing procedure] | | |
| Color development | 38° C. | 3 min. 30 sec. |
| Bleach-fixation | 33° C. | 1 min. 30 sec. |
| Washing | 25–30° C. | 3 min. |
| Drying | 75–80° C. | Approx. 2 min. |
| [Color-developing solution] | | |
| Benzylalcohol | | 15 ml |
| Ethylene glycol | | 15 ml |
| Potassium sulfite | | 2.0 g |
| Potassium bromide | | 1.3 g |
| Sodium chloride | | 0.2 g |
| Potassium carbonate | | 30.0 g |
| Hydroxylamine sulfate | | 3.0 g |
| Polyphosphoric acid (TPPS) | | 2.5 g |
| 3-methyl-4-amino-N-ethyl-N-(β-methanesulfonamide ethyl)-aniline sulfate | | 5.5 g |
| Fluorescent bleaching agent (4,4'-diaminostilbenesulfonic acid derivative) | | 1.0 g |
| Potassium hydroxide | | 2.0 g |
| The total quantity is made 1 liter by addition of water and pH is adjusted to 10.20. | | |
| [Bleach-fixing solution] | | |
| Ferric di-ammonium ethylenediaminetetraacetate dihydrate | | 60.0 g |
| Ethylenediaminetetraacetic acid | | 3.0 g |
| Ammonium thiosulfate (70% solution) | | 100 ml |
| Ammonium sulfite (40% solution) | | 27.5 ml |

pH is adjusted to 7.1 with potassium carbonate or glacial acetic acid and the total quantity is made 1 liter by adding water.

TABLE 16

| | Sample No. | Compound (solubility product with sliver ion | Inhibitor Added amount mol/Ag × mol | Inhibitor Time for addition | Inorganic sulfur Added amount mg/Ag × mol | Inorganic sulfur Time for addition | Sensitometry Sensitivity | Sensitometry δ | Sensitometry Fog |
|---|---|---|---|---|---|---|---|---|---|
| Comparative | XI-1 | — | — | — | — | — | 100 | 3.62 | 0.36 |
| Inventive | XI-2 | S-16 | $2 \times 10^{-4}$ | Pr-2 | 0.05 | Pr-2 | 93 | 3.31 | 0.12 |
| | | ($3 \times 10^{-11}$) | $4 \times 10^{-4}$ | Pr-3 | | | | | |
| | XI-3 | S-1 | $2 \times 10^{-4}$ | Pr-2 | 0.05 | Pr-2 | 95 | 3.42 | 0.07 |
| | | ($3.2 \times 10^{-12}$) | $4 \times 10^{-4}$ | Pr-3 | | | | | |
| | Xi-4 | S-3 | $2 \times 10^{-4}$ | Pr-2 | 0.05 | Pr-2 | 96 | 3.51 | 0.07 |
| | | ($6.3 \times 10^{-13}$) | $4 \times 10^{-4}$ | Pr-3 | | | | | |
| | XI-5 | S-8 | $2 \times 10^{-4}$ | Pr-2 | 0.05 | Pr-2 | 94 | 3.60 | 0.07 |
| | | ($4 \times 10^{-14}$) | $4 \times 10^{-4}$ | Pr-3 | | | | | |
| | XI-6 | S-11 | $2 \times 10^{-4}$ | Pr-2 | 0.05 | Pr-2 | 99 | 3.78 | 0.06 |
| | | ($3.2 \times 10^{-14}$) | $4 \times 10^{-4}$ | Pr-3 | | | | | |
| | XI-7 | S-12 | $2 \times 10^{-4}$ | Pr-2 | 0.05 | Pr-2 | 98 | 3.90 | 0.05 |
| | | ($1.2 \times 10^{-14}$) | $4 \times 10^{-4}$ | Pr-3 | | | | | |
| | XI-8 | S-28 | $2 \times 10^{-4}$ | Pr-2 | 0.05 | Pr-2 | 96 | 3.96 | 0.05 |
| | | ($7.9 \times 10^{-17}$) | $4 \times 10^{-4}$ | Pr-3 | | | | | |
| | XI-9 | S-32 | $2 \times 10^{-4}$ | Pr-2 | 0.05 | Pr-2 | 97 | 4.03 | 0.05 |
| | | ($7.1 \times 10^{-17}$) | $4 \times 10^{-4}$ | Pr-3 | | | | | |
| | XI-10 | S-34 | $2 \times 10^{-4}$ | Pr-2 | 0.05 | Pr-2 | 98 | 4.00 | 0.05 |
| | | ($2 \times 10^{-17}$) | $4 \times 10^{-4}$ | Pr-3 | | | | | |
| | XI-11 | S-36 | $2 \times 10^{-4}$ | Pr-2 | 0.05 | Pr-2 | 97 | 4.08 | 0.05 |
| | | ($6.3 \times 10^{-17}$) | $4 \times 10^{-4}$ | Pr-3 | | | | | |
| | XI-12 | S-1 | $2 \times 10^{-4}$ | Pr-2 | 0.05 | Pr-2 | 95 | 3.38 | 0.07 |
| | | S-8 | $4 \times 10^{-4}$ | Pr-3 | | | | | |
| | XI-13 | S-12 | $2 \times 10^{-4}$ | Pr-2 | 0.05 | Pr-2 | 98 | 4.11 | 0.05 |
| | | S-34 | $4 \times 10^{-4}$ | Pr-3 | | | | | |
| | XI-14 | S-36 | $2 \times 10^{-4}$ | Pr-2 | 0.05 | Pr-2 | 96 | 4.05 | 0.05 |
| | | S-12 | $4 \times 10^{-4}$ | Pr-3 | | | | | |
| | XI-15 | S-36 | $2 \times 10^{-4}$ | Pr-2 | 0.05 | Pr-2 | 98 | 4.03 | 0.05 |
| | | S-32 | $4 \times 10^{-4}$ | Pr-3 | | | | | |

Table-16 shows that it is preferably to use an inhibitor whose solubility product with silver ion is $1 \times 10^{-12}$ in this invention. It is seen that the use of especially a mercapto compound or purine derivative in combination with an inorganic sulfur brings about an excellent effect in making the gradation contrasty. Additional introduction of a plurality of inhibitors in combination with an inoganic sulfur renders the gradation more contrasty.

EXAMPLE 12

Preparation of silver halide emulsion EMP-9

An aqueous solution of silver nitrate and an aqueous halide solution, an aqueous solution of a mixture of potassium bromide and sodium chloride, were added to an aqueous solution of inactive gelatin by a double-jet method with stirring so as to be mixed well. The temperature was maintained at 60° C., pH at 3.0, and pAg at 7.8 in accordance with the method described in the Japanese Patent Publication Open to Public Inspection No. 45437/1984. Then by desalting and washing by conventional methods, EMP-9 was obtained.

EMP-9 consisted of a monodispersed emulsion of cubic silver chloro-bromide grains containing silver bromide in a proportion of 0.15 mol % and having an average grain size of 0.5 μm.

Next, EMP-9 was made to undergo chemical sensitization by adding sodium thiosulfate. The chemical sensitization was carried out at 60° C., and ended by lowering the temperature after a pripening time adequate for optimal sensitometric results, sensitivity and gradation. The specimen was spectrally sensitized by adding a sensitizing dye RS-7 just before the chemical sensitization was ended.

After the chemical sensitization, a cyan coupler CC-2 in a proportion of 0.4 mole per 1 mole silver halide, which was dissolved in dioctyl phthalate, and sodium dodecylbenzenesulfonate as a coating aid were incorporated into the specimen and a coating of the resultant emulsion was applied to a support of paper, which was coated with a titanium oxide-containing polyethylene, so as to form thereon a coating containing silver in a quantity of 0.35 g/m$^2$ and gelatin in a quantity of 3.0 g/m$^2$. The resulting coating was overlaid with a protective layer consisting of gelatin in a quantity of 4.0 g/m/$^2$.

As shown in Table-17, samples Nos. XII-1 through XII-16 were produced by adding an inhibitor and an inorganic sulfur according to this invention at various points of time during the preparation of the sample.

Each sample thus obtained was subjected to wedge exposure by a sensitometer Model KS-7 followed by development and fixation in accordance with the developing procedure C below. Upon completion of this procedure the specimens were tested by a densitometer Model PDA-65 with respect to sensitometric properties. The results are shown sn Table-17.

In Table-17, γ is the same as in Example 11.

The sensitivity is shown in terms of relative sensitivity with the sensitivity of sample XII-1 as 100.

[Evaluation of desilverization property]

The samples processed in accordance with the following processing procedure below were examined with a fluorescent X-ray spectroscopic analyser (product of Nihon Electron Co.) to determine whether residual silver existed or not.

| | Temperature | Time |
|---|---|---|
| [Processing procedure] | | |
| Color development | 30 ± 0.3° C. | 90 sec. |
| Bleach-fixing | 30 ± 0.5° C. | 45 sec. |
| Stabilizing process | 30–34° C. | 90 sec. |
| Drying | 60–80° C. | 60 sec. |
| [Color developing solution] | | |
| Pure water | | 800 ml |
| Triethanolamine | | 10 g |
| N,N-diethylhydroxylamine | | 10 g |
| Potassium chloride | | 2 g |
| Potassium sulfite | | 0.3 g |
| 1-hydroxyethylidene-1,1-diphosphonic acid | | 1.0 g |
| Ethylenediaminetetraacetic acid | | 1.0 g |
| Disodium catechol-3,5-disulfonate | | 1.0 g |
| N-ethyl-N-β-methanesulfonamide ethyl-3-methyl-4-aminoaniline sulfate | | 4.5 g |
| Fluorescent bleaching agent (4,4'-diaminostilbenesulfonic acid derivative) | | 1.0 g |
| The total quantity is made 1 liter by addition of water and pH is adjusted to 10.10. | | |
| [Bleach-fixing solution] | | |
| Ferric di-ammonium ethylenediaminetetraacetate dihydrate | | 60 g |
| Ethylenediaminetetraacetic acid | | 3 g |
| Ammonium thiosulfate (70% solution) | | 100 ml |
| Ammonium sulfite (40% solution) | | 27.5 ml |

pH is adjusted to 6.2 with potassium carbonate or glacial acetic acid and the total quantity is made 1 liter by adding water.

| [Stabilizing solution] | |
|---|---|
| 5-chloro-2-methyl-4-isothiazoline-3-one | 1.0 g |
| Ethylene glycol | 1.0 g |
| 1-hydroxyethylidene-1,1-diphosphonic acid | 2.0 g |
| Ethylenediaminetetraacetic acid | 1.0 g |
| Ammonium hydroxide (20% solution) | 3.0 g |
| Ammonium sulfite | 3.0 g |
| Fluorescent bleaching agent (4,4'-diaminostilbenesulfonic acid derivative) | 1.5 g |

The quantity is made 1 liter by adding water and pH is adjusted to 7.0 with sulfuric acid or potassium hydroxide.

TABLE 17

| | Sample No. | Compound | Inhibitor: Added amount mol/Ag × mol | Inhibitor: Time for addition*1 | Inorganic sulfur: Added amount mol/Ag × mol | Inorganic sulfur: Time for addition*1 | Sensitometry: Sensitivity | Sensitometry: σ | Sensitometry: Fog | Desilverization*2 |
|---|---|---|---|---|---|---|---|---|---|---|
| Comparative | XII-1 | — | — | — | — | — | 100 | 3.35 | 0.41 | G |
| | XII-2 | S-39 | $1 \times 10^{-4}$<br>$2 \times 10^{-4}$ | Pr-2 | — | — | 99 | 3.30 | 0.40 | G |
| | XII-3 | S-39 | $5 \times 10^{-4}$<br>$10 \times 10^{-4}$ | Pr-2<br>Pr-3 | — | — | 84 | 2.81 | 0.41 | G |
| | XII-4 | S-39 | $2.5 \times 10^{-3}$<br>$5 \times 10^{-3}$ | Pr-2<br>Pr-3 | — | — | 60 | 1.98 | 0.05 | NG |
| Inventive | XII-5 | S-39 | $1 \times 10^{-4}$<br>$2 \times 10^{-4}$ | Pr-2<br>Pr-3 | 0.075 mg | Pr-2 | 98 | 3.60 | 0.06 | G |
| | XII-6 | S-39 | $2 \times 10^{-4}$<br>$6 \times 10^{-4}$ | Pr-2<br>Pr-3 | 0.075 mg | Pr-2 | 97 | 3.48 | 0.04 | G |

TABLE 17-continued

| Sample No. | Compound | Inhibitor Added amount mol/Ag × mol | Inhibitor Time for addition*1 | Inorganic sulfur Added amount mol/Ag × mol | Inorganic sulfur Time for addition*1 | Sensitometry Sensitivity | Sensitometry σ | Sensitometry Fog | Desilverization*2 |
|---|---|---|---|---|---|---|---|---|---|
| XII-7 | S-37 | $6 \times 10^{-4}$ | Pr-2 Pr-3 | 0.075 mg | Pr-2 | 99 | 3.53 | 0.04 | G |
| XII-8 | S-45 | $6 \times 10^{-4}$ | Pr-2 Pr-3 | 0.075 mg | Pr-2 | 98 | 3.47 | 0.04 | G |
| XII-9 | S-48 | $6 \times 10^{-4}$ | Pr-2 Pr-3 | 0.075 mg | Pr-2 | 98 | 3.42 | 0.04 | G |
| XII-10 | S-49 | $6 \times 10^{-4}$ | Pr-2 Pr-3 | 0.075 mg | Pr-2 | 97 | 3.49 | 0.04 | G |
| XII-11 | S-54 | $6 \times 10^{-4}$ | Pr-2 Pr-3 | 0.075 mg | Pr-2 | 99 | 3.50 | 0.04 | G |
| XII-12 | S-77 | $6 \times 10^{-4}$ | Pr-2 Pr-3 | 0.075 mg | Pr-2 | 96 | 3.38 | 0.06 | G |
| XII-13 | S-80 | $6 \times 10^{-4}$ | Pr-2 Pr-3 | 0.075 mg | Pr-2 | 97 | 3.40 | 0.05 | G |
| XII-14 | S-82 | $6 \times 10^{-4}$ | Pr-2 Pr-3 | 0.075 mg | Pr-2 | 95 | 3.41 | 0.05 | G |
| XII-15 | S-84 | $6 \times 10^{-4}$ | Pr-2 Pr-3 | 0.075 mg | Pr-2 | 99 | 3.50 | 0.04 | G |
| XII-16 | S-98 | $6 \times 10^{-4}$ | Pr-2 Pr-3 | 0.075 mg | Pr-2 | 98 | 3.48 | 0.04 | G |

*1The same conditions as in Example 1 applied to the time for addition.
*2Desilverization property
G: No residual silver
NG: Residual silver exists.

As is clear from Table-17, where a high silver chloride emulsion used is excellent in rapid processing property, the use of an inhibitor alone for inhibiting fogging not only degrades the sensitometric properties (γ markedly degrades) but also impairs the desilverization property and rapid processing becomes impracticable as a result. Contrarily, the use of an inhibitor in combination with an inorganic sulfur makes it possible to obtain satisfactory sensitometric results especially when a high chloride silver emulsion is used and at the same time enables accomplishing a good rapid processing efficiency.

EXAMPLE 13

A multilayer silver halide photographic sensitive material was obtained by forming seven layers one over another on a paper coated with a polyethylene resin as follows. The quantities of the additives are shown per $m^2$ unless otherwise specified.

First layer comprised of 1.2 g gelatin, 0.35 g of (converted value representing equivalent metal silver; the same hereinafter applies) blue-sensitive silver chlorobromide emulsion, average grain size 0.8 μm; silver bromide content 0.3 mol %, and dioctyl phthalate (hereinafter abbreviated as "DOP") in which 0.9 g yellow coupler YC-1 and 0.015 g 2,5-di-t-octylhydroquinone (hereinafter referred to as "HQ-1") were dissolved;

Second layer comparised of 0.7 g gelatin and DOP in which 0.06 g HQ-1 was dissolved.

Third layer comparised of 1.25 g gelatin, 0.35 g green-sensitive silver chloro bromide emulsion, average grain size 0.5 μm, silver bromide content 0.1 mol %, and DOP in which 0.53 g magenta coupler MC-2 and 0.015 g HQ-1 were dissolved.

Fourth layer comprised of 1.3 g gelatin and DOP in which 0.08 g HQ-1 and 0.5 g ultlraviolet ray-absorbent (UV-1) were dissolved.

Fifth layer comprised of 1.4 g gelatin, 0.3 g red-sensitive silver chlorobromide emulsion, average grain size 0.5 μm, silver bromide content 0.1 mol %, and DOP in which 0.5 g cyan coupler CC-3 and 0.02 g HQ-1 were dissolved;

Sixth layer comprised of 1.0 g gelatin and DOP in which 0.032 g HQ-1 and 0.2 g UV-1 were dissolved;

Seventh layer comprised of 0.5 g gelatin.

A hardener MD-1 was also added in a quantity of 10 mg per gram gelatin.

Samples XIII-1 through XIII-4 of a multilayer silver halide photographic sensitive material were thus obtained by adding an inhibitor and an inorganic sulfur applicable according to this invention at various points of time (as shown in Table-8) during the preparation of the silver halide emulsions contained in the first, third, and fifth layers and during the preparation of the coating solutions of the silver halide emulsions.

YC-1

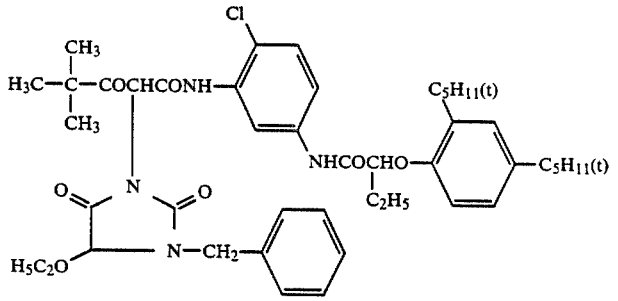

-continued

MC-2

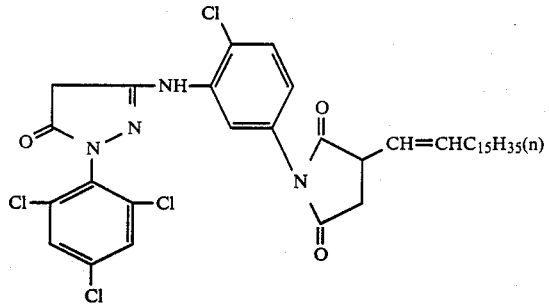

CC-3

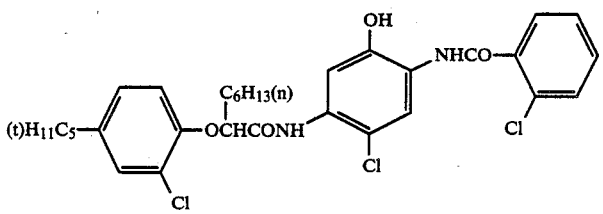

MD-1

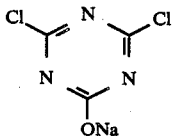

RS-7

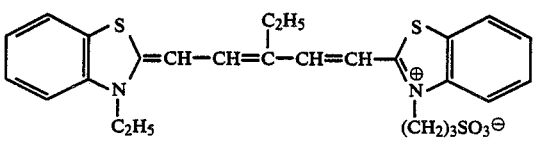

Table-18 shows the results obtained by evaluating the specimens thus obtained by exposure and treatment according to the methods in Example 12.

Table-18 shows that the application of the present invention to multilayered silver halide photographic sensitive materials was also successful in rendering the

TABLE 18

| | Sample No. | Layer No. | Compound | Inhibitor: Added amount mol/Ag × mol | Inhibitor: Time for addition | Inorganic sulfur: Added amount mol/Ag × mol | Inorganic sulfur: Time for addition | Sensitometry: Sensitivity | Sensitometry: σ | Sensitometry: Fog | Desilverization |
|---|---|---|---|---|---|---|---|---|---|---|---|
| Comparative | XIII-1 | 1B | S-42 | $1 \times 10^{-4}$ | Pr-2 | | | 100 | 2.96 | 0.24 | |
| | | | S-42 | $5 \times 10^{-4}$ | Pr-3 | | | | | | |
| | | 3G | S-42 | $2 \times 10^{-4}$ | Pr-2 | | | 100 | 3.10 | 0.41 | G |
| | | | S-42 | $8 \times 10^{-4}$ | Pr-3 | | | | | | |
| | | 5R | S-42 | $2 \times 10^{-4}$ | Pr-2 | | | 100 | 3.21 | 0.36 | |
| | | | S-42 | $8 \times 10^{-4}$ | Pr-3 | | | | | | |
| | | 1B | S-42 | $5 \times 10^{-4}$ | Pr-2 | | | 58 | 1.75 | 0.04 | |
| | | | S-42 | $25 \times 10^{-4}$ | Pr-3 | | | | | | |
| | XIII-2 | 3G | S-42 | $1 \times 10^{-4}$ | Pr-2 | | | 70 | 2.10 | 0.05 | NG |
| | | | S-42 | $4 \times 10^{-4}$ | Pr-3 | | | | | | |
| | | 5R | S-42 | $1 \times 10^{-4}$ | Pr-2 | | | 64 | 2.11 | 0.05 | |
| | | | S-42 | $4 \times 10^{-4}$ | Pr-3 | | | | | | |
| Inventive | XIII-3 | 1B | S-42 | $1 \times 10^{-4}$ | Pr-2 | 0.03 mg | Pr-2 | 97 | 3.08 | 0.04 | |
| | | | S-42 | $5 \times 10^{-4}$ | Pr-3 | | | | | | |
| | | 3G | S-42 | $2 \times 10^{-4}$ | Pr-2 | 0.06 mg | Pr-2 | 98 | 3.32 | 0.04 | G |
| | | | S-42 | $8 \times 10^{-4}$ | Pr-3 | | | | | | |
| | | 5R | S-42 | $2 \times 10^{-4}$ | Pr-2 | 0.06 mg | Pr-2 | 99 | 3.35 | 0.04 | |
| | | | S-42 | $8 \times 10^{-4}$ | Pr-3 | | | | | | |
| | XIII-4 | 1B | S-12 | $1 \times 10^{-4}$ | Pr-2 | 0.04 mg | Pr-2 | 100 | 3.60 | 0.04 | |
| | | | S-12 | $4 \times 10^{-4}$ | Pr-3 | | | | | | |
| | | | S-42 | $2 \times 10^{-4}$ | Pr-4 | | | | | | |
| | | 3G | S-12 | $2 \times 10^{-4}$ | Pr-2 | 0.05 mg | Pr-2 | 99 | | 0.04 | G |
| | | | S-12 | $5 \times 10^{-4}$ | Pr-3 | | | | | | |
| | | | S-42 | $3 \times 10^{-4}$ | Pr-4 | | | | | | |
| | | 5R | S-12 | $2 \times 10^{-4}$ | Pr-2 | 0.05 mg | Pr-2 | 99 | 3.53 | 0.04 | |
| | | | S-12 | $5 \times 10^{-4}$ | Pr-3 | | | | | | |
| | | | S-42 | $3 \times 10^{-4}$ | Pr-4 | | | | | | |

gradation contrasty and minimizing fogging without impairing the sensitivity of each sensitive layer.

EXAMPLE 14

Using a method described in Japanese Patent O.P.I. Publication No. 48521/1979, an aqueous silver nitrate solution and an aqueous solution containing both potassium bromide and sodium chloride at the rate of $Br^-/Cl^-=50/50$ were mixed in the presence of inactive gelatin, under the conditions of 50° C., pAg of 6.5, and pH of 3.0, in order to prepare a silver chloro-bromide emulsion EMP-10 comprising 50 mol % of silver chloride. Observing this silver halide emulsion with an electron-microscope confirmed that it contained monodispersed cubic grains having mean grain size of 0.40 μm, as converted into spherical grains. Next, using a conventional method, this silver halide emulsion was subjected to flocculation and washing with water, then the pAg was adjusted to 7.5, and the resultant product was further added inactive gelatin, and the mixture was re-dispersed.

The obtained emulsion was separated into several parts, thereby the respective parts were subjected to optimum chemical sensitization at 55° C., using, as sensitizers listed in Table 19, sodium thiosulfate, chloroauric acid, and inorganic sulfur, thereby as a stabilizer, example mercapto compound SB-2 was added at a rate of $10^{-2}$ mol/molAg, thus the respective parts of ripened emulsion 91 to 100 were prepared.

In terms of order and timing of addition, inorganic sulfur was added in independent parts; the first portion of inorganic sulfur was added prior to the initiation of chemical sensitization, then, after the chemical sensitization was initiated, sodium thiosulfate, chloroauric acid, and the second portion of inorganic sulfur were sequentially added, thereby at the completion of the chemical sensitization, the mercapto compound S-36 was added.

TABLE 19

| Emulsion No. | Adding amount of sodium thiosulfate (mol/molAg) | Adding amount of chloroauric acid (mol/molAg) | Adding amount of inorganic sulfur (mol/molAg) Timing of addition A (mol/molAg) | Timing of addition B (mol/molAg) |
|---|---|---|---|---|
| 91 | $3.5 \times 10^{-6}$ | — | — | — |
| 92 | — | $2.7 \times 10^{-6}$ | — | — |
| 93 | " | " | $1.0 \times 10^{-6}$ | — |
| 94 | " | " | $2.0 \times 10^{-6}$ | — |
| 95 | " | " | $3.5 \times 10^{-6}$ | — |
| 96 | " | " | $5.0 \times 10^{-6}$ | — |
| 97 | " | " | — | $2.0 \times 10^{-6}$ |
| 98 | " | " | — | $5.0 \times 10^{-6}$ |
| 99 | " | " | $1.0 \times 10^{-6}$ | $2.0 \times 10^{-6}$ |
| 100 | " | " | $3.5 \times 10^{-6}$ | $1.0 \times 10^{-6}$ |

A: Prior to initiation of chemical sensitization.
B: During chemical sensitization The emulsions prepared were applied and dried based on the following constitution, thus the respective samples were prepared.

| | |
|---|---|
| Protective layer | Gelatin (5.0 g/m²)<br>Hardener MD-1 |
| Emulsion layer | Emulsion as in Table 1 (silver coating weight, 1.0 g/m²)<br>Gelatin (4.0 g/m²) |
| Support | Polyethylene-coated paper |

Next, the prepared coating samples No. 1 through 10 were examined for sensitometric properties in the following manner.

[Sensitometric evaluation]

The respective samples were subjected to white-light exposure through the optical wedge, using a optical sensitometer Model KS-7, thereby the samples were treated in the following processes.

| | Temperature | Time |
|---|---|---|
| [Processing procedure] | | |
| Developing | 20 ± 0.3° C. | 4 min. |
| Stopping | same as above | 1 min. |
| Fixing | same as above | 2 min. |
| Washing | same as above | 2 min. |
| Drying | 60 to 80° C. | 2 min. |
| [Developer solution] | | |
| Methol | 2 g | |
| Sodium sulfite anhydride | 0 g | |
| Hydroquinone | 8 g | |
| Sodium carbonate (monohydrate) | 52.5 g | |
| Potassium bromide | 5 g | |
| Water to | 1 l | |
| [Stop solution] | | |
| 1% sodium acetate | | |
| [Fixing solution] | | |
| Konifix (Konica Corporation) | | |

The samples undergone the above treatment were evaluated for reflective density, using the PDA-65 densitometer.

The sensitivity levels are indicated using the reciprocals of exposure required for attaining the density of 0.8, wherein each sensitivity levels is a relative sensitivity based on that of sample XIV, i.e. 100.

In regards to gradation, the gradient of linear line connecting density data on the sensitometric curve between densities 0.8 and 1.5 is designated the shoulder gradation ($\gamma_A$); the similar gradation, between densities 0.3 to 0.8 is designated the toe gradation ($\gamma_B$). p In regards to fog, the fog level is indicated by a value obtainable by subtracting the density of support alone from the density of post-processing non-exposure area.

Table 20 lists the results obtained.

TABLE 20

| | Sample No | Emulsion No. | Relative sensitivity | γA | γB | Fog |
|---|---|---|---|---|---|---|
| Comparative | XIV-1 | 91 | 100 | 3.04 | 2.25 | 0.07 |
| | XIV-2 | 92 | 245 | 2.12 | 1.55 | 0.24 |
| Invention | XIV-3 | 93 | 241 | 2.78 | 1.90 | 0.12 |
| | XIV-4 | 94 | 237 | 2.86 | 2.01 | 0.09 |

TABLE 20-continued

| Sample No | Emulsion No. | Relative sensitivity | γA | γB | Fog |
|---|---|---|---|---|---|
| XIV-5 | 95 | 220 | 2.93 | 2.13 | 0.07 |
| XIV-6 | 96 | 217 | 3.09 | 2.21 | 0.05 |
| XIV-7 | 97 | 240 | 2.81 | 2.00 | 0.13 |
| XIV-8 | 98 | 220 | 3.00 | 2.15 | 0.06 |
| XIV-9 | 99 | 219 | 3.08 | 2.26 | 0.07 |
| XIV-10 | 100 | 210 | 3.21 | 2.29 | 0.05 |

The results in Table 20 shows that compared to comparative sample XIV-1 that was sensitized solely with sodium thiosulfate, comparative sample XIV-2 that incorporated chloroauric acid in addition to sodium thiosulfate is highly sensitive, though having much lower contrast, and larger fog; sample XIV-3, 4, 5, and 6, into which organic sulfur was respectively added prior to the initiation of chemical sensitization, exhibited effects of added inorganic sulfur by their high sensitivity, higher contrast, and low fog. Additionally, sample XIV-7, and 8, to which inorganic sulfur was added during chemical sensitization, also exhibited the similar effects; sample XIV-9, and 10, to which inorganic sulfur was added twice, both before the initiation and in the course of chemical sensitization, exhibited extremely excellent properties.

EXAMPLE 15

A silver chloro-bromide emulsion comprising 70 mol % of silver chloride content was prepared in a manner identical with that of Example 14. This emulsion contained monodispersed cubic grains of mean grain size of 0.35 μm.

In order to perform chemical sensitization, to the relevant emulsion prepared was added, as listed in Table 21, each of sodium thiosulfate, chloroauric acid, inorganic sulfur, and example mercapto compound S-42, thereby at the completion of sensitization was added as a stabilizer, example mercapto compound S-36 at a rate of $1\times10^{-2}$ mol/molAg, thus, the ripen emulsions 101–109 were prepared.

In regards to the order and timing of addition, prior to the initiation of chemical sensitization, the mercapto compound S-42 was added; after the initiation of chemical sensitization, inorganic sulfur, chloroauric acid, and sodium thiosulfate were added; after the completion of chemical sensitization, the mercapto compound S-36 was added.

Next, in a manner identical with example 14, coating samples were prepared and subjected to sensitometric evaluation. Table 22 lists the evaluation results.

TABLE 21

| Emulsion No. | Adding amount of sodium thiosulfate (mol/molAg) | Adding amount of chloroauric acid (mol/molAg) | Adding amount of inorganic sulfur (mg/molAg) | Adding amount of mercapto compound S-42 (mol/molAg) |
|---|---|---|---|---|
| 101 | $4.2\times10^{-6}$ | — | — | — |
| 102 | " | — | — | $2\times10^{-3}$ |
| 103 | " | $3.0\times10^{-6}$ | — | — |
| 104 | " | " | — | $2\times10^{-3}$ |
| 105 | " | " | $2.5\times10^{-6}$ | — |
| 106 | " | " | $4.0\times10^{-6}$ | — |
| 107 | " | " | $6.0\times10^{-6}$ | — |
| 108 | " | " | $4.0\times10^{-6}$ | $2\times10^{-3}$ |
| 109 | " | " | $6.0\times10^{-6}$ | $2.5\times10^{-3}$ |

TABLE 22

| Sample No. | Emulsion No. | Relative sensitivity | γA | γB | Fog |
|---|---|---|---|---|---|
| XV-1 | 101 | 100 | 2.81 | 2.05 | 0.08 |
| XV-2 | 102 | 95 | 2.84 | 2.00 | 0.07 |
| XV-3 | 103 | 280 | 2.03 | 1.49 | 0.22 |
| XV-4 | 104 | 270 | 2.08 | 1.50 | 0.20 |
| XV-5 | 105 | 270 | 2.76 | 1.93 | 0.09 |
| XV-6 | 106 | 259 | 3.01 | 2.06 | 0.07 |
| XV-7 | 107 | 250 | 3.03 | 2.07 | 0.06 |
| XV-8 | 108 | 257 | 3.15 | 2.13 | 0.05 |
| XV-9 | 109 | 249 | 3.20 | 2.15 | 0.04 |

The results in Table 22 shows that when compared to comparative sample XV-1 that was sensitized solely with sodium thiosulfate, comparative sample XV-3 that incorporated chloroauric acid in addition to sodium thiosulfate was highly sensitive, though having much lower contrast, and larger fog. In contrast, sample XV-15, -16, and -17 according to the invention satisfactorily reproduced the results in Example 14, and these samples exhibited satisfactory sensitization, higher contrast, and smaller fog, and showed excellent sensitometric results. Additionally, in regards to the respective emulsions to which amercapto compound was added prior to the initiation of chemical sensitization (101→102, 103→104, and 106→108) to which inorganic sulfur was added, a system that incorporated sodium thiosulfate alone, and a system that incorporated both sodium, thiosulfate and chloroauric acid did not show significant improvement. In contrast, a system that incorporated inorganic sulfur according to the invention attained much harder gradation, and smaller fog, without the cost of decreased sensitivity, whereby the effects of the invention are apparent.

It is apparent from the results of emulsion 108 and 109 according to the invention that addition of mercapto compound is capable of further decreasing fog.

EXAMPLE 16

In a manner identical with Example 14, except for a temperature of40° C., pAg of 7.0, and pH of 3.0, a silver chloro-bromide emulsion EMP-11 comprising not less than 99.9 mol % of silver chloride was prepared. This silver halide emulsion contained monodispersed cubic grains of a mean grain size of 0.42 μm. Next, this emulsion was subjected to precipitation, washing with water, and to the product was further added gelatin, and the emulsion was subjected to redispersion.

The resultant emulsion was separated into several parts. Then, as listed in Table 23, to the relevant emulsion was added, for chemical sensitization, a sensitizer, inorganic sulfur, example mercapto compound S-42, or the following red-spectral sensitizing dye ($1\times10^{-4}$ mol/molAg), thereby at the completion of sensitization, a mixture of example mercapto compounds S-39 and S-36 (total amount, $1\times10^{-2}$ mol/molAg; blending ratio, 1:1) was added as stabilzer to the emulsion. Thus, the ripen emulsions No. 110 to 117 were prepared.

In terms of order and timing of addition, a mercapto compound S-42 was added prior to the initiation of chemical sensitization, then, after the chemical sensitization was initiated, inorganic sulfur, sodium thiosulfate, chloroauric acid, and a red-spectral sensitizing dye RS-8 were sequentially added, thereby at the completion of the chemical sensitization, the mercapto compounds S-39/S-36 were added.

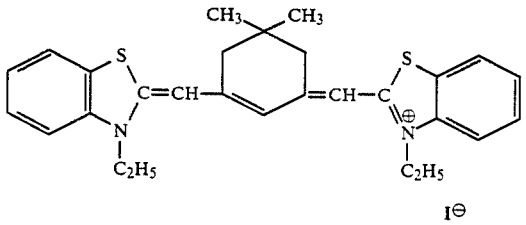

RS-8

TABLE 23

| Emulsion No. | Adding amount of sodium thiosulfate (mol/molAg) | Adding amount of chloroauric acid (mol/molAg) | Adding amount of inorganic sulfur (mg/molAg) | Adding amount of mercapto compound SB-42 (mol/molAg) |
|---|---|---|---|---|
| 110 | $4.0 \times 10^{-6}$ | — | — | — |
| 111 | " | $4.0 \times 10^{-6}$ | — | — |
| 112 | " | " | $3.0 \times 10^{-6}$ | — |
| 113 | " | " | $6.0 \times 10^{-6}$ | — |
| 114 | " | " | $9.0 \times 10^{-6}$ | — |
| 115 | " | " | $3.0 \times 10^{-6}$ | $3.0 \times 10^{-3}$ |
| 116 | " | " | $6.0 \times 10^{-6}$ | $3.0 \times 10^{-3}$ |
| 117 | " | " | $9.0 \times 10^{-6}$ | $3.0 \times 10^{-3}$ |

*After the completion of the ripening, to emulsion No. 28 was added inorganic sulfur, when the emulsion temperature reached 40° C. (i.e. not present in the course of chemical sensitization)

Using the respective prepared emulsions, multi-layer samples having the following layer constitution were prepared.

On a paper support coated with polyethylene resin on both side, and undergone corona discharge treatment, the following eight layers were sequentially formed, thus a silver halide color photographic light-sensitive material was prepared. The coating weights below are, unless otherwise specified, amounts per square meter.

Layer 1 . . . Layer containing 1.0 g of gelatin

Layer 2 . . . Layer containing 1.2 g of gelatin, 0.38 of blue-sensitive silver chlorybromide emulsion (silver chloride content, 99.7 mol %; cubic grains; means grain size, 0.85 μm; sensitized with gold and sulfur sensitizer; containing blue-sepctral sensitizing dye); and 0.44 g of DOP (dioxylphthalate) dissolving 0.88 g of yellow coupler Y-16 and 0.015 g of 2,5-di-t-octyl-hydroquinone (HQ-1)

Layer 3 . . . Layer containing 0.7 g of gelatin

Layer 4 . . . Layer containing 1.25 g of gelatin, 0.32 g of green-sensitive silver chlorybromide emulsion, silver chloride content, 99.5 mol %; cubic grains; mean grain size, 0.38 μm; sensitized with gold and sulfur sensitizer; containing green-sepctral sensitizing dye; and 0.2 g of DOP dissolving 0.53 g of magenta coupler MC-3 and 0.015 g of HQ-1

Layer 5 . . . Layer containing 1.28 g of gelatin, 0.35 g of DBP (dibutylphthalate) dissolving 0.08 g of HQ-1 and 0.5 g of ultraviolet absorbent UV-1

Layer 6 . . . Layer containing 1.4 g of gelatin, 0.25 g of red-sensitive silver chloro-bromide emulsion (the previously mentioned emulsion undergone chemical sensitization; each of emulsion Nos. 110 through 117); and 0.18 g of DOP dissolving 0.05 g of the following example cyan CC-1 and 0.02 g of HQ-1

Layer 7 . . . Layer containing 1.0 g of gelatin, 0.14 g of DBP dissolving 0.032 g of HQ-1 and 0.2 g of ultraviolet absorbent UV-1

Layer 8 . . . Layer containing 0.5 g of gelatin

Additionally, MD-1 as a hardener was added to each of the layers, 1, 3, 5 and 8 at a rate of 0.017 g per gram gelatin.

Magenta coupler

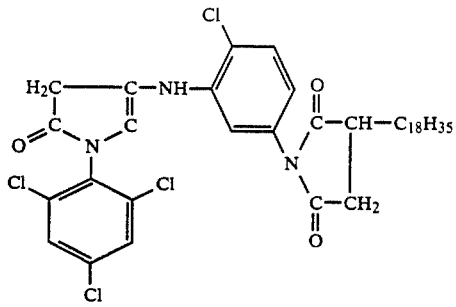

MC-3

The coating samples XVI-1 to XVI-17 were subjected to sensitometry, in compliance with the following method.

Each sample was subjected to white-exposing through an optical wedge using a sensitometer, thereby treated as specified below. Next, the samples treated were evaluated for reflective density using PDA-65 densitometer equipped with a red filter. The indication system of measurement values is same as that of Example 14.

| | Temperature | Time |
|---|---|---|
| [Processing procedure] | | |
| Color developing | 33 ± 0.3° C. | 90 sec. |
| Bleach-fixing | 33 ± 0.3° C. | 90 sec. |
| Stabilizing | 30 to 34.0° C. | 90 sec. |
| Drying | 60 to 80° C. | 60 sec. |
| [Color developing solution] | | |
| Water | 800 ml | |
| Ethylene glycol | 10 ml | |
| N,N-diethylhydroxylamine | 10 g | |
| Potassium chloride | 2 g | |
| N-ethyl-N-β-methanesulfonamidoethyl-3-methyl-aminoaniline sulfate | 5 g | |
| Sodium tetrapolyphosphate | 2 g | |
| Fluorescent whitening agent (4,4'-diaminostylbene disulfonate derivative) | 1 g | |

Water was added to prepared one liter solution which was adjusted to pH of 10.08.

| [Bleach-fixing solution] | |
|---|---|
| Ferric ammonium ethylenediamine tetraacetate dihydrate | 60 g |
| Ethylenediamine tetraacetic acid | 3 g |
| Ammonium thiosulfate (70% solution) | 100 ml |
| Ammonium sulfite (40% solution) | 27.5 ml |

Potassium carbonate or glacial acetic acid was added to adjust the pH level to 7.1, thereby water was added to prepare one liter solution.

| [Stabilizing solution] | |
|---|---|
| 5-chloro-2-methyl-4-isothiazoline-3-one | 1 g |
| 1-hydroxyethylidene-1,1-diphosphonic acid | 2 g |

Water was added to prepare one liter solution, which was adjusted to pH of 7.0 using sulfuric acid or potassium hydroxide.

The resultant sensitometric data are listed in Table 26.

TABLE 24

| Sample No. | Emulsion No. | Relative sensitivity | γA | γB | Fog | |
|---|---|---|---|---|---|---|
| XVI-20 | 110 | 100 | 4.02 | 2.28 | 0.06 | Comparative |
| XVI-21 | 111 | 315 | 2.11 | 1.12 | 0.21 | |
| XVI-22 | 112 | 306 | 3.75 | 1.92 | 0.13 | Inventive |
| XVI-23 | 113 | 298 | 4.00 | 2.15 | 0.07 | |
| XVI-24 | 114 | 290 | 4.13 | 2.29 | 0.05 | |
| XVI-25 | 115 | 299 | 4.01 | 2.08 | 0.10 | |
| XVI-26 | 116 | 291 | 4.25 | 2.34 | 0.05 | |
| XVI-27 | 117 | 284 | 4.33 | 2.42 | 0.04 | |

Like the results in Examples 14 and 15, gradation of a sample sensitized with gold alone was lower contrast, and such a sample indicated greater fog. Results by comparing sample XVI-20 with sample XVI-21

In contrast, sample XVI-22, -23, and 24 according to the invention, indicated higher contrast in proportion to an amount of inorganic sulfur added, thereby fog is significantly suppressed. Furthermore, sample XVI-25, -26, and -27, to which a mercapto compound was also added prior to the initiation of chemical sensitization, indicated excellent sensitometric results as demonstrated by higher contrast, and low fog, while positively exhibiting high sensitivity.

EXAMPLE 17

In a manner identical with Example 14, except for a temperature of 40° C., pAg of 6.8, and pH of 5.8, a silver chloro-bromide emulsion EMP-12 comprising not less than 99.7 mol % of silver chloride was prepared. This silver halide emulsion contained monodispersed cubic grains of a mean grain size of 0.38 μm. Next, this emulsion was subjected to floculation,.washing with water, and to the product was further added gelatin, and the emulsion was subjected to redispersion.

The resultant emulsion was separated into several parts. Then, as listed in Table 25, to the relevant emulsion was added, for chemical sensitization, a sensitizer, inorganic sulfur, example mercapto compound S-42, or the red-spectral sensitizing dye ($1.5\times10^{-4}$ mol/molAg) also used in Example 16, thereby at the completion of sensitization, example mercapto compound S-36 ($1\times10^{-2}$ mol/molAg) was added as a stabilizer to the emulsion. Thus, the ripen emulsions No. 131 to 137 were prepared.

In terms of order and timing of addition, a mercapto compound S-42 was added prior to the initiation of chemical sensitization, then, after the chemical sensitization was initiated, inorganic sulfur, sodium thiosulfate, chloroauric acid, and a red-spectral sensitizing dye were sequentially added, thereby at the completion of the chemical sensitization, the mercapto compound S-36 was added.

Next, in compliance with the layer order specified in Example 16, multilayer samples were prepared and subjected to sensitometric evaluation. Table 26 lists the evaluation results.

TABLE 25

| Emulsion No. | Adding amount of sodium thiosulfate (mol/molAg) | Adding amount of chloroauric acid (mol/molAg) | Adding amount of inorganic sulfur (mg/molAg) | Adding amount of mercapto compound SB-5 (mol/molAg) |
|---|---|---|---|---|
| 131 | $4.2\times10^{-6}$ | — | — | — |

TABLE 25-continued

| Emulsion No. | Adding amount of sodium thiosulfate (mol/molAg) | Adding amount of chloroauric acid (mol/molAg) | Adding amount of inorganic sulfur (mg/molAg) | Adding amount of mercapto compound SB-5 (mol/molAg) |
|---|---|---|---|---|
| 132 | " | $4.0\times10^{-6}$ | — | — |
| 133 | " | " | $6.0\times10^{-6}$ | $2.8\times10^{-3}$ |
| 134 | — | " | $6.0\times10^{-6}$ | " |
| 135 | — | " | $6.0\times10^{-6}$ | " |
| 136 | — | " | $9.0\times10^{-6}$ | " |
| 137 | — | " | $1.2\times10^{-6}$ | " |

TABLE 26

| Sample No. | Emulsion No. | Relative sensitivity | γA | γB | Fog | |
|---|---|---|---|---|---|---|
| XVII-1 | 131 | 100 | 3.95 | 2.17 | 0.07 | Comparative |
| XVII-2 | 132 | 288 | 2.25 | 1.35 | 0.29 | |
| XVII-3 | 133 | 279 | 3.87 | 2.10 | 0.08 | Inventive |
| XVII-4 | 134 | 258 | 3.97 | 2.18 | 00.05 | |
| XVII-5 | 135 | 280 | 4.10 | 2.23 | 0.04 | |
| XVII-6 | 136 | 296 | 4.23 | 2.30 | 0.03 | |
| XVII-7 | 137 | 270 | 3.90 | 2.16 | 0.04 | |

The results in Table 26 shows that when compared to sensitization using sodium thiosulfate alone, combined use of sodium thiosulfate and gold compound results in high sensitivity, in spite of lower contrast, and large fog.

In contrast, sample XVII-3 according to the invention attained significantly higher contrast, and small fog, while maintaining high-sensitivity. Additionally, though not sensitized using sodium thiosulfate, sample XVII-4, -5, -6. and -7, that incorporated both a gold compound and inorganic sulfur exhibited much higher contrast, and smaller fog, and demonstrating excellent effects of the invention.

EXAMPLE 18

According to the method described in Japanese Patent O.P.I. No. 48521/1979, silver chlorobromide emulsion EMP-13 including 50 mol % silver halide was prepared by adding and mixing an aques solution of silver nitrate and an aques solution of potassium bromide, and sodium chloride, at a rate of Br—Cl=50/50, under conditions of 50° C., pAg7.2, and pH3.0, in the presence of inactive gelatin. During forming the silver chlorobromide, silver halide emulsion to which $5\times10^{-6}$ mol $K_2[Ir(IV)Cl_6]$ per mol of said silver halide was added, and emulsion to which nothing was added were prepared. As a result of observing under an electron microscope, this silver halide emulsions were including monodisperse tetradecahedron particles with a average particle size of 0.38 μm, reduced as a shere. Next, each of this silver halide emulsion was flocculated, and washed with water using ordinary methods, and then pAg was conditioned to 7.5 and additional inactive gelatin was added to re-disperse.

After dividing the emulsion obtained, and optimal chemical sensitization was carried out using sodium thiosulfate as a sensitizer and inorganic sulfur (commercially available, 99.999% pure) shown in Table 27 at 60° C.

As a stabilizer, 4-hydroxy-6-methyl-(1, 3, 3a, 7)-tetraseinden (abbreviated as TAI) and an examplified mercapto compound S-36 was added by $1\times10^{-2}$ mol/AgX mol to prepare ripend emulsion 141–154.

Furthermore, the chemical sensitization was carried out by adding sodium thiosulfate to start the sensitization, adding inorganic sulfur during the chemical sensitization, and adding TAI or S-36 when the chemical sensitization stopped.

TABLE 27

| Emulsion No. | $K_2[Ir(IV)Cl_6]$ | Sodium thiosulfate adding amount (mol/Agxmol) | Inorganic sulfur adding amount (mg/Agxmol) | Stabilizer |
|---|---|---|---|---|
| 141 | None | $3.5\times 10^{-6}$ | — | TAI |
| 142 | " | " | $1.0\times 10^{-6}$ | " |
| 143 | " | " | $2.0\times 10^{31\ 6}$ | " |
| 144 | " | " | $3.0\times 10^{-6}$ | " |
| 145 | " | " | $4.0\times 10^{-6}$ | " |
| 146 | " | " | $3.0\times 10^{-6}$ | S-36 |
| 147 | " | " | $4.0\times 10^{-6}$ | " |
| 148 | Added | " | — | TAI |
| 149 | " | " | $1.0\times 10^{-6}$ | " |
| 150 | " | " | $2.0\times 10^{-6}$ | " |
| 151 | " | " | $3.0\times 10^{-6}$ | " |
| 152 | " | " | $4.0\times 10^{-6}$ | " |
| 153 | " | " | $3.0\times 10^{-6}$ | S-36 |
| 154 | " | " | $4.0\times 10^{-6}$ | " |

The emulsion obtained was applied according to the construction shown below to make samples.

| | |
|---|---|
| Protective layer | Gelatin (5.0 g/m²)<br>Hardener MD-1 |
| Emulsion layer | Emulsion obtained in Table 27 (Silver amount 1.0 g/m²)<br>Gelatin amount (4.0 g/m²) |
| Support | Polyethylene-coated paper |

Next, the obtained samples XVIII-1 to XVIII-14 was tested for sensitometry and reciprocity failure characteristics. The test was performed by adjusting the exposure intensity so as to give a constant exposure at 0.2 senconds, standard exposure; and 16 seconds, low intensity exposure; performing light exposure, and then processing and drying were carried out according to the procedure shown below. After that, sensitometry was measured using densitometer PDA-65 to obtain relative sensitivity (S) and gradation ($\gamma$) during the 0.2 seconds exposure and 16 seconds exposure respectively and then the rate of sensitivity variation S* ($S_{16''}/S_{0.2''}\times 100$)% and the rate of gradation variation $\gamma$* ($\gamma_{16''}/\gamma_{0.2''}\times 100$) was obtained. These results are shown in Table-2. S* and $\gamma$* show reciprocity characteristics: S* shows the rate of sensitivity variation of the low intensity exposure (16 seconds) to the standard exposure (0.2 seconds); and $\gamma$* shows the rate of gradation variation of the low intensity exposure (16 seconds) to the standard exposure (0.2 seconds). The more these values near 100%, the lower the variations are.

Furthermore, developing conditions for the test were as follows:

| | Temperature | Time |
|---|---|---|
| [Processing procedure] | | |
| Developing | 20 ± 0.3° C. | 4 min. |
| Stopping | same as above | 1 min. |
| Fixing | same as above | 2 min. |
| Water washing | same as above | 2 min. |
| Drying | 60 to 80° C. | 2 min. |
| [Developer solution] | | |
| Methol | | 2 g |
| Sodium sulfite anhydride | | 90 g |
| Hydroquinone | | 8 g |
| Sodium carbonate (salt with one hydroxyl group) | | 52.5 g |
| Potassium bromide | | 5 g |

-continued

| | Temperature | Time |
|---|---|---|
| Solution with water added | | 1 l |
| [Stop solution] | | |
| sodium acetate 1% solution | | |
| [Fixing solution] | | |
| Konifix (made by Konica Corp.) | | |

TABLE 28

| Sample No. | Emulsion No. | Present invention (stan- S0.2" | (Low S16" | S*% | γ0.2" | γ16" | γ*% |
|---|---|---|---|---|---|---|---|
| XVIII-1 | 141 | 100 | 44 | 44 | 2.8 | 3.1 | 111 |
| XVIII-2 | 142 | 98 | 45 | 46 | 2.9 | 3.0 | 103 |
| XVIII-3 | 143 | 99 | 46 | 46 | 2.8 | 3.0 | 107 |
| XVIII-4 | 144 | 97 | 48 | 49 | 2.9 | 3.3 | 113 |
| XVIII-5 | 145 | 95 | 50 | 53 | 3.0 | 3.3 | 110 |
| XVIII-6 | 146 | 101 | 53 | 53 | 3.1 | 3.5 | 113 |
| XVIII-7 | 147 | 105 | 57 | 54 | 3.2 | 3.7 | 112 |
| XVIII-8 | 148 | 95 | 61 | 64 | 3.1 | 3.7 | 119 |
| XVIII-9 | 149 | 93 | 70 | 75 | 3.2 | 3.3 | 103 |
| XVIII-10 | 150 | 95 | 75 | 80 | 3.4 | 3.4 | 100 |
| XVIII-11 | 151 | 94 | 77 | 82 | 3.3 | 3.4 | 103 |
| XVIII-12 | 152 | 96 | 79 | 82 | 3.3 | 3.4 | 103 |
| XVIII-13 | 153 | 102 | 89 | 87 | 3.5 | 3.5 | 100 |
| XVIII-14 | 154 | 101 | 91 | 90 | 3.4 | 3.4 | 100 |

According to Table 28, adding inorganic sulfur during the chemical sensitization to the emulsion to which $K_2[Ir(IV)Cl_6]$ was not added does not improve reciprocity characteristics because sensitivity variation (S*) and gradation variation ($\gamma$*) are large.

On the other hand, in case of the emulsion to which $K_2[Ir(IV)Cl_6]$ was added, a emulsion No. 148 not including inorganic sulfur has large variations of S* and $\gamma$*, which enables a small effect of improvement, but it is obvious that emulsions No. 149 through 154 containing iridium greatly reduce the variation, largely improving reciprocity failure characteristics. Furthermore, it was revealed that emulsions No. 153, 154 using exemplified mercapto compounds increase the effect of the invention.

EXAMPLE 19

The silver halide emulsion was tested under the same conditions except the $K_3[Ir(III)Cl_6]$ was used instead of $K_2[Ir(IV)Cl_6]$ used in Example 18. The results were entirely the same as the results of Example 18 and revealed that the emulsion containing the iridium compound and inorganic sulfur is remarkably improved in reciprocity failure.

EXAMPLE 20

Using the same method as in Example 18, silver chlorobromide emulsion EMP-14 whose silver halide content was 99.5 mol % was prepared. This emulsion was including monodisperse cubic grains with an average diameter of 0.35 μm. For this emulsion, as shown in Table 29. $K_3[Ir(III)Cl_6]$ was added to the emulsion changing its amount. Next, flocculation and water washing was carried out, and additional gelatin was added and redispersed.

After dividing the emulsion obtained, a chemical sensitization was carried out with $4.0\times 10^{-6}$ mol/Ag×mol of sodium thiosulfate $3.0\times 10^{-6}$ mol/Ag×mol chloroauric acid, inorganic sulfur shown in Table 29, $3.0\times 10^{-3}$ mol/Ag×mol of exemplified mercapto compound S-42, and below-mentioned red sensitive sensitizing dye. The exemplified mercapto compound S-36 of $1\times10^{-2}$ mol/AgX mol was added as a stabilizer when the digestion stopped.

Furthermore, S-42, inorganic sulfur, and chloroauric acid were added in order before starting the chemical sensitization, and then sodium thiosulfate was added to start the chemical sensitization. During the chemical sensitization, the red sensitive sensitizing dye RS-8 was added. S-36 was added when the chemical sensitization stopped.

The chemical sensitized emulsion obtained was applied according to the construction as shown below to form following multi-layer samples.

The following eight layers are applied in order on a paper support coated with polyethylene resin on both side and treated with corona discharge to prepare a silver halide color photo sensitive material XIX-1 to XIX-13. The amount of compositions shown below is the amount per $m^2$ unless otherwise especially stated.

Layer 1 . . . Layer including 1.0 g of gelatin

Layer 2 . . . Layer including 1.2 g of gelatin, 0.38 g. (equivalent to the amount of the silver, hereafter in the same way) blue sensitive silver chlobromide emulsion silver chloride content, 99.7 mol %; cubic; average particle diameter, 0.85 μm; sensitized with gold and sulfur; and including bue sensitive sensitizing dye, and 0.44 g of DOP (dioctyl phthalate) dissolving 0.88 g, of yellow coupler Y-16 and 0.015 g of 2.5-di-t-octyl hydroquinone HQ-1

Layer 3 . . . Layer including 0.7 g of gelatin

Layer 4 . . . Layer including 1.25 g of gelatin, 0.32 g of green-sensitive silver chlorybromide emulsion, silver chloride content, 99.5 mol %; cubic; average particle diameter, 0.38 μm; sensitized with gold and sulfur; and including green-sensitive sensitizing dye, and 0.2 g of DOP (dioctyl phthalate) dissolving a 0.53 g of magenta coupler MC-3 and 0.015 g of HQ-1

Layer 5 . . . Layer including 1.28 g of gelatin, 0.35 g of DBP (dibutylphthalate) dissolving 0.08 g of HQ-1 and 0.5 g of ultraviolet rays absorbent UV-1

Layer 6 . . . Layer including 1.4 g of gelatin, 0.25 g of red-sensitive silver chlorobromide emulsion, and 0.18 g of DOP which solved a 0.50 g of the below-exemplified cyan couple CC-1 and 0.02 g of HQ-1

Layer 7 . . . Layer including 1.0 g of gelatin, 0.14 g of DBP which solved 0.032 g of HQ-1 and 0.2 g of ultraviolet absorbent UV-1

Layer 8 . . . Layer including 0.5 g of gelatin

As an hardening agent, H-1 was added to layers 1, 3, 5, and 8 by 0.017 g. per gram of gelatin.

Using samples to be applied, a sensitometry evaluation was performed by the method shown below.

[Sensitometry and reciprocity evaluation]

Using an actinometer model KS-7, an exposure with white light was performed for each sample through an optical wedge in the same way as Example 18, and processing shown below was carried out. Next, reflection density of the sample was measured for samples processed with a PDA-65 densitometer through a red filter. The treatment of measured value was the same as in Example 18.

| | Temperature | Time |
|---|---|---|
| [Processing procedure] | | |
| Color developing | 33 ± 0.3° C. | 90 sec. |
| Bleach-fixing | 33 ± 0.3° C. | 90 sec. |
| Stabilizing | 30 to 34.0° C. | 90 sec. |
| Drying | 60 to 80° C. | 60 sec. |
| [Color developing solution] | | |
| Water | | 800 ml |
| Ethylene glycol | | 10 ml |
| N,N-diethylhydroxylamine | | 10 g |
| Potassium chloride | | 2 g |
| N-ethyl-N-β-methanesulfonamidoethyl-3-methyl-aminoaniline sulfate | | 5 g |
| Sodium tetrapolyphosphate | | 2 g |
| Potassium carbonate | | 2 g |
| Optical whitening agent, 4, 4'-diamino stilbene disulfonic acid derivative | | 1 g |

Add water to make total amount to be 1 l. Adjust pH to 10.08.

| [Bleach-fixing solution] | |
|---|---|
| Ferric ammonium ethylenediamine-tetraacetate dihydrate | 60 g |
| Ethylenediamine-tetraacetic acid | 3 g |
| Ammonium thiosulfate (70% solution) | 100 ml |
| Ammonium sulfite (40% solution) | 27.5 ml |

The pH of the solution is adjusted to 7.1 with potassium carbonate or glacial acetic acid. Water is added to total amount of 1 l.

| [Stabilizing solution] | |
|---|---|
| 5-chloro-2-methyl-4-isothiazoline-3-one | 1 g |
| 1-hydroxyethylidene-1,1-diphosphonic acid | 2 g |

Water was added to total 1l and the pH of the solution was adjusted to 7.0 with sulfuric acid or potassium hydroxide.

The resultant obtained as to sensitometry are shown in Table 29.

TABLE 29

| Sample No. | Added amount of $K_3[Ir(III)Cl_6]$ mol/AgX mol | Added amount of inorganic sulfur mol/AgX mol (Added amount) | Reciprocity characteristics S 0.2" (Standard) | S 16" (Low intensity) | S* % | γ0.2" | γ16" | γ* % |
|---|---|---|---|---|---|---|---|---|
| XIX-1 | — | — | 100 | 45 | 45 | 2.8 | 3.0 | 107 |
| XIX-2 | $2\times10^{-6}$ | — | 97 | 47 | 49 | 2.8 | 3.1 | 111 |
| XIX-3 | $4\times10^{-6}$ | — | 98 | 50 | 51 | 2.9 | 3.2 | 111 |
| XIX-4 | $6\times10^{-6}$ | — | 93 | 55 | 59 | 3.0 | 3.4 | 113 |
| XIX-5 | $8\times10^{-6}$ | — | 87 | 68 | 78 | 3.1 | 3.6 | 116 |
| XIX-6 | $1\times10^{-5}$ | — | 80 | 66 | 83 | 3.1 | 3.8 | 123 |
| XIX-7 | $3\times10^{-5}$ | | 75 | 65 | 87 | 3.2 | 3.9 | 122 |
| XIX-8 | $2\times10^{-6}$ | $3.0\times10^{-6}$ | 97 | 70 | 72 | 2.9 | 2.9 | 100 |
| XIX-9 | $4\times10^{-6}$ | " | 98 | 72 | 74 | 2.9 | 3.0 | 103 |
| XIX-10 | $6\times10^{-6}$ | " | 95 | 76 | 80 | 3.0 | 3.1 | 103 |
| XIX-11 | $8\times10^{-6}$ | " | 92 | 78 | 85 | 3.1 | 3.2 | 100 |
| XIX-12 | $1\times10^{-5}$ | " | 90 | 81 | 90 | 3.1 | 3.2 | 103 |

TABLE 29-continued

| Sample No. | Added amount of $K_3[Ir(III)Cl_6]$ mol/AgX mol | Added amount of inorganic sulfur mol/AgX mol (Added amount) | Reciprocity characteristics S 0.2" (Standard) | S 16" (Low intensity) | S* % | γ0.2" | γ16" | γ* % |
|---|---|---|---|---|---|---|---|---|
| XIX-13 | $3 \times 10^{-5}$ | " | 87 | 81 | 93 | 3.1 | 3.3 | 106 |

Table 29 reveals that adding only $K_3[Ir(III)Cl_6]$, with increasing the amount thereof, into the emulsion containing neither $K_3[Ir(III)Cl_6]$ nor inorganic sulfur reduces sensitivity variations (S*) while increases contrast variations (γ*), which reises problems for practical use.

On the other hand, samples XIX-8-13 according to the invention using both $K_3[Ir(III)Cl_6]$and inorganic sulfur are obviously improved in reciprocity characteristics because adding $K_3[Ir(III)Cl_6]$ by the same amount reduces sensitivity variations and gradation variations comparing to the emulsion which does not include inorganic sulfur.

Moreover, it was revealed that the construction according to the invention enables the range of sensitivity variation in reciprocity failure to be controlled freely without gradiation variation. This is a large merge merit for controlling the color balance of each layer in multilayer color photographic materials.

EXAMPLE 21

Using the same emulsion as used in Example 20, the procedure of chemical sensitization in the chemical sensitization process was varied XXI-1–4 to prepare sensitized emulsions XXI-1–4. An iridium compound was added to the emulsion by $6\times10^{-6}$ mol/Ag×mol.

Procedure A: A procedure in that after adding S-42 and inorganic sulfur in order, sodium thiosulfate is added to start chemical sensitization, the red sensitive sensitizing dye is added during the chemical sensitization, and S-42 is added at the second time when the chemical sensitization is stoped.

Procedure B: A procedure according to the procedure A in that additional inorganic sulfur is added at the second time between the adding times of the red sensitive sensitizing dy and S-42 added at the second time.

Procedure C: A procedure according to the procedure A in that the adding time of inorganic sulfur is between the adding times of the red sensitive sensitizing dye and S-42 added at the second time.

Procedure D: A procedure according to the procedure A in that sodium thiosulfate is not added.

The adding amounts of each additive used were substantially equivalent to the adding amounts shown in Example 20. The adding amount of inorganic sulfur was $3.5\times10^{-6}$ per mol of silver halide.

The chemical sensitization process includes an optimal ripening process.

The emulsion of Procedure A to D are treated in the same methods as described in Example 20 and the reciprocity failure characteristics were examined.

The results are shown in Table 30.

TABLE 30

| Sample No. | Procedures | Reciprocity failure characteristics S0.2" | S16" | S*% | γ0.2" | γ16" | γ*% |
|---|---|---|---|---|---|---|---|
| XXI-1 | A | 95 | 80 | 84 | 3.2 | 3.2 | 100 |
| XXI-2 | B | 92 | 81 | 88 | 3.1 | 3.2 | 103 |
| XXI-3 | C | 96 | 79 | 83 | 3.1 | 3.2 | 103 |

TABLE 30-continued

| Sample No. | Procedures | Reciprocity failure characteristics S0.2" | S16" | S*% | γ0.2" | γ16" | γ*% |
|---|---|---|---|---|---|---|---|
| XXI-4 | D | 100 | 87 | 87 | 3.3 | 3.3 | 100 |

Table 30 reveals that inorganic sulfur is effective when it is added either separately or at a time while carring out a chemical sensitization, as shown in sample XXX-1, -2 and -3. The effect of the invention is not corrupted by the absence of an instable sulfur compounds such as sodium thiosulfate during the chemical sensitization, as shown in sample XXI-4.

EXAMPLE 22

To aqueous gelatin solution being thoroughly agitated were added 1 l of 1 mol/l aqueous silver nitrate, and 1 l of 1 mol/l mixture silver halide solution containing potassium bromide, 0.5 mol %' and sodium chloride, 99.5 mol %, thus, silver chlorobromide EMP-15 comprising grains of 0.4 μm size was prepared. To the obtained emulsion was added, as a sulfur sensitizer, sodium thiosulfate at a rate of $1\times10^{-5}$ mol per mol silver halide, thereby five minutes before the completion of chemical sensitization was added sensitizing dye GS-1 at a rate of $2\times10^{-4}$ mol per mol silver halide. At the completion of chemical ripening, the resultant emulsion was prepared into to parts. To one part of emulsion XXII-1 was added stabilizer S-42 at a rate of $5\times10^{-4}$ mol per mol silver halide, and to the other part XXII-2 were added the same amount of stabilizer S-42, and inorganic sulfur at a rate of 0.1 mg per mol silver halide.

Next, on a polyethylene-coated paper support were formed the following layers, in order to prepare silver halide photographic light-sensitive materials XXII-1 and -2. The coating weights of the respective compounds are values per 1 $m^2$.

Layer 1

Layer comprising 0.45 g of tricresyl phosphate dispersion dissolving 0.85 g of magenta coupler MC-2 and 0.02 g of anti-color-stain agent HQ-1; green-sensitive emulsion (silver, 0.52 g); and 2.5 g gelatin.

Layer 2

Protecting layer containing 2 g of gelatin

A color photographic paper thus produced was exposed by a conventional method, and subjected to the color developing specified later, thereby the density of the resultant magenta dye image was measured with photographic densitometer PDA-65, and the average gradient γ from the density 0.5 to 2.0, and the sensitivity, the reciprocal of exposure that provides density of 1.0, were determined.

The sensitivity is relative sensitivity based on the sensitivity of sample XXII-1 i.e. 100 attained when this sample was developed for 90 seconds at 30.5° C.

TABLE 31

| No. | Inorganic sulfur | Developing Temperature (°C.) | Developing Time (sec.) | Sensitivity | γ | |
|---|---|---|---|---|---|---|
| XXII-1 | None | 30.5 | 90 | 100 | 3.02 | Comparative |
| XXII-1 | None | 35 | 45 | 104 | 2.79 | Inventive |
| XXII-2 | Added | 30.5 | 90 | 103 | 3.10 | |
| XXII-3 | Added | 35 | 45 | 105 | 3.05 | |

The results in Table 31 demonstrate that if the developing temperature and developing time is adjusted so that like exposure can attain density level of approximately 1.0 with the respective samples of which development being completed in 45 seconds, the comparative sample XXII-1 not containing inorganic sulfur showed significantly lower contrast; in contrast the materials according to the invention XXII-2 showed no loss in γ. Accordingly, it is apparent that subjecting a light-sensitive material containing inorganic sulfur to the image forming method of the invention is capable of forming a high quality color image more rapidly.

Next, in a manner identical with the above-mentioned, developing was performed, and minimum density was measured on a sample, except that both a color developer incorporated 0.6 ml of bleach-fixer, and a color developer not incorporating bleach-fixer were used. The results are listed in Table 32.

TABLE 32

| No. | Sulfur | Developing Temperature (°C.) | Developing Time (sec) | Minimum density With bleach-fixer No | Minimum density With bleach-fixer Yes |
|---|---|---|---|---|---|
| XXII-1 | None | 30.5 | 90 | 0.06 | 0.24 |
| XXII-1 | None | 35 | 45 | 0.06 | 0.26 |
| XXII-2 | Added | 30.5 | 90 | 0.06 | 0.16 |
| XXII-2 | Added | 35 | 45 | 0.06 | 0.09 |

As can be understood from Table 32, if no bleach-fixer was mixed, minimum densities remained approximately at a common level; in contrast, minimum densities increased with the incorporation of bleach-fixer. Sample XXII-1 not containing inorganic sulfur exhibited a slightly increased density by 45 seconds processing; in contrast, sample XXII-2, that is a light-sensitive material containing inorganic sulfur exhibited not only smaller minimum density, but only the limited increase in minimum density in 45 seconds processing. These facts mean that forming an image using a light-sensitive material containing inorganic sulfur is appropriate not only in effecting rapid processing, but in providing a color image of further improved image quality by subjecting the similar material to rapid processing.

In addition, to attain a density of 1.0, these samples were uniformly exposed, and developed, and then, evaluated for density using an automatic densitometer having an aperture of 2 $\phi$ in the direction perpendicular to the direction of sample transportation, whereby the difference between the maximum density and the minimum density was measured.

TABLE 33

| No. | Sulfur | Developing Temperature (°C.) | Developing Time (sec.) | Difference in maximum density and minimum density |
|---|---|---|---|---|
| XXII-1 | No addition | 30.5 | 90 | 0.04 |
| XXII-1 | No addition | 35 | 45 | 0.10 |

TABLE 33-continued

| No. | Sulfur | Developing Temperature (°C.) | Developing Time (sec.) | Difference in maximum density and minimum density |
|---|---|---|---|---|
| XXII-2 | Added | 30.5 | 90 | 0.02 |
| XXII-2 | " | 35 | 45 | 0.02 |

As apparent from Table 33, there were shown image irregularities contributable to rapid processing; however, the image forming method using a light-sensitive material containing inorganic sulfur provided high-quality images free from development-induced image-irregularities.

The treatment processes, and the compositions of processing solutions were as follows.

| | Temperature | Time |
|---|---|---|
| [Processing procedure] | | |
| Color developing | 30.5° C. or 35° C. | 90 sec. 45 sec. |
| Bleach-fixing | 35° C. | 45 sec. |
| Washing | 30–35° C. | 90 sec. |
| Drying | 60–68° C. | 60 sec. |

| [Color developing solution] | |
|---|---|
| Water | 800 ml |
| Triethanolamine | 12 ml |
| N,N-diethylhydroxylamine (85% aqueous solution) | 12 ml |
| Potassium chloride | 2.2 g |
| Potassium sulfate | 0.2 g |
| N-ethyl-N-β-methanesulfonamidoethyl-3-methyl-4-aminaniline sulfate | 5.0 g |
| 1-hydroxyethylidene-1,1-diphosphonate | 1 g |
| Ethylenediamine-tetraacetic acid | 2 g |
| Diaminostilbene-type water-soluble fluorescent whitening agent | 2 g |
| Potassium carbonate | 25 g |

Water was added to one liter, thereby the solution was adjusted to pH=10.1.

| [Bleach-fixing solution] | |
|---|---|
| Water | 800 ml |
| Ferric ammonium ethylenediamine-tetraacetate | 65 g |
| Disodium ethylenediamine-tetraacetate | 5 g |
| Ammonium thiosulfate | 85 g |
| Sodium hydrogen sulfate | 10 g |
| Sodium metabisulfate | 2 g |
| Sodium chloride | 10 g |

Water was added to one liter, thereby the solution was adjusted to pH=5.5 with diluted sulphuric acid.

EXAMPLE 23

Silver halide emulsion EMP-15 was prepared in a manner identical with Example 22. The emulsion was divided into six parts. The first part was chemically sensitized in a manner identical with Example 22. Five minutes before the completion of chemical sensitization, sensitizing dye GS-1 was added, thereby the emulsion was divided into two subparts. Then, upon the completion of chemical sensitization, to one part of emulsion was added stabilizer S-42 at a rate of $5\times10^{-4}$ mol and 0.05 mg of inorganic sulfur per mol silver halide; while to the other part of emulsion was add stabilizer S-42 alone.

The second part of emulsion was chemically sensitized in a manner identical with the first emulsion, except in that one minute before the addition of a sulfur sensitizer, inorganic sulfur was added at a rate of 0.05 mg per mol silver halide, thereby upon the completion of chemical sensitization stabilizer S-42 alone was added at a rate of $5\times10^{-4}$ mol per mol silver halide. The third part of emulsion was chemically senisitized in a manner identical with the second emulsion, except in that stabilizer S-42 was added at a rate of $5\times10^{-4}$ mol per mol silver halide at the same time with inorganic sulfur. The fourth through sixth emulsions were prepared in a manner correspondingly identical with the first through third emulsions, except that as sensitizers $5\times10^{-5}$ mol of sodium thiosulfate and $2\times10^{-5}$ mol of chloroauric acid per mol silver halide were added.

Light-sensitive materials XXIII-1 to XXIII-8 were prepared in a manner identical with Example 22, being subjected to exposing and developing. The results are listed in Table 34.

The gradation, the difference between the maximum and minimum density in the uniformely exposed area such as shown in Example 22, and the increase in the fog density due to contamination with bleach-fixer, are indicated based on data obtainable from the processing for 90 seconds at 30.5° C.

TABLE 34

| No. | Addition prior to chemical sensitization: Sulfur | Addition prior to chemical sensitization: Stabilizer S-42 | Addition at completion of chemical sensitization: Sulfur | Gold sensitization | Δγ | ΔD | ΔFog | |
|---|---|---|---|---|---|---|---|---|
| XXIII-1 | No addition | No addition | No addition | No addition | −0.22 | +0.06 | +0.02 | Comparative |
| XXIII-2 | No addition | No addition | Added | No addition | −0.05 | +0.02 | −0.07 | Inventive |
| XXIII-3 | Added | No addition | No addition | No addition | −0.03 | +0.02 | −0.07 | Inventive |
| XXIII-4 | Added | Added | No addition | No addition | −0.02 | +0.02 | −0.06 | Inventive |
| XXIII-5 | No addition | No addition | No addition | Added | −0.25 | +0.07 | +0.03 | Comparative |
| XXIII-6 | No addition | No addition | Added | Added | −0.07 | +0.03 | −0.06 | Inventive |
| XXIII-7 | Added | No addition | No addition | Added | −0.02 | +0.02 | −0.07 | Inventive |
| XXIII-8 | Added | Added | No addition | Added | −0.00 | +0.02 | −0.06 | Inventive |

As apparent from Table 34, regardless of timing where inorganic sulfur was added, sensitive materials free from either image irregularities or change in gradation contributable to rapid processing were obtained. In particular, the similar materials chemically sensitized in the presence of inorganic sulfur and sensitizer exhibited significantly limited γ fluctuation and development-induced irregularities. Furthermore, the similar materials subjected to gold sensitization showed further improved effects of the invention.

EXAMPLE 24

Silver halide photographic light-sensitive materials were prepared in a manner identical with Example 22, except that sensitizing dye GS-1 used in Example 22 was replaced with BS-4, and layer 1 was modified as follows.

Layer 1

Silver halide emulsion layer comprising 0.4 g dinonylphthalate dispersion dissolving 0.70 g of yellow coupler Y-1 or Y-16, 0.15 g of image stabilizer IST-4, 0.15 g of IST-1 and 0.015 g color-stain-inhibitor HQ-1; blue-sensitive silver halide emulsion containing 0.4 g silver; and 4 g of gelatin.

The light-sensitive material thus obtained was processed in a manner identical with Example 22, and evaluated. The results are listed in Table 35.

TABLE 35

| No. | Sulfur | Yellow coupler | γ (45 sec., at 35° C.) | Δγ | ΔD | ΔFog |
|---|---|---|---|---|---|---|
| XXIV-1 | No addition | Y-1 | 2.79 | −0.12 | +0.03 | +0.02 |
| XXIV-2 | Added | Y-1 | 2.81 | −0.02 | +0.01 | −0.06 |
| XXIV-3 | No added | Y-16 | 2.97 | −0.18 | +0.06 | +0.03 |
| XXIV-3 | Added | Y-16 | 2.97 | −0.02 | +0.01 | +0.07 |

*In the table 35 photographic performance data are indicated based on those of 90 sec. processing at 30.5° C.

Next, the prepared samples was irradiated with 80 klux light of a xenon fade-o-meter, in which ultraviolet light being eliminated by a UV cut filter. Twenty days later, the magnitude of fading was measured on the area where a density was 1.2. The results are listed in Table 36.

TABLE 36

| No. | Yellow coupler | Developing: Temperature °C. | Developing: Time sec. | Degree of fading |
|---|---|---|---|---|
| XXIV-2 | Y-1 | 30.5 | 90 | 0.40 |
| XXIV-2 | Y-1 | 35 | 45 | 0.39 |
| XXIV-4 | Y-16 | 30.5 | 90 | 0.39 |
| XXIV-4 | Y-16 | 35 | 45 | 0.33 |

As apparent from Tables 35 and 36, the silver halide light-sensitive materials simultaneously using a blue-sensitive emulsion and a yellow coupler are capable of providing high-quality images less susceptible to lower contrast, and development-induced irregularities contributable to rapid processing. The samples containing a coupler represented by general formula [γ'] exhibited improved light-resistance to rapid processing.

Accordingly, the image forming method of the invention is not only capable of providing an image rapidly, but of providing an image of further improved quality by the similar processing.

EXAMPLE 25

The samples prepared in Example 22 were adjusted so that they might have approximately same sensitivity when treated in a predetermined developing, thereby it was examined how the fog increased by contamination with a bleach-fixer solution depending on the change in developing time. The results are listed in Table 37.

TABLE 37

| Test No. | Developing time (sec.) | Fog Contamination with bleach-fixer No | Yes |
|---|---|---|---|
| 1 | 30 | 0.07 | 0.09 |
| 2 | 45 | 0.06 | 0.09 |
| 3 | 60 | 0.06 | 0.10 |
| 4 | 75 | 0.06 | 0.13 |
| 5 | 90 | 0.06 | 0.16 |

As apparent from Table 4, if there is no contamination with bleach-fixer, the fog is constant regardless of the developing time; in contrast, if there is contamination with bleach-fixer, and if the developing time is less than 60 seconds, there is not change in fog, thereby the effect of the invention is manifest, though, the change in fog is great if the developing time is longer than 60 seconds.

EXAMPLE 26

In a manner identical with Example 1, an emulsion not containing inorganic sulfur was prepared. Using this emulsion, silver halide light-sensitive materials XXVI-1 to XXVI-9 having inorganic sulfur either in layers 1 or 2 were prepared. These materials were evaluated, like Example 22, by subjecting them to developing for 90 seconds at 30.5° C., or for 45 seconds at 35° C., thereby the difference, resulting from the difference of former and latter modes, i.e. differences in $\gamma$, (maximum density—minimum density), and $D_{min}$ were determined.

TABLE 38

| Sample No. | Sulfur coating weight (mg/m²) Layer 2 | Layer 1 | Δγ | (Max. density - min. density) | ΔFog |
|---|---|---|---|---|---|
| XXVI-1 | 0 | 0 | −0.23 | +0.06 | +0.03 |
| XXVI-2 | 0.04 | 0 | −0.20 | +0.04 | 0.00 |
| XXVI-3 | 0.08 | 0 | −0.18 | +0.04 | −0.01 |
| XXVI-4 | 0.15 | 0 | −0.15 | +0.03 | −0.01 |
| XXVI-5 | 0.50 | 0 | −0.10 | +0.03 | −0.03 |
| XXVI-6 | 0 | 0.04 | −0.18 | +0.04 | −0.01 |
| XXVI-7 | 0 | 0.08 | −0.14 | +0.03 | −0.02 |
| XXVI-8 | 0 | 0.15 | −0.11 | +0.03 | −0.03 |
| XXVI-9 | 0 | 0.50 | −0.08 | +0.02 | −0.05 |

As apparent from Table 38, the effects of the present invention were attained when a light-sensitive material was processed, regardless of to which layer inorganic sulfur was added, to emulsion layer or to protective layer.

EXAMPLE 27

Samples XXVII-1 to XXVII-11 were prepared in a manner identical with that of the preceding Examples 22, except that the amount of addition, timing for adding inorganic sulfur, type of stabilizer, and amount of the stabilizer added. The prepared samples were subjected to developing at 30.5° C. for 90 seconds, or to developing at 35° C. for 45 seconds, thereby the difference in resultant characteristic data were evaluated. Table 39 lists the results.

TABLE 39

| Sample No. | Amount added prior to chemical sensitization Sulfur | Stabilizer | Amount added after chemical sensitization Sulfur | Stabilizer | Δγ | Max. density - min. density | ΔFog |
|---|---|---|---|---|---|---|---|
| XXVII-1 | 0 | 0 | 0 | S-42 $5 \times 10^{-4}$ mol | −0.21 | +0.06 | +0.03 |
| XXVII-2 | 0 | S-42 $10^{-4}$ mol | 0 | S-42 $5 \times 10^{-4}$ mol | −0.19 | +0.06 | +0.02 |
| XXVII-3 | 0.05 mg | S-42 $10^{-4}$ | 0 | S-42 $5 \times 10^{-4}$ mol | −0.03 | +0.02 | −0.07 |
| XXVII-4 | 0.1 mg | S-42 $10^{-4}$ mol | 0 | S-42 $5 \times 10^{-4}$ mol | −0.02 | +0.02 | −0.17 |
| XXVII-5 | 0.3 mg | S-42 $10^{-4}$ mol | 0 | S-42 $5 \times 10^{-4}$ mol | −0.03 | +0.02 | −0.08 |
| XXVII-6 | 0.1 mg | S-42 $10^{-4}$ mol | 0.1 mg | S-42 $5 \times 10^{-4}$ mol | −0.02 | +0.02 | −0.07 |
| XXVII-7 | " | S-40 $10^{-4}$ mol | 0 | S-40 $5 \times 10^{-4}$ mol | −0.04 | +0.02 | −0.07 |
| XXVII-8 | " | S-29 $10^{-4}$ mol | 0 | S-29 $5 \times 10^{-4}$ mol | −0.05 | +0.03 | −0.05 |
| XXVII-9 | " | S-42 $2 \times 10^{-4}$ mol | 0 | S-42 $5 \times 10^{-4}$ mol | −0.02 | +0.02 | −0.08 |
| XXVII-10 | " | S-42 $4 \times 10^{-4}$ mol | 0 | S-42 $5 \times 10^{-4}$ mol | −0.02 | +0.02 | −0.09 |
| XXVII-11 | " | 0 | 0 | S-42 $5 \times 10^{-4}$ mol | −0.03 | +0.02 | −0.06 |

EXAMPLE 28

The developing was performed in a manner identical with that of Example 22 both at 30.5° C. for 90 seconds and at 35° C. for 45 seconds, except that sensitizing dye was changed to RS-1, thereby the differences in characteristic values were evaluated. As a result, the effects of the present invention were confirmed with a red-sensitive emulsion too.

EXAMPLE 29

A silver halide emulsion EMP-16 comprising grains of size 0.65 μm was prepared in a manner identical with Example 22, except that mixing aqueous silver nitrate solution and aqueous halide solution was performed for a longer period. The following four kinds in total of blue-sensitive emulsions prepared in the same manner as in Example 24 by making use of this emulsion. Namely, (1) emulsion containing blue-sensitizing dye BS-1 and inorganic sulfur, (2) emulsion containing blue-sensitizing dye BS-1 without inorganic sulfur, (3) emulsion containing blue sensitizing dye BS-4 and inorganic sulfur, (4) emulsion containing blue-sensitizing dye BS-4 without inorganic sulfur.

Next, two kinds of green-sensitive emulsion containing inorganic sulfur and no inorganic sulfur, respectively, and two kind of red-sensitive emulsions containing inorganic sulfur or no inorganic sulfur, respectively, in the same manner as in Example 22 and 28. Then, using these emulsions, silver halide photographic light-sensitive materials (color papers) were prepared in compliance with a conventional method.

These samples were exposed through a color negative, thereby subjected to developing specified in Example 22 (color developing at 35° C. for 45 seconds) using an automatic developing machine. As a result, the sample incorporating an emulsion not having inorganic sulfur provided bluer finished image at 50 cm both in the leading and trailing edges of rolled paper, that is, images of lower contrast were obtained. In contrast, the samples using emulsions incorporated inorganic sulfur provided color prints of high contrast images without deterioration in color balance. When comparing the light-sensitive material using BS-1 as a blue sensitizing dye with that using BS-4, in the former, slight yellow stain was deserved due to the residual sensitizing dye.

Thus, it is desirable to use, in rapid processing, a cyanine compound of which alkyl group as a substituent in the 3 position on thiazole nucleus is a group having at least one carboayl substituent group.

What is claimed is:

1. A silver halide photographic light-sensitive material comprising:

(a) a support; and (b) one or more photographic component layers on the support, the photographic component layers including at least one silver halide emulsion layer chemically sensitized with a gold compound and containing a nitrogen-containing heterocyclic compound having a solubility with silver ion of not more than $1\times10^{-10}$;

wherein at least one of said photographic component layers contains elementary sulfur.

2. The material of claim 1, wherein said elementary sulfur is in said silver halide emulsion layer.

3. The material of claim 1, wherein at least one of the photographic component layers is a non-light sensitive layer containing said elementary sulfur.

4. The material of claim 1, wherein said silver halide emulsion layer contains silver halide grains comprising of not less than 80 mol % of silver chloride.

5. The material of claim 4, wherein said silver halide grains contains not less than 90 mol % of silver chloride.

6. The material of claim 5, wherein said silver halide grains are essentially consisting of silver chloride and silver bromide in which silver bromide content is within the range of from 0 to 5 mol %.

7. The material of claim 2, wherein said elementary sulfur is added into said silver halide emulsion layer after completion of a chemical sensitizing of a silver halide emulsion contained in said silver halide emulsion layer.

8. The material of claim 7, wherein an amount of said elementary sulfur added into silver halide emulsion is within the range of from $1\times10^{-5}$ mg to 10 mg per mol of silver halide.

9. The material of claim 8, wherein an amount of said elementary sulfur is within the range of from $1\times10^{-3}$ mg to 5 mg per mol of silver halide.

10. The material of claim 2, wherein said elementary sulfur is added into said silver halide emulsion layer in the course of a chemical sensitization of a silver halide emulsion contained in said silver halide emulsion layer.

11. The material of claim 10, wherein an amount of said elementary sulfur added is within the range of from $1\times10^{-5}$ mg to 10 mg per mol of silver halide.

12. The material of claim 11, wherein an amount of said elementary sulfur added is within the range of from $1\times10^{-3}$ mg to 5 mg per mol of silver halide.

13. The material of claim 10, wherein said silver halide emulsion is chemically sensitized with a sulfur sensitizer.

14. The material of claim 3, wherein an amount of said sulfur sensitizer is within the range of from $10^{-7}$ mol to $10^{-1}$ mol per mol of silver halide.

15. The material of claim 10, wherein said elementary sulfur is additionally added into said silver halide emulsion at a stopping step of said chemical sensitization of said silver halide emulsion.

16. The material of claim 15, wherein an amount of said additionally added elementary sulfur is within the range of from $1\times10^{-5}$ mg to 10 mg per mol of silver halide.

17. The material of claim 16, wherein an amount of said additionally added elementary sulfur is within the range of from $1\times10^{-3}$ mg to 5 mg per mol of silver halide.

18. The material of claim 15, wherein the total amount of said elementary sulfur added in the course of said chemical sensitization of said silver halide emulsion and additionally added at said stopping step of the chemical sensitization is within the range of from $2\times10^{-5}$ mg to 15 mg per mol of silver halide.

19. The material of claim 18, wherein the total amount of said elementary sulfur is within the range of from $2\times10^{-3}$ mg to 10 mg per mol of silver halide.

20. The material of claim 10, wherein said silver halide emulsion layer further contains an iridium compound.

21. The material of claim 20, wherein an amount of said iridium compound contained in said silver halide emulsion layer is within the range of from $10^{-8}$ mol to $10^{-5}$ mol per mol of silver halide.

22. The material of claim 1, wherein an amount of said gold compound is within the range of from $5\times10^{-7}$ mol to $5\times10^{-3}$ mol per mol of silver halide.

23. The material of claim 22, wherein an amount of said gold compound is within the range of from $2\times10^{-6}$ mol to $1\times10^{-4}$ mol per mol of silver halide.

24. The material of claim 23, wherein an amount of said gold compound is within the range of from $2.6\times10^{-6}$ mol to $4\times10^{-5}$ mol per mol of silver halide.

25. The material of claim 24, wherein an amount of said gold compound is within the range of from $2.6\times10^{-6}$ mol to $9\times10^{-6}$ mol per mol of silver halide.

26. The material of claim 1, wherein said solubility product is not more than $1\times10^{-11}$.

27. The material of claim 1, wherein said nitrogen-containing heterocyclic compound is represented by the following formula S;

$$Z_o\text{—SM} \qquad \text{Formula S}$$

wherein $Z_o$ is a nitrogen containing heterocyclic group and M is a hydrogen atom, an alkali metal atom or ammonium.

28. The material of claim 1, wherein an amount of said nitrogen-containing heterocyclic compound contained in said silver halide emulsion layer is within the range of from $1\times10^{-6}$ mol to $1\times10^{-1}$ mol per mol silver halide.

29. The material of claim 28, wherein an amount of said nitrogen-containing heterocyclic compound is within the range of from $1\times10^{-5}$ mol to $1\times10^{-2}$ mol per mol of silver halide.

30. The material of claim 1, wherein an amount of inorganic sulfur added into said silver halide emulsion layer is within the range of from $10^{-5}$ mg to 10 mg per mol of silver halide.

31. A method for forming an image comprising a step of developing a silver halide photographic material comprising one or more photographic component layers including at least one silver halide emulsion layer containing silver halide grains comprising not less than 80 mol % of silver chloride, at least one of said photographic component layers containing elementary sulfur, with a color developer containing an aromatic primary amine compound for not more than 60 seconds.

32. The method of claim 31, wherein said elementary sulfur is in said silver halide emulsion layer.

33. The method of claim 31, wherein an amount of said elementary sulfur is within the range of from $10^{-5}$ mg to 10 mg per mol of silver halide.

34. The method of claim 33, wherein an amount of said elementary sulfur is within the range of from $10^{-3}$ mg to 5 mg per mol of silver halide.

35. The method of claim 31, wherein said silver halide grains comprise not less than 90 mol % of silver chloride.

36. The method of claim 35, wherein said silver halide grains are essentially consisting of silver chloride and silver bromide and silver bromide content is within the range of from 0 to 5 mol %.

37. A silver halide photographic light-senstive material comprising:

(a) a support; and (b) one or more photographic component layers on the support, the photographic component layers including at least one silver halide emulsion layer containing:

(i) silver halide grains comprising not less than 80 mol % of silver chloride; and (ii) a nitrogen-containing heterocyclic compound having a solubility product with silver ion of not more than $1\times10^{-10}$;

wherein at least one of said photographic component layers contains elementary sulfur.

38. The material of claim 37, wherein said elementary sulfur is in said silver halide emulsion layer.

39. The material of claim 37, wherein at least one of the photographic component layers is a non-light sensitive layer containing said elementary sulfur.

40. The material of claim 37, wherein said silver halide grains contain not less than 90 mol % of silver chloride.

41. The material of claim 40, wherein said silver halide grains consist essentially of silver chloride and silver bromide in which the silver bromide content is within the range of from 0 to 5 mol %.

42. The material of claim 30, wherein said elementary sulfur is added into said silver halide emulsion layer after completion of a chemical sensitizing of a silver halide emulsion contained in said silver halide emulsion layer.

43. The material of claim 42, wherein an amount of said elementary sulfur added into said silver halide emulsion is within the range of from $1\times10^{-5}$ mg to 10 mg per mol of silver halide.

44. The material of claim 43, wherein an amount of said elementary sulfur is within the range of from $1\times10^{-3}$ mg to 5 mg per mol of silver halide.

45. The material of claim 38, wherein said elementary sulfur is added into said silver halide emulsion layer in the course of a chemical sensitization of a silver halide emulsion contained in said silver halide emulsion layer.

46. The material of claim 45, wherein an amount of said elementary sulfur added is within the range of from $1\times10^{-5}$ mg to 10 mg per mol of silver halide.

47. The material of claim 46, wherein an amount of said elementary sulfur added is within the range of from $1\times10^{-3}$ mg to 5 mg per mol of silver halide.

48. The material of claim 45, wherein said silver halide emulsion is chemically sensitized with a sulfur sensitizer.

49. The material of claim 48, wherein an amount of said sulfur sensitizer is within the range of from $10^{-7}$ mol to $10^{-1}$ mol per mol of silver halide.

50. The material of claim 45, wherein said elementary sulfur is additionally added into said silver halide emulsion at a stopping step of said chemical sensitization of said silver halide emulsion.

51. The material of claim 50, wherein an amount of said additionally added elementary sulfur is within the range of from $1\times10^{-5}$ mg to 10 mg per mol of silver halide.

52. The material of claim 51, wherein an amount of said additionally added elementary sulfur is within the range of from $1\times10^{-3}$ mg to 5 mg per mol of silver halide.

53. The material of claim 50, wherein the total amount of said elementary sulfur added in the course of said chemical sensitization of said silver halide emulsion and additionally added at said stopping step of the chemical sensitization is within the range of from $2\times10^{-5}$ mg to 15 mg per mol of silver halide.

54. The material of claim 53, wherein the total amount of said elementary sulfur is within the range of from $2\times10^{-3}$ mg to 10 mg per mol of silver halide.

55. The material of claim 45, wherein said silver halide emulsion layer further contains an iridium compound.

56. The material of claim 55, wherein an amount of said iridium compound contained in said silver halide emulsion layer is within the range of from $10^{-8}$ mol to $10^{-5}$ mol per mol of silver halide.

57. The material of claim 45, wherein said silver halide emulsion is chemically sensitized with a gold compound.

58. The material of claim 57, wherein an amount of said gold compound is within the range of from $5\times10^{-7}$ mol to $5\times10^{-3}$ mol per mol of silver halide.

59. The material of claim 58, wherein an amount of said gold compound is within the range of from $2\times10^{-6}$ mol to $1\times10^{-4}$ mol per mol of silver halide.

60. The material of claim 59, wherein an amount of said gold compound is within the range of from $2.6\times10^{-6}$ mol to $4\times10^{-5}$ mol per mol of silver halide.

61. The material of claim 60, wherein an amount of said gold compound is within the range of from $2.6\times10^{-6}$ mol to $9\times10^{-6}$ mol per mol of silver halide.

62. The material of claim 37, wherein said solubility product is not more than $1\times10^{-11}$.

63. The material of claim 37, wherein said nitrogen-containing heterocyclic compound is represented by the following formula S:

$Z_O$—SM Formula S wherein $Z_O$ *is a nitrogen-containing heterocyclic group and M is a hydrogen atom, and alkali metal atom or ammonium.*

64. The material of claim 37, wherein an amount of said nitrogen-containing heterocyclic compound contained in said silver halide emulsion layer is within the range of from $1\times10^{-6}$ mol to $1\times10^{-1}$ mol per mol silver halide.

65. The material of claim 64, wherein an amount of said nitrogen-containing heterocyclic compound is within the range of from $1\times10^{-5}$ mol to $1\times10^{-2}$ mol per mol of silver halide.

66. The material of claim 38, wherein an amount of inorganic sulfur added into said silver halide emulsion layer is within the range of from $10^{-5}$ mg to 10 mg per mol of silver halide.

* * * * *

UNITED STATES PATENT AND TRADEMARK OFFICE

CERTIFICATE OF CORRECTION

PATENT NO. : 4,914,016

DATED : April 3, 1990

INVENTOR(S) : Masanobu Miyoshi et al

It is certified that error appears in the above-identified patent and that said Letters Patent is hereby corrected as shown below:

Claim 14, Column 92, Line 10, "claim 3" should be --claim 13--;

Claim 37, Column 93, Line 33, "senstive" should be --sensitive--;

Claim 42, Column 93, Line 60, "claim 30" should be --claim 39--;

Claim 63, Column 95, Lines 3 and 4 should not be italicized.

Signed and Sealed this

First Day of December, 1992

*Attest:*

DOUGLAS B. COMER

*Attesting Officer*

*Acting Commissioner of Patents and Trademarks*